US012383805B2

(12) United States Patent
Spackman et al.

(10) Patent No.: US 12,383,805 B2
(45) **Date of Patent: *Aug. 12, 2025**

(54) CO-MOLDED GOLF PUTTER WITH INTEGRAL INTERLOCKING FEATURES

(71) Applicant: KARSTEN MANUFACTURING CORPORATION, Phoenix, AZ (US)

(72) Inventors: Clayson C. Spackman, Scottsdale, AZ (US); Tom J. Nuttall, Loughborough (GB); James D. Willmott, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/933,800

(22) Filed: Sep. 20, 2022

(65) Prior Publication Data

US 2023/0014500 A1 Jan. 19, 2023

Related U.S. Application Data

(63) Continuation of application No. 16/811,503, filed on Mar. 6, 2020, now Pat. No. 11,452,922.
(Continued)

(51) Int. Cl.
*A63B 53/04* (2015.01)
*A63B 53/02* (2015.01)
*A63B 53/08* (2015.01)

(52) U.S. Cl.
CPC ..... *A63B 53/0487* (2013.01); *A63B 53/02* (2013.01); *A63B 53/08* (2013.01);
(Continued)

(58) Field of Classification Search
CPC ..... A63B 53/0487; A63B 53/065
See application file for complete search history.

(56) References Cited

U.S. PATENT DOCUMENTS 3,652,093 A * 3/1972 Reuter, Jr. ..... A63B 53/0487 473/340
3,815,910 A * 6/1974 Raines ..... A63B 53/007 473/340

(Continued)

FOREIGN PATENT DOCUMENTS

JP 2003024488 A 1/2003
WO 2015160557 A1 10/2015

OTHER PUBLICATIONS

International Search Report, dated Jun. 10, 2020, and Written Opinion, dated Oct. 6, 2020, from PCT Appl. No. PCT/US20/021414.

*Primary Examiner* — Eugene L Kim
*Assistant Examiner* — Matthew B Stanczak

(57) ABSTRACT

Embodiments of a co-molded putter-type golf club head comprising a high-density chassis made of a first material and a low-density putter-type body made of a second material. The first material can be a high density metal (i.e., steel or tungsten, but not limited to). The second material can be a low density thermoplastic composite (i.e., polyphenylene sulfide (PPS), polyamide (PA), but not limited to). The chassis comprises a flow aperture, and one or more interlocking features. The putter-type body portion encases the entirety of the at least one interlocking feature. Further, the putter-type body encapsulates the chassis such that the body extends through, and completely fills the flow aperture, to interlock the body and chassis, and thus form the club head. Other embodiments may be described and claimed.

20 Claims, 25 Drawing Sheets

Related U.S. Application Data

(60) Provisional application No. 62/814,770, filed on Mar. 6, 2019.

(52) U.S. Cl.
CPC ..... *A63B 53/0412* (2020.08); *A63B 53/0437* (2020.08); *A63B 53/0441* (2020.08); *A63B 2053/0491* (2013.01); *A63B 2209/026* (2013.01)

(56) References Cited

U.S. PATENT DOCUMENTS 3,843,122 A * 10/1974 Florian ..... A63B 53/0487 473/340
3,866,922 A 2/1975 Marci
3,873,094 A * 3/1975 Sebo ..... A63B 53/0487 473/250
4,113,249 A * 9/1978 Beery ..... A63B 60/00 473/332
4,147,357 A * 4/1979 Strop ..... A63B 53/0487 473/251
4,222,566 A * 9/1980 Berry ..... A63B 53/04 473/250
4,324,404 A * 4/1982 Dian ..... A63B 53/007 473/250
4,534,558 A * 8/1985 Yoneyama ..... A63B 53/04 273/DIG. 8
4,635,941 A * 1/1987 Yoneyama ..... A63B 53/047 473/331
4,690,408 A * 9/1987 Kobayashi ..... A63B 60/00 473/349
4,693,478 A * 9/1987 Long ..... A63B 53/0487 473/251
4,697,814 A * 10/1987 Yamada ..... A63B 53/047 473/348
4,699,383 A * 10/1987 Kobayashi ..... A63B 53/047 473/348
4,708,347 A * 11/1987 Kobayashi ..... A63B 53/047 473/338
4,883,623 A * 11/1989 Nagamoto ..... A63B 53/04 264/108
4,991,843 A * 2/1991 Mori ..... A63B 53/04 473/312
5,004,242 A * 4/1991 Iwanaga ..... A63B 53/047 473/347
5,009,425 A * 4/1991 Okumoto ..... A63B 53/0466 273/DIG. 23
5,082,277 A * 1/1992 Gingold ..... A63B 53/0487 473/250
5,100,144 A * 3/1992 Okumoto ..... A63B 53/047 273/DIG. 7
5,246,227 A * 9/1993 Sun ..... A63B 53/0487 273/DIG. 1
5,324,031 A 6/1994 Green
5,328,175 A * 7/1994 Yamada ..... A63B 60/00 473/345
5,333,871 A * 8/1994 Wishon ..... A63B 53/04 273/DIG. 7
5,340,106 A * 8/1994 Ravaris ..... A63B 53/0487 473/328
5,482,281 A * 1/1996 Anderson ..... A63B 53/0487 473/341
5,683,307 A * 11/1997 Rife ..... A63B 53/0487 473/340
5,782,706 A * 7/1998 DePriest ..... A63B 60/02 473/341
5,797,176 A * 8/1998 Rose ..... A63B 53/0487 473/340
5,820,481 A * 10/1998 Raudman ..... A63B 53/0487 473/340
5,842,935 A * 12/1998 Nelson ..... A63B 53/0487 473/341
5,938,543 A * 8/1999 McGeeney ..... B29C 70/84 473/341
6,146,571 A * 11/2000 Vincent ..... B29C 45/4457 425/176
6,386,991 B1 * 5/2002 Reyes ..... A63B 53/0487 473/340
6,464,599 B1 * 10/2002 Wolf ..... A63B 60/02 473/340
6,569,032 B1 * 5/2003 Haliyo ..... A63B 53/0487 473/340
6,692,376 B2 * 2/2004 Kosovac ..... A63B 53/007 473/341
6,716,110 B1 4/2004 Ballow
6,974,394 B1 12/2005 Tang
6,984,181 B2 1/2006 Hettinger
6,988,955 B2 1/2006 Stoakes
7,156,752 B1 1/2007 Bennett
7,163,469 B2 1/2007 Bonneau
7,347,793 B2 3/2008 Davis
7,351,162 B2 4/2008 Soracco
7,371,184 B2 5/2008 Tao
7,384,345 B2 6/2008 Sherman
7,396,295 B1 * 7/2008 Frame ..... A63B 60/02 473/340
7,435,188 B2 10/2008 Tateno
7,455,599 B2 11/2008 Jones
7,491,135 B1 2/2009 Rollinson
7,648,425 B2 1/2010 Wahl
7,758,454 B2 7/2010 Burnett
7,798,919 B2 9/2010 Kubota
7,815,519 B2 10/2010 Bryant
7,819,757 B2 10/2010 Soracco
7,959,519 B2 * 6/2011 Zielke ..... A63B 60/00 473/250
8,057,323 B2 11/2011 Liang
8,128,505 B2 3/2012 Tryner
8,302,658 B2 * 11/2012 Gilbert ..... A63B 53/04 164/112
8,328,654 B2 12/2012 Demkowski
8,388,464 B2 3/2013 Gilbert
8,523,698 B2 9/2013 Hotaling
8,550,932 B2 10/2013 Franklin
8,632,415 B1 1/2014 Smith
9,022,876 B2 5/2015 Snyder
9,044,654 B2 * 6/2015 Mickle ..... A63B 53/0487
9,144,717 B2 9/2015 Franklin
9,220,960 B2 12/2015 Schartiger
9,289,659 B2 3/2016 Franklin
9,314,678 B2 4/2016 Quan
9,415,279 B2 8/2016 Foster
9,474,948 B2 10/2016 Dolezel
9,884,234 B1 * 2/2018 Fischer ..... A63B 53/0487
9,956,463 B2 5/2018 Franklin
10,434,386 B2 10/2019 Myers
11,020,640 B2 6/2021 Higdon
11,123,614 B2 9/2021 Parente
11,135,648 B1 * 10/2021 Maple ..... B22F 3/225
11,452,922 B2 * 9/2022 Spackman ..... A63B 53/0487
11,813,508 B2 * 11/2023 Higdon ..... A63B 53/0437
2002/0016219 A1 * 2/2002 Halko ..... A63B 53/0487 473/340
2002/0049093 A1 * 4/2002 Reyes ..... A63B 53/0487 473/340
2002/0103039 A1 * 8/2002 Shmoldas ..... A63B 53/04 473/340
2002/0169033 A1 * 11/2002 Sery ..... A63B 53/0487 473/324
2003/0162599 A1 * 8/2003 Klein ..... A63B 53/007 473/316
2003/0232661 A1 12/2003 Greer
2004/0058743 A1 * 3/2004 Hettinger ..... A63B 53/0487 473/340
2004/0254029 A1 * 12/2004 Souza ..... A63B 53/0487 473/340
2005/0192114 A1 9/2005 Zider
2006/0035718 A1 * 2/2006 Soracco ..... A63B 53/0487 473/340

(56) References Cited

U.S. PATENT DOCUMENTS

2006/0040764 A1* 2/2006 Soracco ..... A63B 53/0487 473/340
2006/0247071 A1 11/2006 Womersley
2007/0049401 A1* 3/2007 Tateno ..... A63B 53/0487 473/340
2007/0049402 A1* 3/2007 Sanchez ..... A63B 53/0487 473/340
2007/0270237 A1* 11/2007 Tavares ..... A63B 53/047 473/316
2008/0207352 A1 8/2008 Engel
2009/0029800 A1 1/2009 Jones
2010/0137074 A1* 6/2010 Gilbert ..... A63B 60/00 473/349
2010/0234127 A1* 9/2010 Snyder ..... A63B 53/007 473/331
2010/0323807 A1 12/2010 Rha
2011/0092306 A1 4/2011 Lee
2012/0115628 A1 5/2012 Woods
2014/0357403 A1* 12/2014 Quan ..... A63B 53/007 473/349
2016/0220875 A1 8/2016 Sanyal
2017/0036078 A1 2/2017 Serrano
2018/0243623 A1 8/2018 Patton
2019/0001200 A1* 1/2019 àWengen ..... A63B 53/007
2019/0022482 A1 1/2019 Sanyal
2019/0091527 A1* 3/2019 Serrano ..... A63B 53/0487
2020/0001150 A1 1/2020 Matthesen
2020/0038717 A1* 2/2020 Stubben ..... A63B 53/0487
2020/0282274 A1* 9/2020 Spackman ..... A63B 53/02
2021/0001190 A1 1/2021 Lambeth
2021/0138322 A1* 5/2021 Wang ..... A63B 53/0487
2021/0236906 A1* 8/2021 Feheley ..... A63B 71/0009
2021/0245020 A1* 8/2021 Higdon ..... A63B 53/0487
2021/0252350 A1* 8/2021 Patton ..... A63B 53/0416
2021/0362011 A1* 11/2021 Higdon ..... A63B 53/042
2021/0387063 A1* 12/2021 OBarske ..... A63B 53/0433
2022/0161108 A1* 5/2022 Higdon ..... A63B 53/0437

* cited by examiner

CO-MOLDED GOLF PUTTER WITH INTEGRAL INTERLOCKING FEATURES

RELATED APPLICATIONS

This is a continuation of U.S. patent application Ser. No. 16/811,503, filed on Mar. 6, 2020, now U.S. Pat. No. 11,452,922, issued on Sep. 27, 2022, which claims the benefit to U.S. Provisional Patent Appl. No. 62/814,770, filed on Mar. 6, 2019, the contents all of which are incorporated herein by reference.

TECHNICAL FIELD

The present disclosure relates generally to golf equipment, and more particularly, to co-molded golf putters with integral interlocking features.

BACKGROUND

Typically putter type golf club heads are formed from metallic materials such as stainless steel, aluminum, copper, or tungsten. These metallic materials are often combined to create a putter head, wherein the peripheral portion of the putter contains a high-density metal to increase the moment of inertia (MOI) of the putter. However, combining two metallic materials can create an extremely heavy putter or high-volume putter, without maximizing the MOI, thus creating an unforgiving or bulky putter. There is a need in the art to combine lightweight composite materials with high-density metallic materials to create a high-MOI putter with a modest weight and volume, no matter the overall design.

Figure 1:
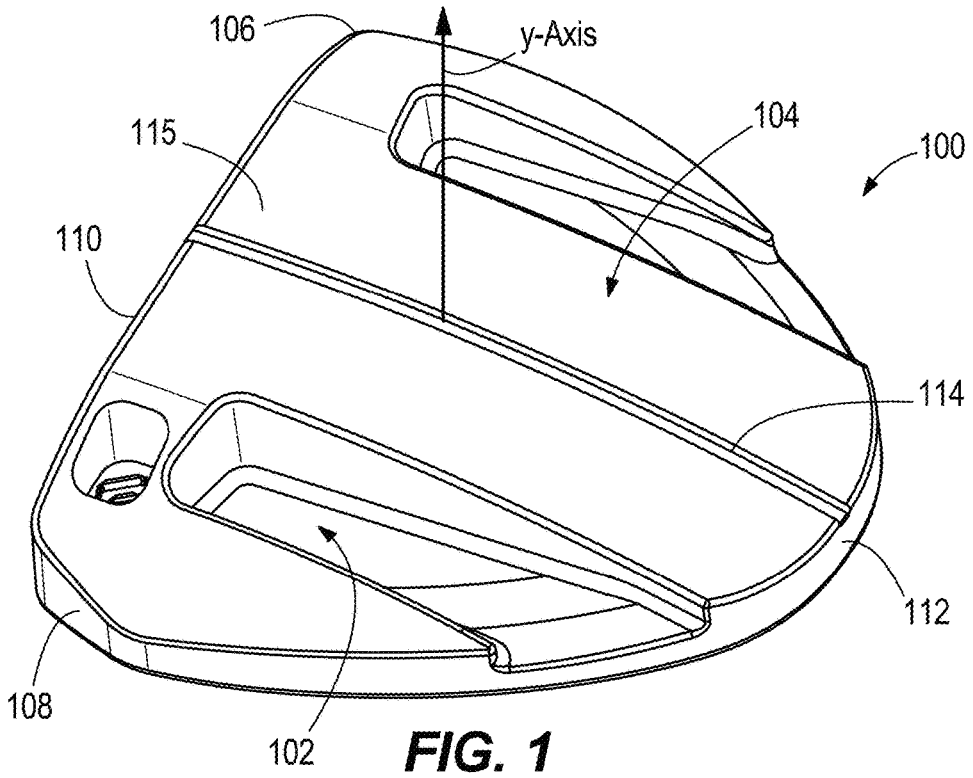
FIG. 1 illustrates a rear perspective view of a putter-type golf club.

Other aspects of the disclosure will become apparent by consideration of the detailed description and accompanying drawings.

DESCRIPTION

I. Putter Golf Club Head

Described herein is a putter-type golf club head comprising a high-density chassis made of a first material such as a high density metal (e.g., steel or tungsten, but not limited to) and a low density putter-type body portion, made of a second material, such as a low density thermoplastic composite (i.e., polycarbonate, polyurethane, polypropylene, polyphenylene sulfide (PPS), polyamide (PA), but not limited to). The chassis comprises a flow aperture, and one or more interlocking features. The putter-type body portion encases the entirety of the at least one interlocking feature(s). Further, the putter-type body encapsulates the chassis such that the body extends through, and completely fills the flow aperture, to interlock the body and chassis, and thus form the club head. This combination of a high density chassis, surrounded by a low density putter-type body portion results, in an increase of MOI about a y-axis of at least 5%, over a putter with the same volume, mass, and an entire metallic material construction (i.e., a putter milled of a single material such as a steel putter or a putter investment cast of a single material). Furthermore, the combination of a low density thermoplastic composite body and a high density chassis, can lead to improvements in the sound of the putter, as well as decreased manufacturing costs.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

In many embodiments, the golf club head can comprise a putter-type golf club head (the putter type golf club head 100, 1100, 2100, 3100 4100 . . . etc.). FIGS. 1-41 illustrate multiple embodiments of a putter-type golf club head having a chassis and putter-type body integrally formed together. The putter-type golf club head can be a mallet-type putter head, mid-mallet type putter head, a blade type putter head, a high MOI putter head, or any other type of putter-type golf club head.

The putter-type golf club head 100 comprises a chassis 102 and putter-type body 104 (can also be referred to as the body 104). The putter-type body 104 can partially or entirely enclose (or encapsulate) the chassis 102 to form the features of the putter-type golf club head 100. The golf club head 100 can comprise a toe end 106, and a heel end 108 opposite the toe end 106. The golf club head 100 can comprise a striking surface 110, and a rear portion 112 opposite the striking surface 110. Further, the putter-type golf club head 100 can comprise an alignment feature 114. The putter-type golf club head 100 comprises a sole 117. The sole 117 spans from the heel end 108 to the toe end 106, and from the striking surface 110 to the rear portion 112. The sole is 117 is positioned in a ground plane, when the putter 100 is at an address position (i.e., in a position to strike a golf ball). The putter-type golf club head 100 comprises a crown 115, wherein the crown 115 is opposite the sole 117. The crown 115 spans from the heel end 108 to the toe end 106, and from the striking surface 110 to the rear portion 112. The crown 115 is visible by the golfer when the putter 100 is at an address position.

The golf club head 100 striking surface 110 comprises a loft plane (not shown). The loft place is tangent to the striking surface 110. The loft plane intersects the ground plane, such that to form a loft angle. In many embodiments, the putter-type golf club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

The golf club head 100 comprises a golf club head center of gravity that is positioned within the golf club. The center of gravity is average location of a weight of the golf club head 100. Referring to FIG. 1, the golf club head 100 further comprises a y-axis that is positioned within the center of gravity, is perpendicular to the ground plane, in extends in a direction away from the golf club head 100 crown 115. The y-axis is the axis that which the heel end 108 and toe end 106 rotate about during a putting stroke with club head 100. Improving the MOI about the y-axis prevents the golf club head from rotating about the y-axis, thus leading to straighter putts.

Furthermore, the putter-type golf club head 100 can comprise a hosel 119 attached to the heel end 108 of the golf club head 100. In some embodiments, the hosel 119 may be attached to a center (not shown) of the putter-type golf club head 100. The hosel 119 may be integrally formed with the putter-type body 104 of the putter-type golf club head 100. The hosel 119 may be integrally formed with the chassis 102 of the putter-type golf club head 100.

The golf club head 100 may comprise two or more materials. The chassis 102 can comprise a first material. The putter-type body 104 can comprise a second material. The first material is different than the second material. The first material has a first density. The second material has a second density. The first density is not the same as the second density. The first density can be greater than the second density.

In many embodiments, the putter-type golf club head 100 can have a mass that ranges between 320 and 385 grams. In other embodiments, the mass of the putter-type golf club head 100 can range between 320 grams-325 grams, 325 grams-330 grams, 330 grams-335 grams, 335 grams-340 grams, 340 grams-345 grams, 345 grams-350 grams, 350 grams-355 grams, 355 grams-360 grams, 360 grams-365 grams, 365 grams-370 grams, 370 grams-375 grams, 375 grams-380 grams, or 380 grams-385 grams. In some embodiments, the mass of the putter-type golf club head can be 320 grams, 321 grams, 322 grams, 323 grams, 324 grams, 325 grams, 326 grams, 327 grams, 328 grams, 329 grams, 330 grams, 331 grams, 332 grams, 333 grams, 334 grams, 335 grams, 336 grams, 337 grams, 338 grams, 339 grams, 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, 365 grams, 366 grams, 367 grams, 368 grams, 369 grams, 370 grams, 371 grams, 372 grams, 373 grams, 374 grams, 375 grams, 376 grams, 377 grams, 378 grams, 379 grams, 380 grams, 381 grams, 382 grams, 383 grams, 384 grams, or 385 grams.

In many embodiments, the putter type golf club head 100 can comprise a club head volume ranging between 25 cc and 125 cc. In some embodiments, the club head volume can range between 25 cc-30 cc, 30 cc-35 cc, 35 cc-40 cc, 40 cc-45 cc, 45 cc-50 cc, 50 cc-55 cc, 55 cc-60 cc, 60 cc-65 cc, 65 cc-70 cc, 70 cc-75 cc, 75 cc-80 cc, 80 cc-85 cc, 85 cc-90 cc, 90 cc-95 cc, 95 cc-100 cc, 100 cc-105 cc, 105 cc-110 cc, 110 cc-115 cc, 115 cc-120 cc, or 120 cc-125 cc. In one embodiment, the club head volume can range between 40 cc-110 cc. In some embodiments, the club head volume can be greater than 25 cc, greater than 50 cc, greater than 75 cc, or greater than 100 cc.

In some embodiments, the putter type golf club head 100 can comprise a striking surface 110. The striking surface 110 can be made of the first material or the second material. In other embodiments, the striking surface 110 can be made of a third material. In these embodiments, the third material of the striking surface 110 can be any one or combination of the following: a thermoplastic polymer matrix material and a filler. Exemplary thermoplastic polymer matrix materials include polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), polyamide 11 (PA11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherimide (PEI), polyvinylidene fluoride (PVDF), polymethylmethacrylate (PMMA), polyether ether ketone (PEEK), polyether ketone (PEK), polyetherimide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), or alloys of the above described thermoplastic materials, such as an alloy of acrylonitrile butadiene styrene (ABS) and polycarbonate (PC) or an alloy of acrylonitrile butadiene styrene (ABS) and polyamide (PA).

In some embodiments, the striking surface 110 can be integrally formed to the putter-type body 104. In most embodiments, the striking surface 110 can be integrally formed to the club head 100 by co-molding, injection molding, casting, additive manufacturing or other forming process. In some embodiments, the thermoplastic composite material can include thermoplastic polyurethane (TPU) as the thermoplastic polymer matrix material. TPU comprises a chemical structure consisting of linear segmented block copolymers having hard and soft segments. In some embodiments, the hard segments comprise aromatic or aliphatic structures, and the soft segments comprise polyether or polyester chains. In other embodiments, the thermoplastic polymer matrix material comprising TPU can have a hard and soft segments with different chemical structures.

Figure 25:
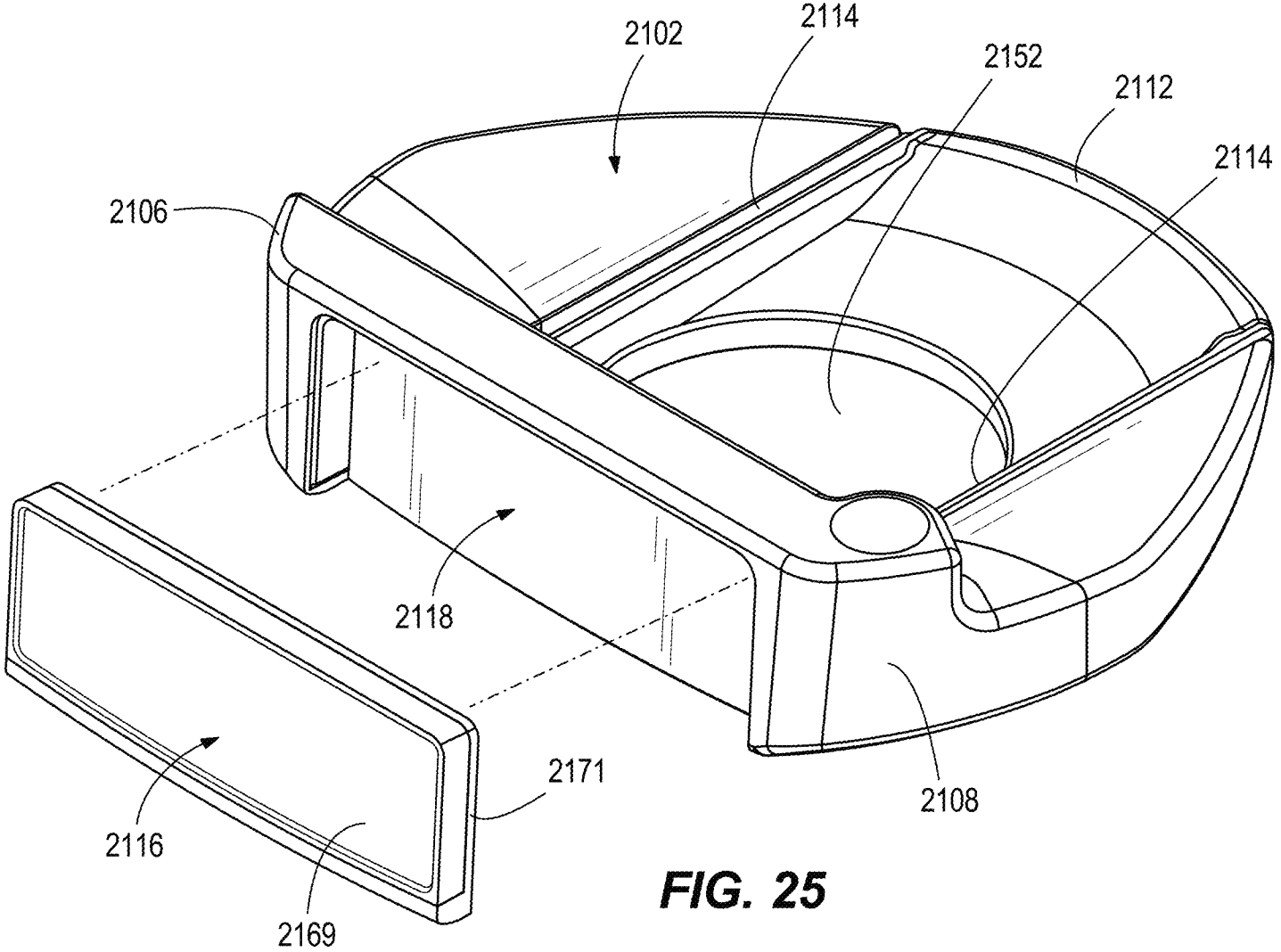
FIG. 25 illustrates a front exploded view of the putter-type golf club of FIG. 22.
Figure 41:
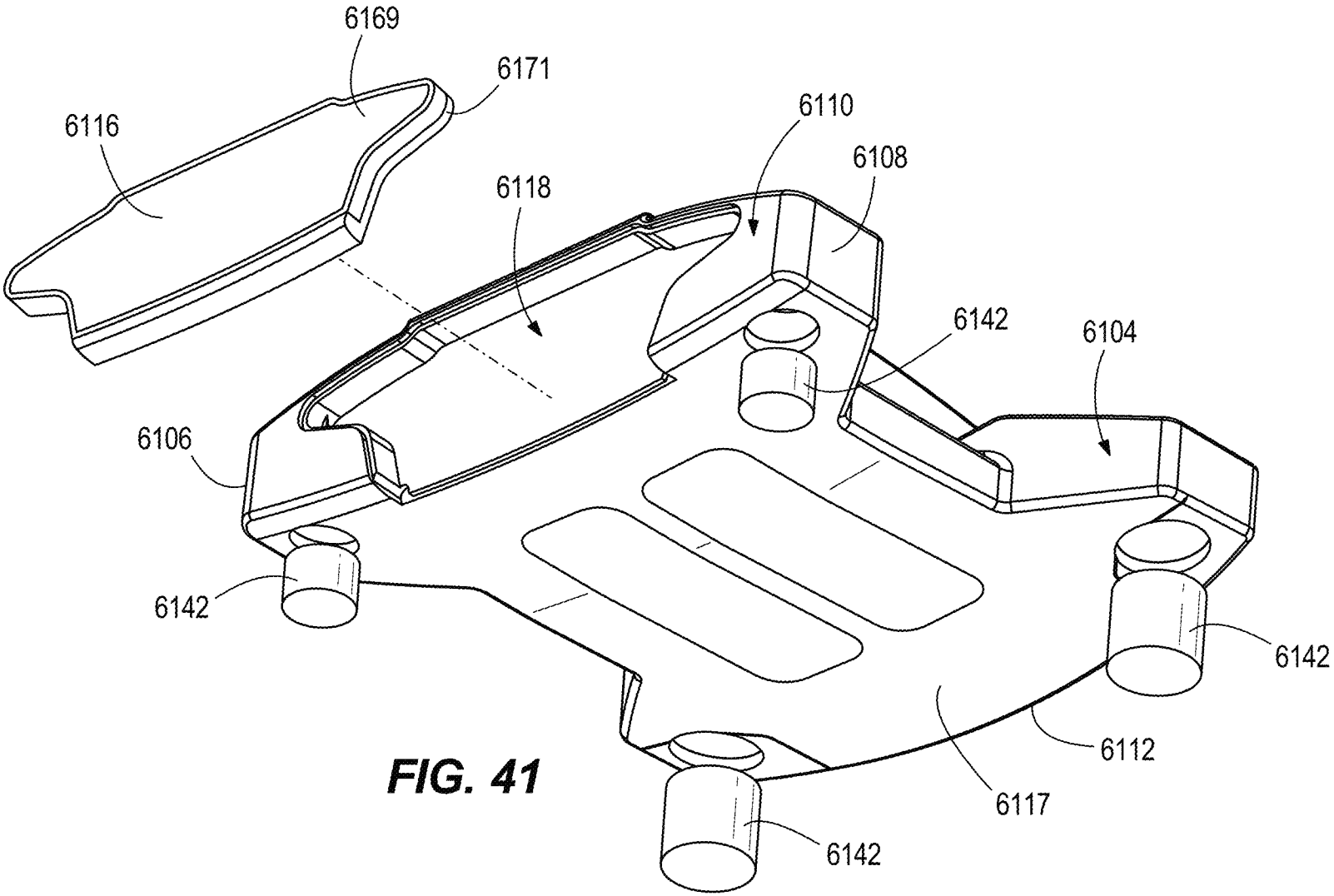
FIG. 41 illustrates a bottom assembly view of the putter-type golf club of FIG. 37.

In some embodiments, referring to FIGS. 25 and 41, the putter-type golf club head 100 can comprise a strike face insert 116, positioned on or within the striking surface 110. In these embodiments, the strike face insert 116 is independently formed prior to being coupled to the club head 100. The side of the strike face insert 116 that will contact the club head 100 can comprise a geometry complementary to the geometry of the corresponding portion (i.e., a cavity in the striking surface of the putter-type golf club head) of the club head 100 that will contact the striking surface 110. In some embodiments, the strike face insert 116 can be made of the first material, the second material, or the third material. In many embodiments, the putter head 100, can comprise a chassis 102, of the first material, a putter-type body 104, of the second material, and a strike face insert 116, comprising the third material.

The strike face insert 116 can be secured to the club head 100 by being integrally formed to a portion of the club head 100 or by a fastening means. In some embodiments, the strike face insert 116 is secured to the putter-type body 104. In these embodiments, in reference to FIGS. 25 and 41, the putter-type body 104 can comprise an insert cavity 118, wherein the cavity 118 functions to receive the strike face insert 116. In other embodiments (not shown), the strike face insert 116 is secured to the chassis 104. In these embodiments, the chassis 102 can comprise the insert cavity 118. The chassis insert cavity 118 functions to receive the strike face insert 116. The strike face insert 116 can be secured by an adhesive such as glue, very high bond (VHB™) tape, epoxy or another adhesive. Alternately or additionally, the strike face insert 116 can be secured by welding, soldering, screws, rivets, pins, mechanical interlock structure, or another fastening method.

The strike face insert 116 can comprise any one or layered combination of the following materials: aluminum, stainless steel, copper, thermoplastic co-polyester elastomer (TPC), thermoplastic elastomer (TPE), thermoplastic urethane (TPU), steel, nickel, TPU/aluminum, TPE/aluminum, plastic/metal screen insert, polyethylene, polypropylene, polytetrafluoroethylene, polyisobutylene, polyvinyl chloride, PEBAX®, or any other desired material. PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetra methylene oxide (53% wt) and a Nylon 12. The PEBAX® 6333 (Arkema, Paris France) comprises a Nylon 11.

The PEBAX® can comprise a percentage of polyether by volume. In some embodiments, the PEBAX® can comprise 0% to 10%, 10% to 20%, 15% to 30%, 20% to 30%, 30% to 40%, 30% to 50%, 30% to 60%, 40% to 50%, 40% to 60%, 50% to 60%, or 60% to 70% polyether by volume. For example, the PEBAX® can comprise 0%, 5%, 10%, 15%, 20%, 25%, 30%, 35%, 40%, 45%, 50%, 55%, 60%, 65%, or 70% of polyether by volume. In some embodiments, the PEBAX® can comprise 0% to 10%, 10% to 20%, 15% to 30%, 20% to 30%, 30% to 40%, 40% to 50%, 40% to 60%, 50% to 60%, or 60% to 70% of polyamide by volume. For example, the PEBAX® can comprise 0%, 5%, 10%, 15%, 20%, 25%, 30%, 35%, 40%, 45%, 50%, 55%, 60%, 65%, or 70% of polyamide by volume. As the percentage of polyether percentage increases, the hardness of the PEBAX® decreases. As the percentage of polyamide percentage increases, the hardness of the PEBAX® increases. For example, the PEBAX® 4033 (Arkema, Paris France) can comprise 40% to 60% polyether by volume and 15% to 30% polyamide by volume. For example, the PEBAX® 6333 (Arkema, Paris France) can comprise 15% to 30% polyether by volume and 40% to 60% polyamide by volume.

In many embodiments, the PEBAX® can comprise a hardness ranging from Shore 25D to Shore 75D. In some embodiments, the hardness of the PEBAX can range from Shore 25D to Shore 35D, Shore 35D to Shore 45D, Shore 36D to Shore 44D, Shore 38D to Shore 42D, Shore 45D to Shore 55D, Shore 55D to Shore 65D, Shore 56D to Shore 64D, Shore 60D to Shore 65D, or Shore 65D to Shore 75D. For example, the hardness of the PEBAX can be Shore D 25, 30, 35, 40, 45, 50, 55, 60, 65, or 70.

In many embodiments, the PEBAX® 4033 (Arkema, Paris France) can comprise a lower hardness than the PEBAX® 6333 (Arkema, Paris France). In many embodiments, the PEBAX® 4033 (Arkema, Paris France) can comprise a hardness range of Shore 35D to Shore 55D. In some embodiments, the PEBAX® 4033 (Arkema, Paris France) can comprise a hardness range of Shore 38D to Shore 42D, or Shore 39D to Shore 41D. For example, the PEBAX® 4033 (Arkema, Paris France) can be comprise a Shore D hardness of 40. In many embodiments, the PEBAX® 6333 (Arkema, Paris France) can comprise a hardness range of Shore 50D to Shore 75D. In some embodiments, the PEBAX® 6333 (Arkema, Paris France) can comprise a hardness range of Shore 55D to Shore 70D, or Shore 60D to Shore 65D. For example, the PEBAX® 6333 (Arkema, Paris France) can comprise a Shore D hardness of 63.

In some embodiments, FIGS. 25 and 41, the strike face insert 116 can comprise a two-component system. The two-component system can comprise a ball striking face plate 169 and a face insert base 171. The ball striking face plate 169 of the face insert 116 can comprise a fourth material. The face insert base 171 of the face insert 116 can comprise a fifth material.

In many embodiments, the fourth material of the ball striking face plate 169 and the fifth material of the face insert base 171 can be different. In some embodiments, the fourth material of the ball striking face plate 169 and the fifth material of the face insert base 171 can be similar. In many embodiments, the fourth material of the ball striking face plate 169 can comprise a polymer type material. In some embodiments, the fourth material of the ball striking face plate 169 can comprise a metallic material. In many embodiments, the fifth material of the striking face insert base 171 can comprise a polymer type material. In most embodiments, the putter head 100, can comprise a chassis 102, of the first material, a putter-type body 104, of the second material, and a strike face insert 116, comprising the fourth and fifth material.

The fourth material can comprise a metal such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

The fourth material or the fifth material can comprise a polymer type material. The polymer type material can comprise polyethylene, polypropylene, polytetrafluoroethylene, polyisobutylene, polyvinyl chloride, or any other polymer type material. In many embodiments, the face insert 116 can comprise a PEBAX®. More specifically, the PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. The fourth material and the fifth material can comprise similar polyether percentages, polyamide percentages, or Shore D hardness values as described above.

The ball striking face plate 169 of the face insert 116 can comprise a thickness. In many embodiments, the thickness of the ball striking face plate 169 can range from 0.015 to 0.115 inch. In some embodiments, the thickness of the ball striking face plate 169 can range from 0.015 to 0.045 inch, 0.020 to 0.050 inch, 0.025 to 0.055 inch, 0.050 to 0.100 inch, 0.055 to 0.105 inch, 0.060 to 0.110, or 0.065 to 0.115 inch. In some embodiments, the thickness of the ball striking face plate 169 can be at least 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate 169 can be greater than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate 169 can be less than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. For example, the thickness of the ball striking face plate 169 can be 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch.

In other embodiments, the thickness of the ball striking face plate 169 can range from 0.115 to 0.40 inch. In some embodiments, the thickness of the ball striking face plate 169 can range from 0.115 to 0.20 inch, 0.15 to 0.30 inch, 0.20 to 0.30 inch, 0.25 to 0.35 inch, or 0.30 to 0.40 inch. In some embodiments, the thickness of the ball striking face plate 169 can be at least 0.15, 0.20, 0.25, 0.30, 0.35, or 0.40 inch. In some embodiments, the thickness of the ball striking face plate 169 can be greater than or equal to 0.15, 0.20, 0.25, 0.30, 0.35, or 0.40. In some embodiments, the thickness of the ball striking face plate 169 can be less than or equal to 0.15, 0.20, 0.25, 0.30, 0.35, or 0.40 inch. For example, the thickness of the ball striking face plate 169 can be 0.15, 0.20, 0.25, 0.30, 0.35, or 0.40 inch.

The face insert base 171 of the face insert 116 can comprise a thickness. In many embodiments, the thickness of the face insert base 171 can range from 0.05 to 0.20 inch. In some embodiment, the thickness of the face insert base 171 can range from 0.05 to 0.10 inch, or 0.10 to 0.20 inch. In some embodiments, the thickness of the face insert base 171 can be at least 0.05, 0.10, 0.15, or 0.20 inch. In some embodiments, the thickness of the face insert base 171 can be greater than or equal to 0.05, 0.10, 0.15, or 0.20 inch. In some embodiments, the thickness of the face insert base 171 can be less than or equal to 0.05, 0.10, 0.15, or 0.20 inch. For example, the thickness of the face insert base 171 can be 0.05, 0.10, 0.15, or 0.20 inch.

In other embodiments, the thickness of the face insert base 171 can range from 0.20 to 0.80 inch. In some embodiments, the thickness of the face insert base 171 can range from 0.20 to 0.50 inch, 0.30 to 0.60 inch, 0.40 to 0.70 inch, or 0.50 to 0.80 inch. In some embodiment, the thickness of the face insert base 171 can range from 0.20 to 0.40 inch, 0.30 to 0.50 inch, 0.40 to 0.60 inch, 0.50 to 0.70 inch, or 0.60 to 0.80 inch. In some embodiments, the thickness of the face insert base 171 can be at least 0.20, 0.25, 0.30, 0.35, 0.40, 0.45, 0.50, 0.55, 0.60, 0.65, 0.70, 0.75, or 0.80 inch. In some embodiments, the thickness of the face insert base 171 of the face insert 116 can be greater than or equal to 0.20, 0.25, 0.30, 0.35, 0.40, 0.45, 0.50, 0.55, 0.60, 0.65, 0.70, 0.75, or 0.80 inch. In some embodiments, the thickness of the face insert base 171 can be less than or equal to 0.20, 0.25, 0.30, 0.35, 0.40, 0.45, 0.50, 0.55, 0.60, 0.65, 0.70, 0.75, or 0.80 inch. For example, the thickness of the face insert base 171 can be 0.20, 0.25, 0.30, 0.35, 0.40, 0.45, 0.50, 0.55, 0.60, 0.65, 0.70, 0.75, or 0.80 inch.

In many embodiments, the chassis 102 of the putter-type golf club head 100 comprises the first material. The first material comprises a first density. The chassis 102 can range between 7.0 g/cc and 20.0 g/cc. In some embodiments, the first density can range between 7.0-7.5 g/cc, 7.5-8.0 g/cc, 8.0-8.5 g/cc, 8.5-9.0 g/cc, 9.0-9.5 g/cc, 9.5-10.0 g/cc, 10.0-10.5 g/cc, 10.5-11.0 g/cc, 11.0-11.5 g/cc, 11.5-12.0 g/cc, 12.0-12.5 g/cc, 12.5-13.0 g/cc, 13.0-13.5 g/cc, 13.5-14.0 g/cc, 14.0-14.5 g/cc, 14.5-15.0 g/cc, 15.0-15.5 g/cc, 15.5-16.0 g/cc, 16.0-16.5 g/cc, 16.5-17.0 g/cc, 17.0-17.5 g/cc, 17.5-18.0 g/cc, 18.0-18.5 g/cc, 18.5-19.0 g/cc, or 19.0-19.5 g/cc, or 19.5-20.0 g/cc. In one embodiment, the first density of the first material in the chassis 102 can range between 8.0-9.0 g/cc. In some embodiments, the first density can be 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, or 20.0 g/cc.

The chassis 102 of the putter-type golf club 100 having the first material can be made from any one or more combination of the following materials (densities provided): 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), manganese (7.43 g/cc) or any metal suitable for creating a golf club head. In many embodiments, the chassis 102 is made of 304 stainless steel, 8620 alloy steel, 17-4 stainless steel, 1380 stainless steel, tungsten, or a combination of stainless steel and tungsten. However, the chassis 102 and putter type body 104 are not made from the same one material or the same combination of materials.

The putter-type body 104 of the golf club 100 having the second material can be made from any one or combination of the following: polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), polyamide 11 (PA11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherimide (PEI), polyvinylidene fluoride (PVDF), polymethylmethacrylate (PMMA), polyether ether ketone (PEEK), polyether ketone (PEK), polyetherimide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), or alloys of the above described thermoplastic materials, such as an alloy of acrylonitrile butadiene styrene (ABS) and polycarbonate (PC) or an alloy of acrylonitrile butadiene styrene (ABS) and polyamide (PA).

In many embodiments, the putter-type body 104 of the putter-type golf club head 100 having the second material comprises a second density ranging between 1.0 g/cc and 6.0 g/cc. The density of the second material is a second density to the first density of the first material in the chassis 102. The second density can range between 2.0 g/cc to 5.0 g/cc. In some embodiments, the second density can range between 1.0-1.25 g/cc, 1.25-1.5 g/cc, 1.5-1.75 g/cc, 1.75-2.0 g/cc, 2.0-2.25 g/cc, 2.25-2.5 g/cc, 2.5-2.75 g/cc, 2.75-3.0 g/cc, 3.25-3.5 g/cc, 3.5-3.75 g/cc, 3.75-4.0 g/cc, 4.0-4.25 g/cc, 4.25-4.5 g/cc, 4.5-4.75 g/cc, 4.75-5.0 g/cc, 5.0-5.25 g/cc, 5.0-5.25 g/cc, 5.25-5.5 g/cc, 5.5-5.75 g/cc, or 5.75-6.0 g/cc. In one embodiment, the second density of the putter-type body can range between 2.0-3.0 g/cc. In some embodiments, the second density can be less 6.0 g/cc, less than 5.0 g/cc, less than 4.0 g/cc, less than 3.0 g/cc, or less than 2.0 g/cc. In some embodiments, the second density can be 1.25 g/cc, 1.50 g/cc, 1.75 g/cc, 2.0 g/cc, 2.25 g/cc, 2.50 g/cc, 2.75 g/cc, 3.0 g/cc, 3.25 g/cc, 3.50 g/cc, 3.75 g/cc, 4.0 g/cc, 4.25 g/cc, 4.50 g/cc, 4.75 g/cc, 5.0 g/cc, 5.25 g/cc, 5.50 g/cc, 5.75 g/cc, or 6.0 g/cc.

In some embodiments, the first density of the chassis can be at least 2 times greater than the second density, at least 3 times greater than the second density, at least 4 times greater than the second density, or at least 5 times greater than the second density. In some embodiments, the first density can be greater than 7.0 g/cc, greater than 9.0 g/cc, greater than 10.0 g/cc, greater than 11.0 g/cc, or greater than 12.0 g/cc.

In many embodiments, the putter-type body 104 of the putter-type golf club head 100 having the second material can be formed from a thermoplastic composite material that comprises a thermoplastic polymer matrix material and a filler. Exemplary thermoplastic polymer matrix materials include polycarbonate (PC), polyester (PBT), polyphenylene sulfide (PPS), polyamide (PA) (e.g. polyamide 6 (PA6), polyamide 6-6 (PA66), polyamide-12 (PA12), polyamide-612 (PA612), polyamide 11 (PA11)), thermoplastic polyurethane (TPU), polyphthalamide (PPA), acrylonitrile butadiene styrene (ABS), polybutylene terephthalate (PBT), polyvinylidene fluoride (PVDF), polyethylene (PE), polyphenylene ether/oxide (PPE), polyoxymethylene (POM), polypropylene (PP), styrene acrylonitrile (SAN), polymethylpentene (PMP), polyethylene terephthalate (PET), acrylonitrile styrene acrylate (ASA), polyetherimide (PEI), polyvinylidene fluoride (PVDF), polymethylmethacrylate (PMMA), polyether ether ketone (PEEK), polyether ketone (PEK), polyetherimide (PEI), polyethersulfone (PES), polyphenylene oxide (PPO), polystyrene (PS), polysulfone (PSU), polyvinyl chloride (PVC), liquid crystal polymer (LCP), thermoplastic elastomer (TPE), ultra-high molecular weight polyethylene (UHMWPE), or alloys of the above described thermoplastic materials, such as an alloy of acrylonitrile butadiene styrene (ABS) and polycarbonate (PC) or an alloy of acrylonitrile butadiene styrene (ABS) and polyamide (PA).

For example, in some embodiments, the thermoplastic composite material can include thermoplastic polyurethane (TPU) as the thermoplastic polymer matrix material. TPU comprises a chemical structure consisting of linear segmented block copolymers having hard and soft segments. In some embodiments, the hard segments comprise aromatic or aliphatic structures, and the soft segments comprise polyether or polyester chains. In other embodiments, the thermoplastic polymer matrix material comprising TPU can have a hard and soft segments with different chemical structures. For further example, in some embodiments, the thermoplastic composite material can include polyamine 6-6 (PA66) or polyamide 6 (PA6) as the thermoplastic polymer matrix material. PA66 is a type of polyamide made of two monomers, including hexamethylenediamine and adipic acid, each containing 6 carbon atoms.

The fillers of the thermoplastic composite material can include fibers, beads, or other structures comprising various materials (described below) that are mixed with the thermoplastic polymer. The fillers can provide structural reinforcement, weighting, lightening, or various other characteristics to the thermoplastic composite material. In many embodiments, the fillers can comprise carbon or glass. However, in other embodiments, the fillers can comprise other suitable materials. For example, the fillers of one or more lamina layer can comprise aramid fibers (e.g. Nomex, Vectran, Kevlar, Twaron), bamboo fibers, natural fibers (e.g. cotton, hemp, flax), metal fibers (e.g. titanium, aluminum), glass beads, tungsten beads, or ceramic fibers (e.g. titanium dioxide, granite, silicon carbide).

The fillers or fibers can be short (less than approximately 0.5 mm in length or diameter), long (ranging in length or diameter between approximately 0.5 mm to approximately 40 mm, or more preferably between approximately 5 mm and approximately 12 mm), or continuous (greater than approximately 40 mm in length). In many embodiments, the front body 12 and the rear body 14 comprise short and/or long fibers. In other embodiments, the front body 12 and the rear body 14 can comprise continuous fibers instead of, or in addition to the short and long fibers.

In many embodiments, the thermoplastic composite material can comprise 30-40% fillers by volume. In other embodiments, the thermoplastic composite material can comprise up to 55%, up to 60%, up to 65%, or up to 70% fillers by volume.

In many embodiments, the thermoplastic composite comprises a specific gravity of approximately 1.0-2.0, which is significantly lower than the specific gravity of metallic materials used in golf (e.g. the specific gravity of titanium is approximately 4.5 and the specific gravity of aluminum is approximately 2.7). Further, in many embodiments, the thermoplastic composite material comprises a strength to weight ratio or specific strength greater than 1,000,000 PSI/(lb/in3), and a strength to modulus ratio or specific flexibility greater than 0.009. The specific gravity, specific strength, and specific flexibility of the thermoplastic composite material enable significant weight savings in the club head 100, while maintaining durability.

a.) Chassis

Referring to FIGS. 1-4, the putter-type golf club head 100 further, comprises a high density chassis 102, along with a putter-type body 104. The chassis 102 is configured and positioned to be molded to the putter-type body 104, to form the putter-type golf club head 100. The chassis 102 comprises at least one interlocking feature 120 and a flow aperture 122. The at least one interlocking feature 120, allows for the light-weight material (second density material) of the putter-type body 104 to encase the entirety of the at least one interlocking feature 120. Further, the flow aperture 122, allows the light-weight material of the putter-type body 104 to extend through and completely fill the flow aperture 122, to interlock the body 104 and the chassis 102, and form the putter-type golf club head 100. Furthermore, the chassis 102 provides a high-density peripheral structure, that a low-density putter-type body 104 can be formed around, to create a putter 100 with an extremely high MOI putter, while keeping the golf club head at a desirable overall weight.

The chassis 102, in some embodiments, comprises less than 50% of a total volume of the putter 100. In other embodiments, the chassis 102 comprises less than 70% of the total volume of the putter 100, less than 65% of the total volume of the putter 100, less than 60% of the total volume of the putter 100, less than 55% of the total volume of the putter 100, less than 50% of the total volume of the putter 100, less than 45% of the total volume of the putter 100, less than 40% of the total volume of the putter 100, or less than 35% of the total volume of the putter 100. In some embodiments, the chassis 102 can range between 20%-25% of the total volume of the putter 100, 25%-30% of the total volume of the putter 100, 30%-35% of the total volume of the putter 100, 35%-40% of the total volume of the putter 100, 40%-45% of the total volume of the putter 100, 45%-50% of the total volume of the putter 100, 50%-55% of the total volume of the putter 100, 55%-60% of the total volume of the putter 100, 60%-65% of the total volume of the putter 100, or 65%-70% of the total volume of the putter 100.

Although the chassis 102 comprises less than half of the volume of the putter 100, the chassis 102 comprises at least 60% of an overall mass of the putter 100. In some embodiments, the chassis 102 comprises at least 60% of the overall mass of the putter 100, at least 65% of the overall mass of the putter 100, at least 70% of the overall mass of the putter 100, or at least 75% of the overall mass of the putter 100. In other embodiments, the chassis can range between 45%-50% of the overall mass of the putter 100, 50%-55% of the overall mass of the putter 100, 55%-60% of the overall mass of the putter 100, 60%-65% of the overall mass of the putter 100, 65%-70% of the overall mass of the putter 100, 70%-75% of the overall mass of the putter 100, 75%-80% of the overall mass of the putter 100, or 80%-85% of the overall mass of the putter 100.

The beneficial shift of mass to the periphery of the putter head 100, through the use of a high density, low volume chassis 102, increases the MOI of the putter 100, over a putter with the same volume, mass, and single material construction (or multi-metal construction) (i.e., a putter milled of a single stainless steel block, or a putter investment cast of two metals).

In most embodiments, the chassis 102 comprises a heel portion 124. The chassis 102 comprises a toe portion 126, opposite the heel portion 124. The chassis 102 comprises a rear 128. The rear 128 is adjacent the heel portion 124 and the toe portion 126. In some embodiments, the chassis 102 can comprise a central strut 132. The central strut 132 spans from the heel portion 124 to the toe portion 126, opposite the rear 128. The chassis 102 comprises a front 130. The front 130 is formed by the toe portion 126, the heel portion 124, and the central strut 132. The front 130 is opposite the rear 128, adjacent the heel portion 124, and adjacent the toe portion 126.

Further, the chassis 102 can comprise an upper surface 134. The upper surface 134 is adjacent the rear 128, the front 130, the toe portion 126, and the heel portion 124. The chassis 102 comprises a lower surface 136. The lower surface is opposite the upper surface 134, and is adjacent the rear 128, the front 130, the toe portion 126, and the heel portion 124. In many embodiments, the chassis 102 can be "U-shaped," horseshoe shaped, parabolically shaped, ring shaped, dumbbell shaped, trapezoidal, polygonal, hourglass shaped, semi-circular, asymmetrical, symmetrical, spade shaped, "H-shaped," "I-shaped," or any other desirable chassis 102 shape.

In most embodiments, the chassis 102 shape fosters the desirable shift of mass towards the peripheries (toe, heel, rear, front) of the chassis 102 and the peripheries of the putter-type golf club head 100. Certain chassis 102 shapes can be used for certain types of putter heads, to drastically increase the MOI of the resulting co-molded putter. For example, a dumbbell shaped, "I-shaped," or asymmetrical chassis 102 can be used for a blade style putter, wherein mass needs to only be moved toward the heel end 108 and the toe end 106, in order to increase the MOI. In another example, a "U-shaped," horseshoe shaped, or parabolic shaped chassis 102 can be used for a mid-mallet or mallet style putter, wherein mass needs to be moved toward the heel end 108, the toe end 106, the striking surface 110, and the rear portion 112, in order to increase the MOI. In yet another example, a semi-circular, asymmetrical, symmetrical, spade shaped, or "H-shaped" chassis 102 can be used for a mid-mallet or mallet style putter, wherein mass needs to be moved toward the heel end 108, the toe end 106, the striking surface 110, and the rear portion 112, in order to increase the MOI. The shape and weight allocation of the chassis 102, drastically increases the MOI of the putter head 100, when the high-density chassis 102 is combined with the low density, lightweight putter-type body 104. Although certain chassis 102 shapes are used for certain putter types, any chassis 102 shape can be used for any type of putter (i.e., blade, mi-mallet, mallet).

Figure 2:
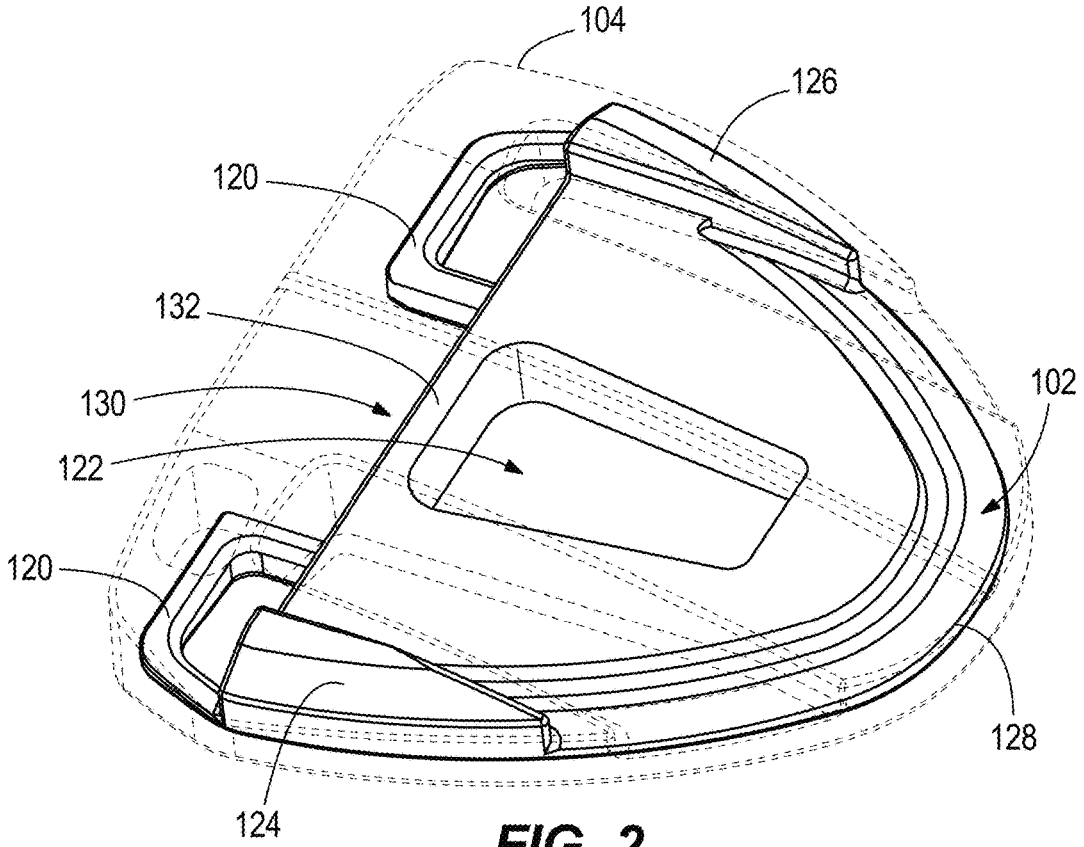
FIG. 2 illustrates a rear perspective view of the combination of a putter-type body and a chassis of the putter-type golf club of FIG. 1.
Figure 3:
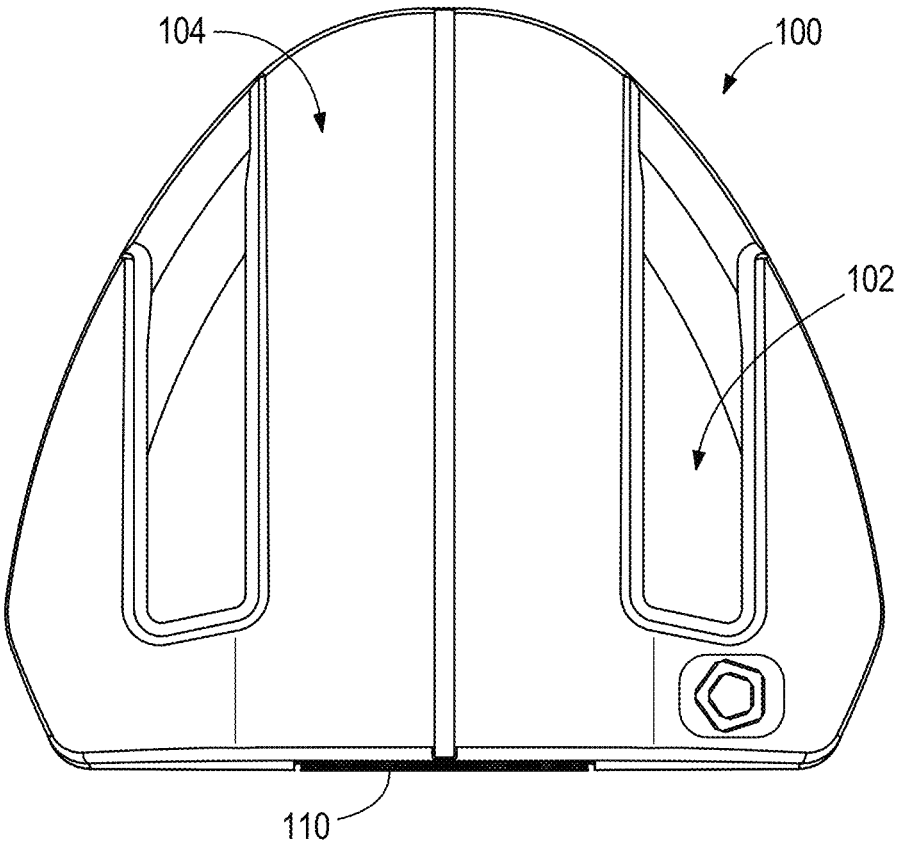
FIG. 3. illustrates a top view of the putter-type golf club of FIG. 1.

Referring to FIGS. 2 and 3, the heel portion 124, toe portion 126, rear 128, and central strut 132 form the flow aperture 122. The flow aperture 122 extends entirely through the chassis 102, in a direction from the upper surface 134 to the lower surface 136. When the putter-type body 104 is molded to the chassis 102, the flow aperture 122 allows the lightweight, low density material that eventually form the putter-type body 104, to encapsulate the chassis 102 such that the body 104 extends through and completely fills the flow aperture 122. The flow aperture 122 allows the putter body 104 to integrally interlock the body 104 and the chassis 102, to form the club head 100. Furthermore, the flow aperture 122 allows the lightweight, low density material of the putter-type body 104 to flow in a direction perpendicular to the striking surface 110 of the golf club head 100. In some cases, when the putter-type body 104 is formed from a thermoplastic composite material with a fibrous filler, the flow aperture 122 allows the fibers to settle in a direction perpendicular to the striking surface 110, thereby increasing the strength and durability of the club head 100. Further still, the flow aperture 122 allows a thermoplastic composite material with a fibrous filler to closely surround the chassis 102, with minimal porosity, thereby forming a solid and durable club head 100.

In some embodiments, the flow aperture 122 can be any one of the following shapes: circular, elliptical, triangular, rectangular, trapezoidal, octagonal, any polygonal shape, or any other desired geometric shape. In some embodiments, the flow aperture 122 can asymmetrical in shape in a direction from the front 130 to the rear 128, or from the rear 128 to the front 130. In some embodiments, the flow aperture 122 can be symmetrical shape from toe portion 126 to the heel portion 124. In other embodiments, the flow aperture 122 can be symmetrical in shape from the rear 128 to the front 130 and symmetrical in shape from the toe portion 126 to the heel portion 124. In more embodiments, the flow aperture 122 can be symmetrical in shape from the toe portion 126 to the heel portion 124, but asymmetrical in shape from the rear 128 to the front 130.

In some embodiments, the chassis 102 can be devoid of the central strut 132, and thereby devoid of a flow aperture 122. Referring to FIGS. 10-12, 22-24, and 26-28, for example, the chassis 102 can merely comprise a front 130 formed by only the toe portion 126 and the heel portion 124, entirely devoid of the central strut 132. In many embodiments wherein the chassis 102 is devoid of the central strut 132, the chassis 102 can be "U-shaped," horseshoe shaped, parabolically shaped, dumbbell shaped, "I-shaped," or any other desired shape.

Figure 10:
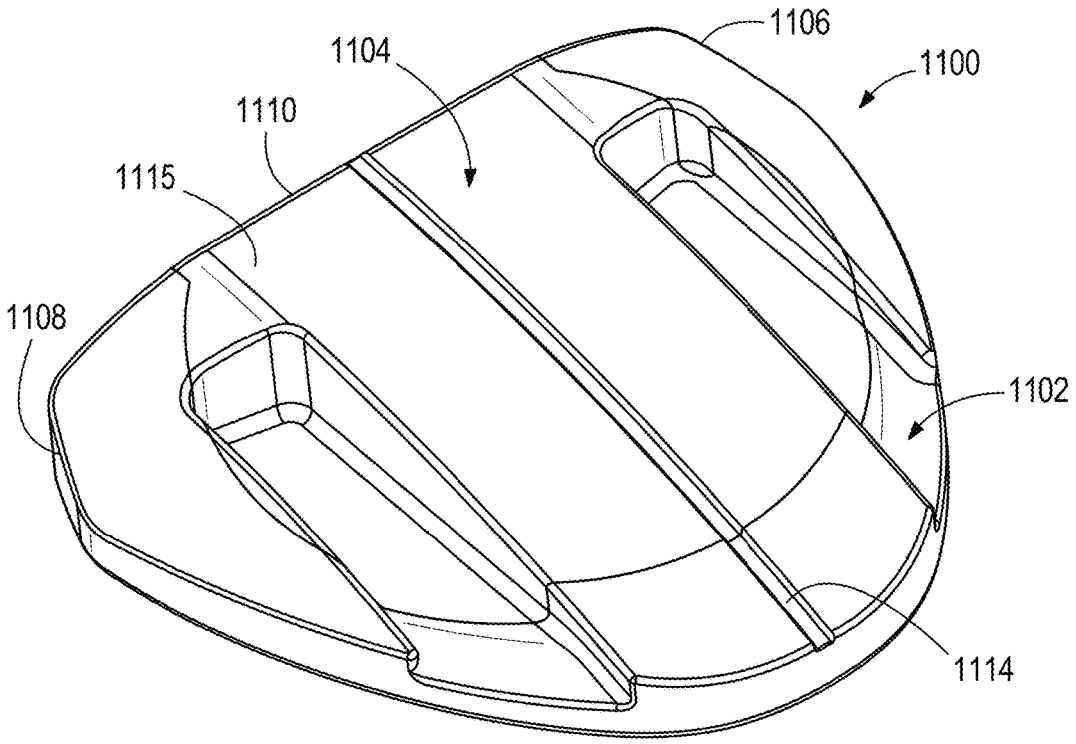
FIG. 10 illustrates a rear perspective view of another putter-type golf club.
Figure 11:
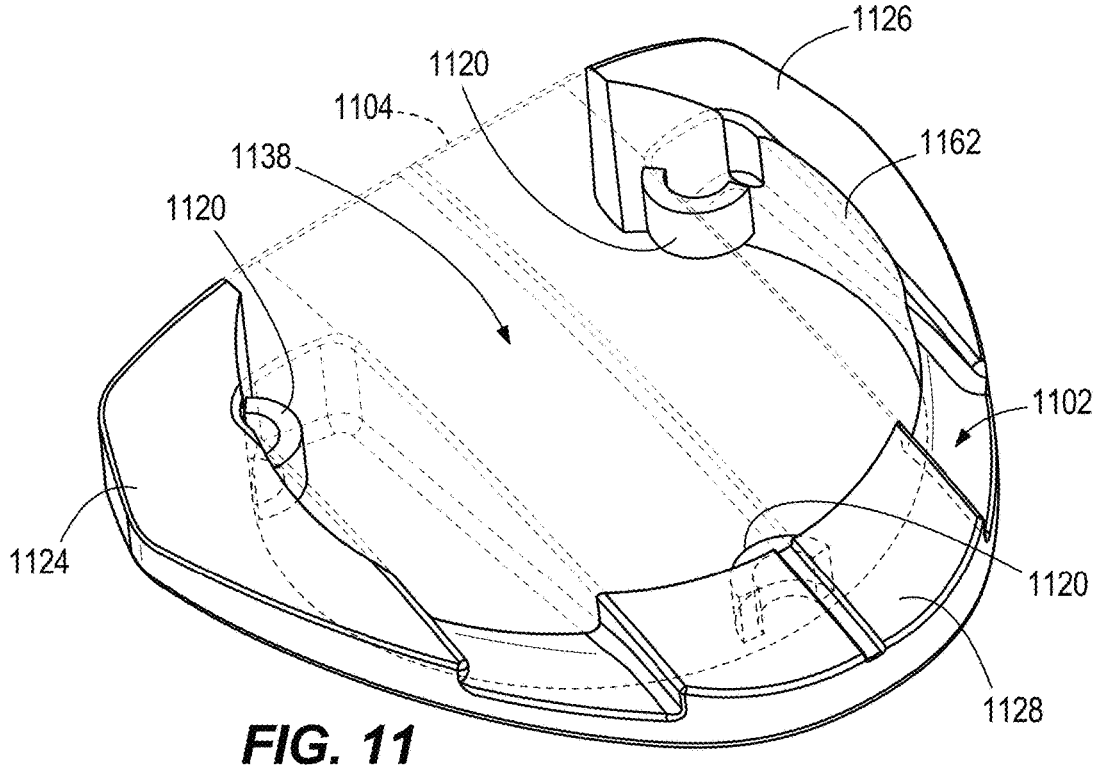
FIG. 11 illustrates a rear perspective view of the combination of a putter-type body and a chassis of the putter-type golf club of FIG. 10.
Figure 12:
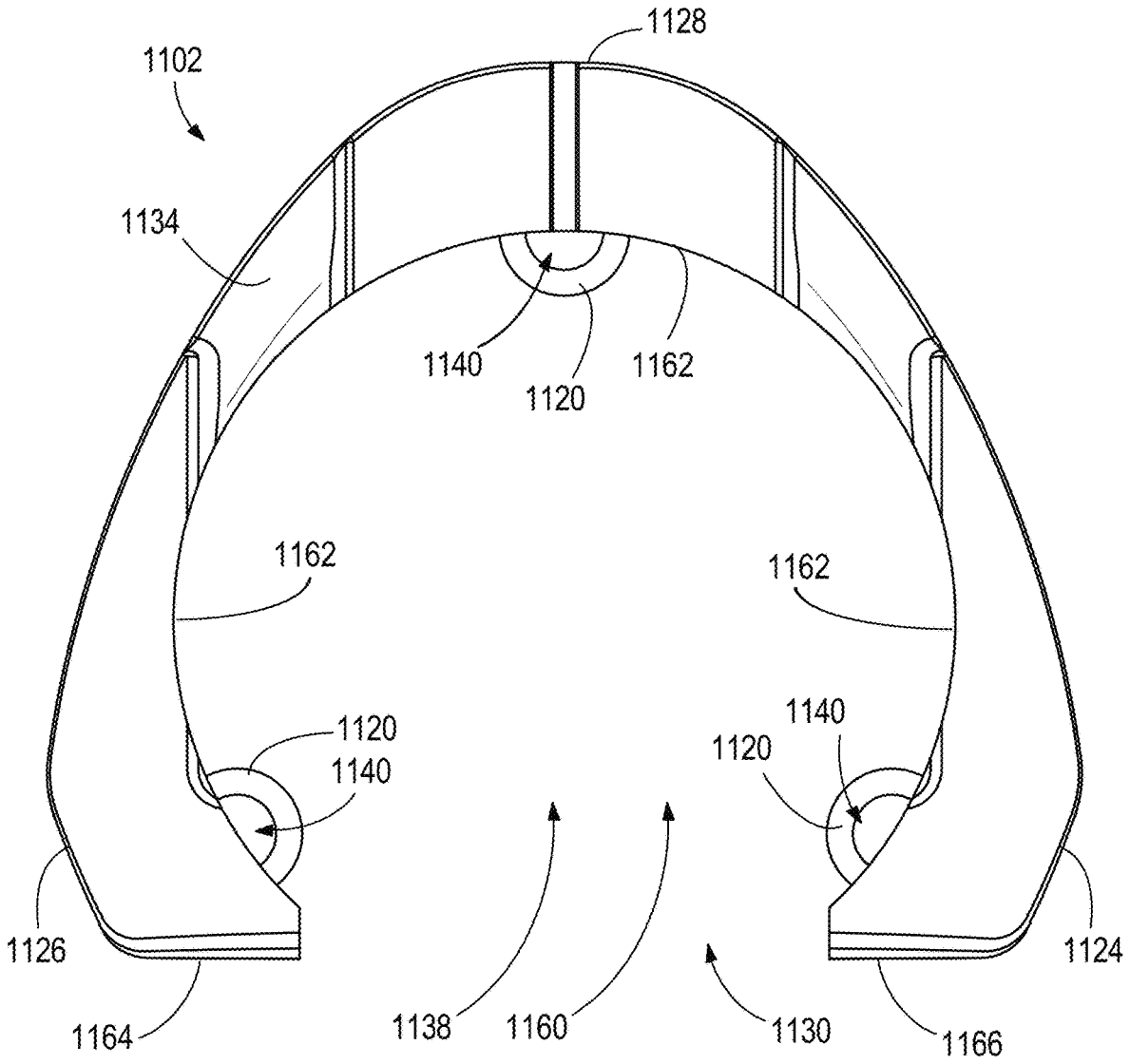
FIG. 12 illustrates a top view of the chassis of the putter-type golf club of FIG. 10.
Figure 14:
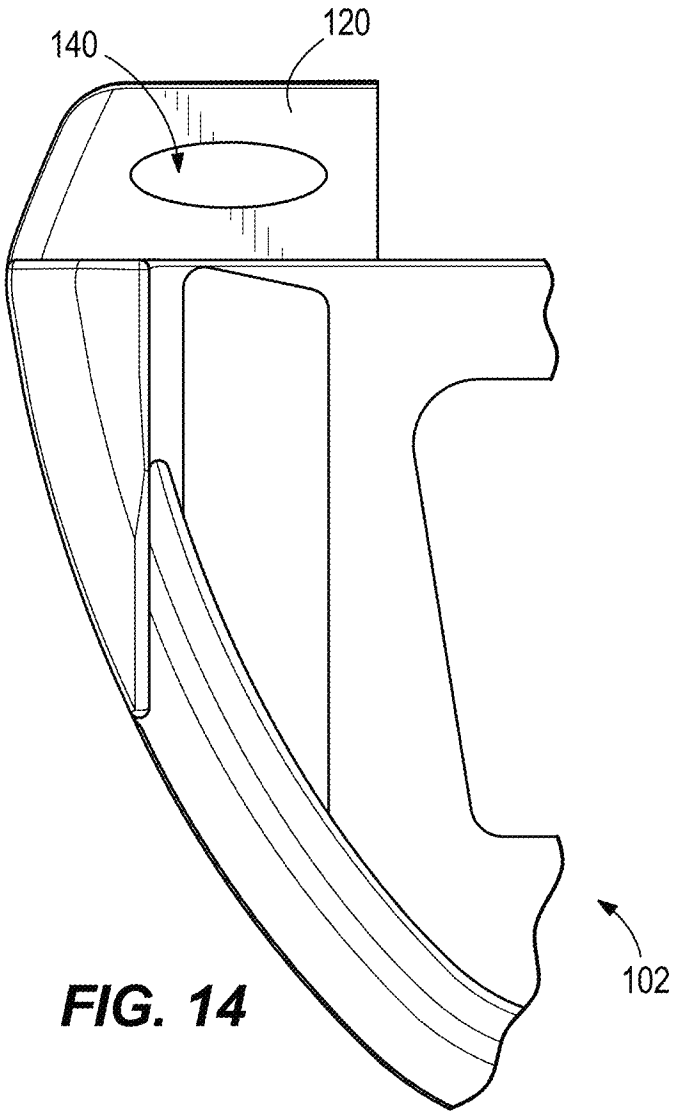
FIG. 14 illustrates a top view of an alternate chassis interlocking feature.
Figure 13:
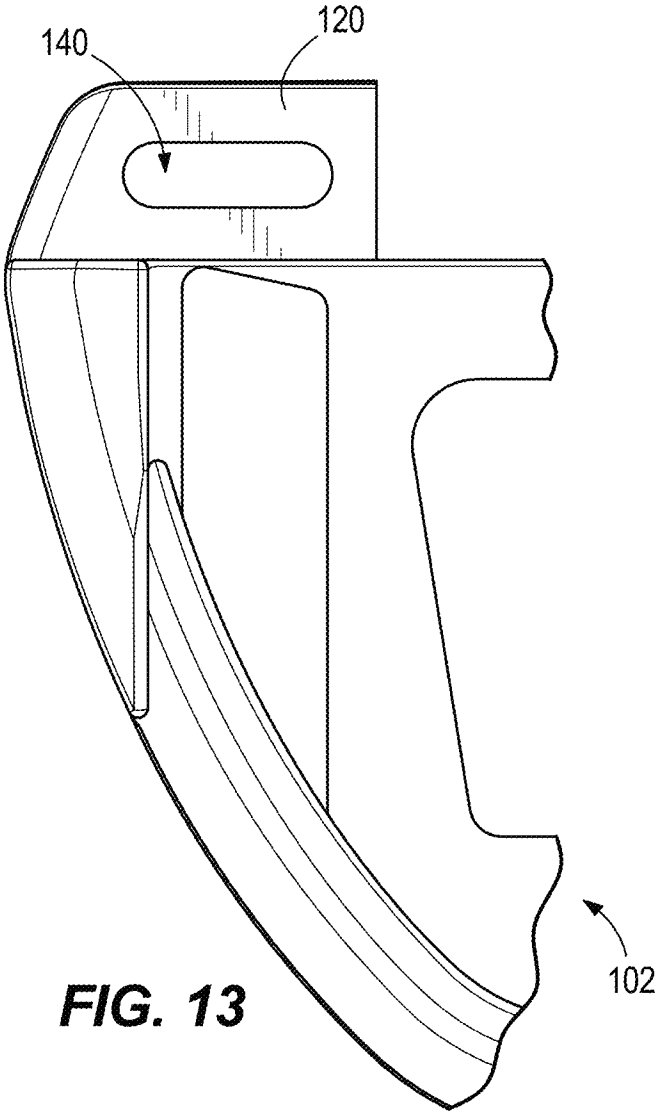
FIG. 13 illustrates a top view of a chassis interlocking feature.
Figure 16:
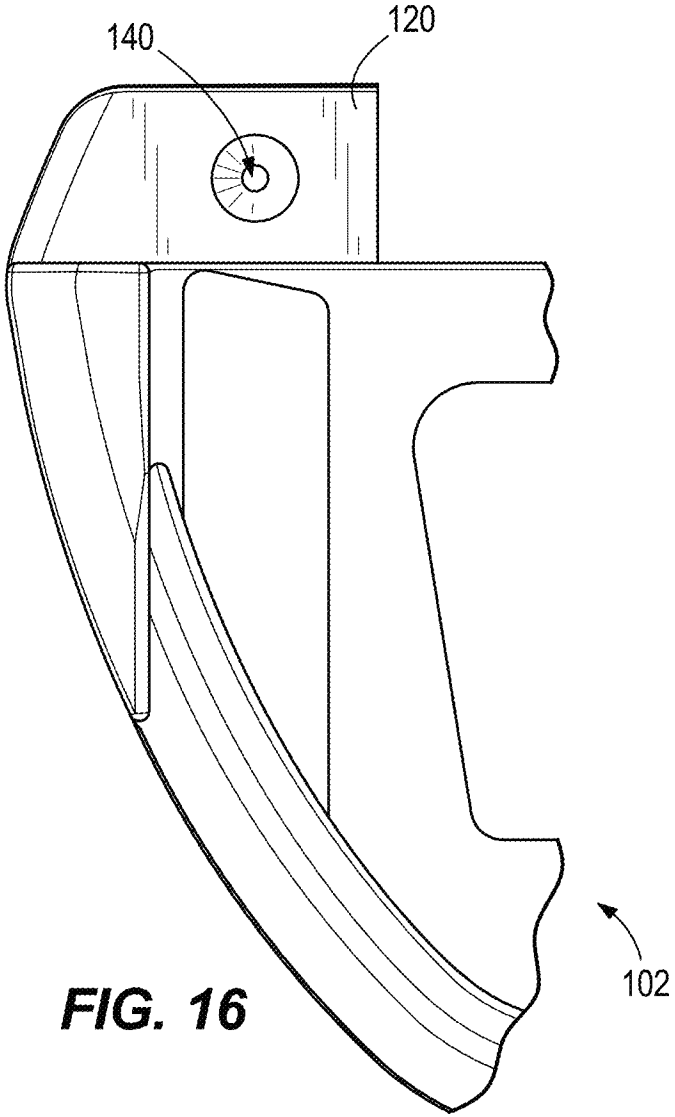
FIG. 16 illustrates a top view of an alternate chassis interlocking feature.
Figure 15:
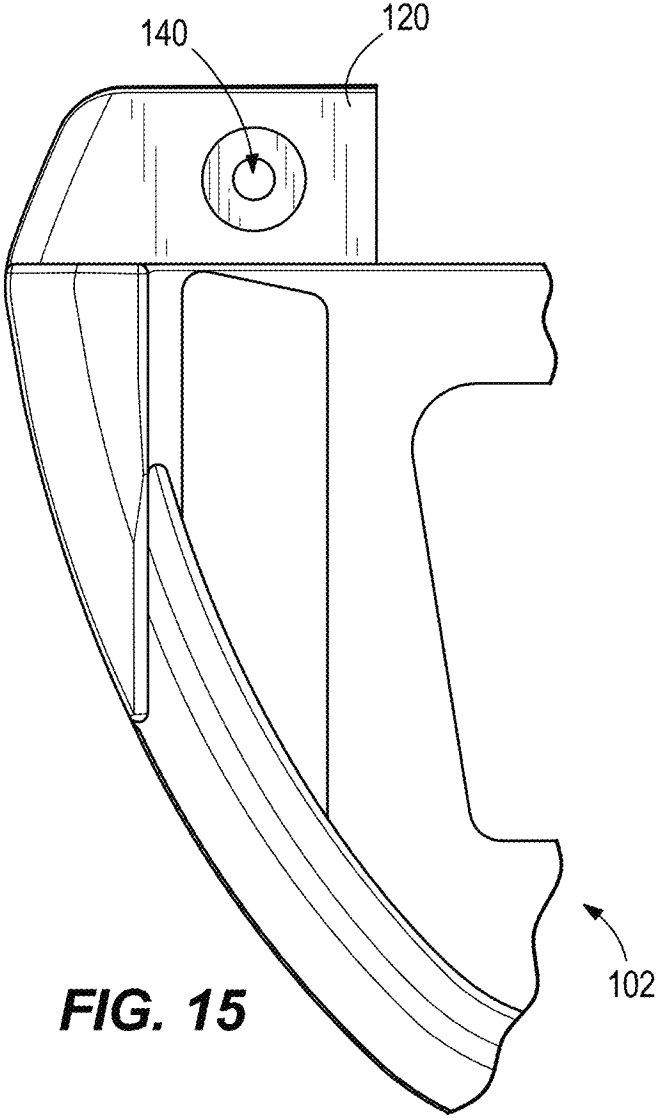
FIG. 15 illustrates a top view of an alternate chassis interlocking feature.
Figure 18:
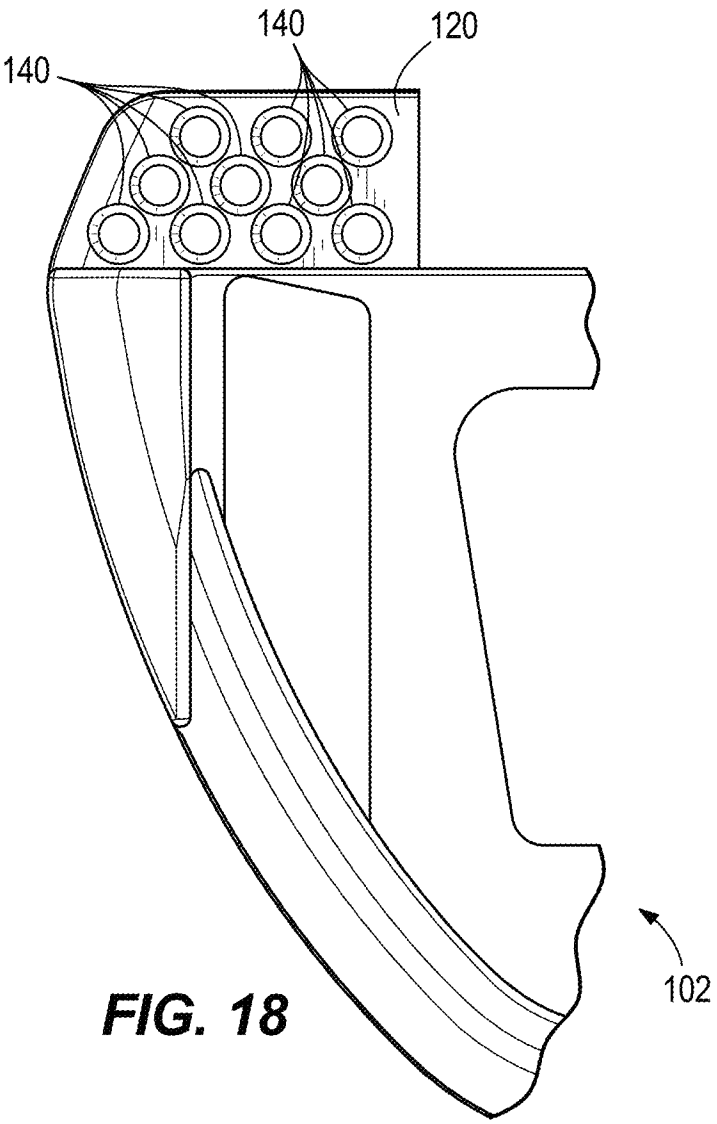
FIG. 18 illustrates a top view of an alternate chassis interlocking feature.
Figure 17:
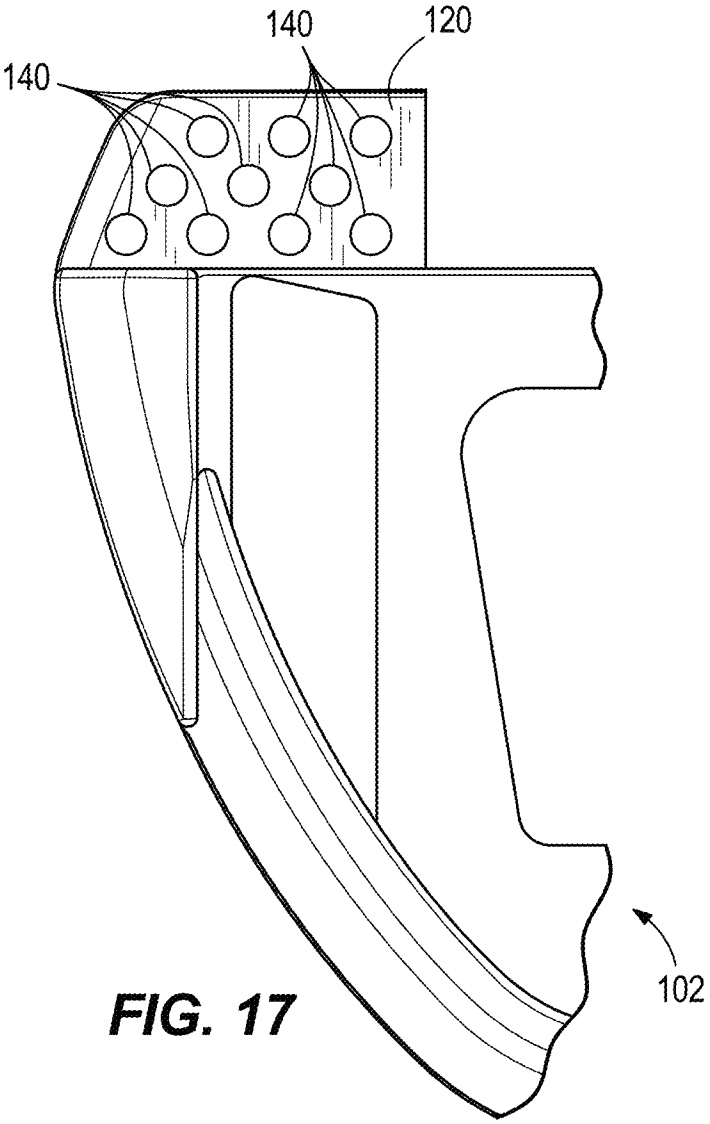
FIG. 17 illustrates a top view of an alternate chassis interlocking feature.
Figure 19:
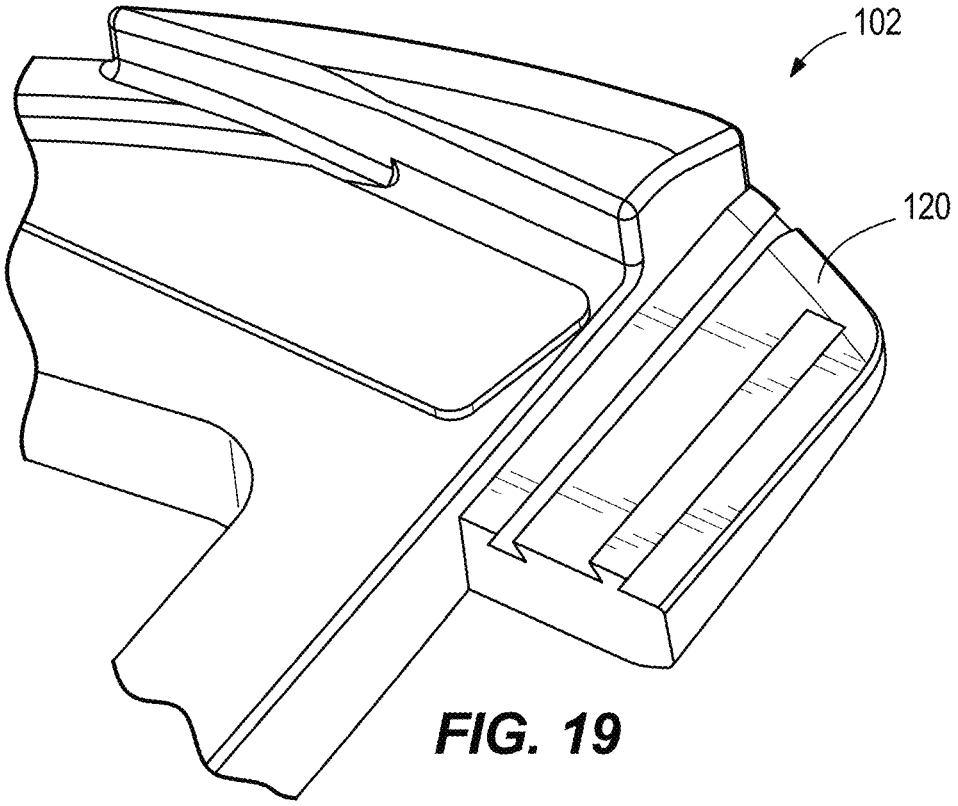
FIG. 19 illustrates a top view of an alternate chassis interlocking feature.
Figure 20:
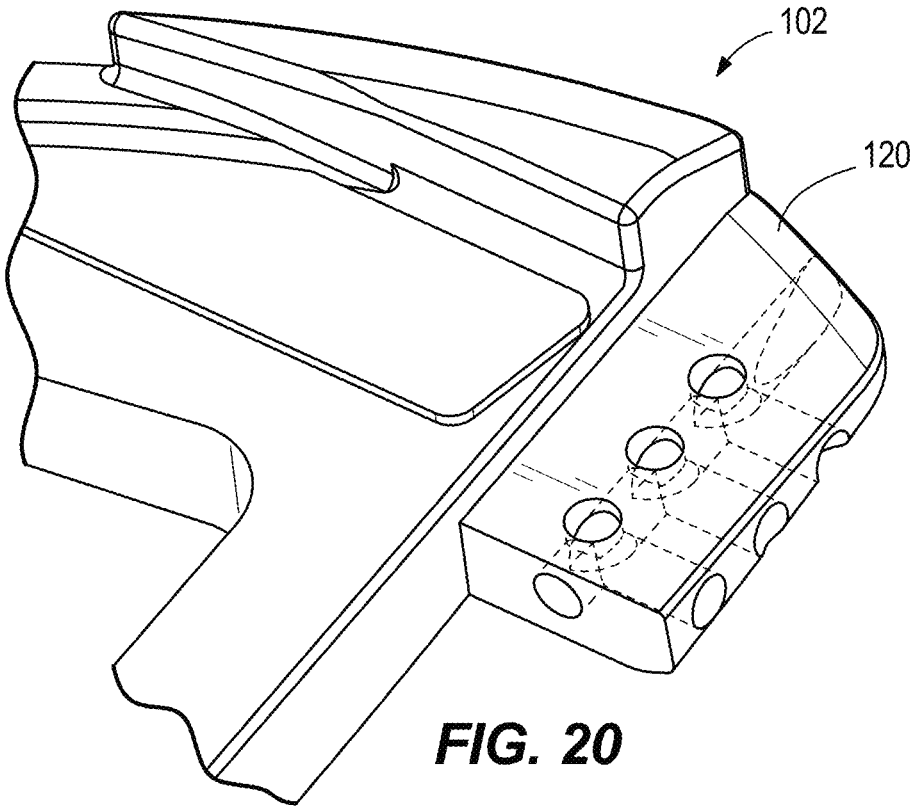
FIG. 20 illustrates a top view of an alternate chassis interlocking feature.
Figure 21:
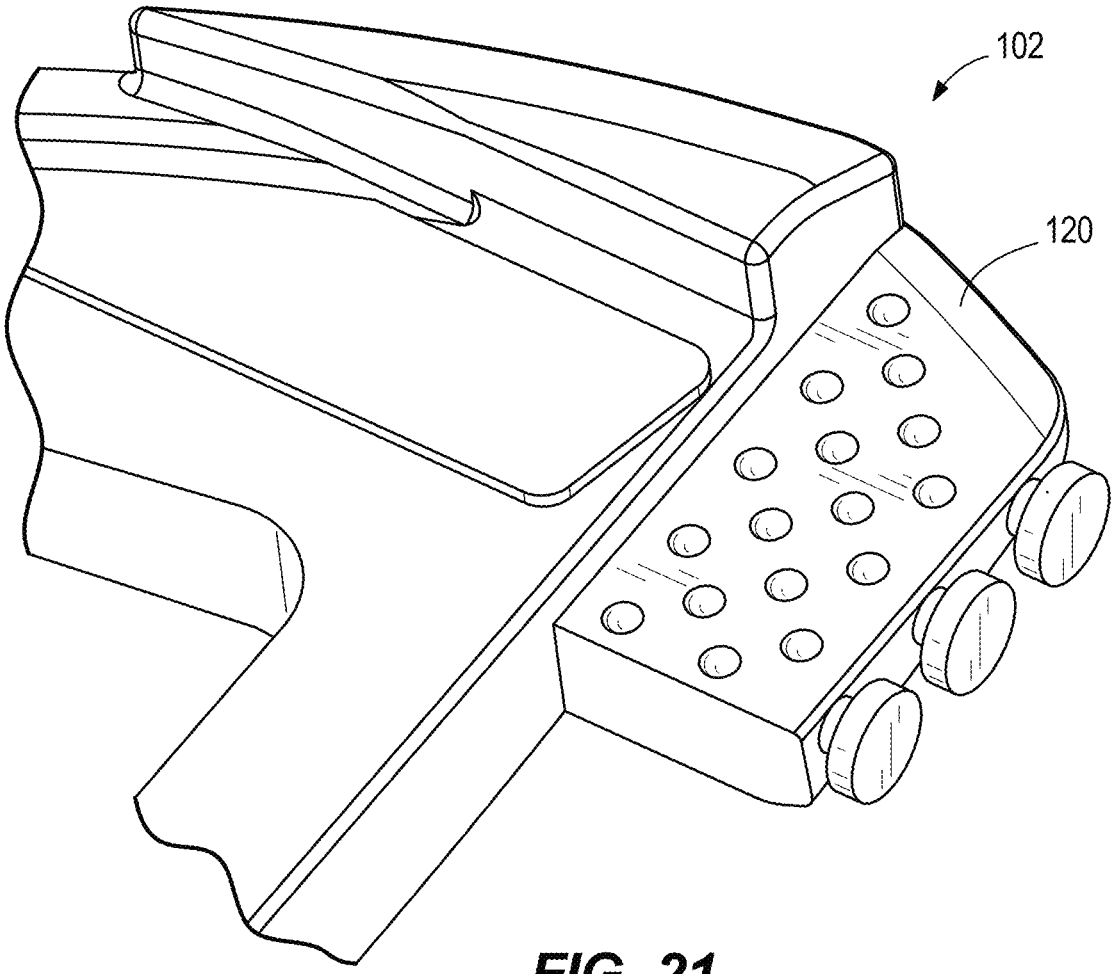
FIG. 21 illustrates a top view of an alternate chassis interlocking feature.
Figure 22:
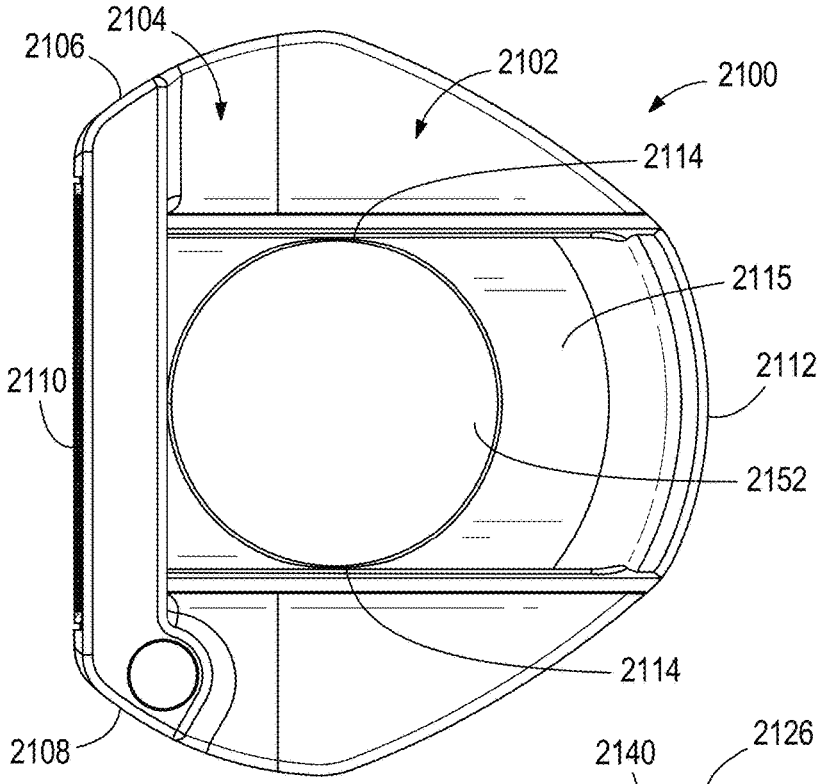
FIG. 22 illustrates a top view of another putter-type golf club.
Figure 23:
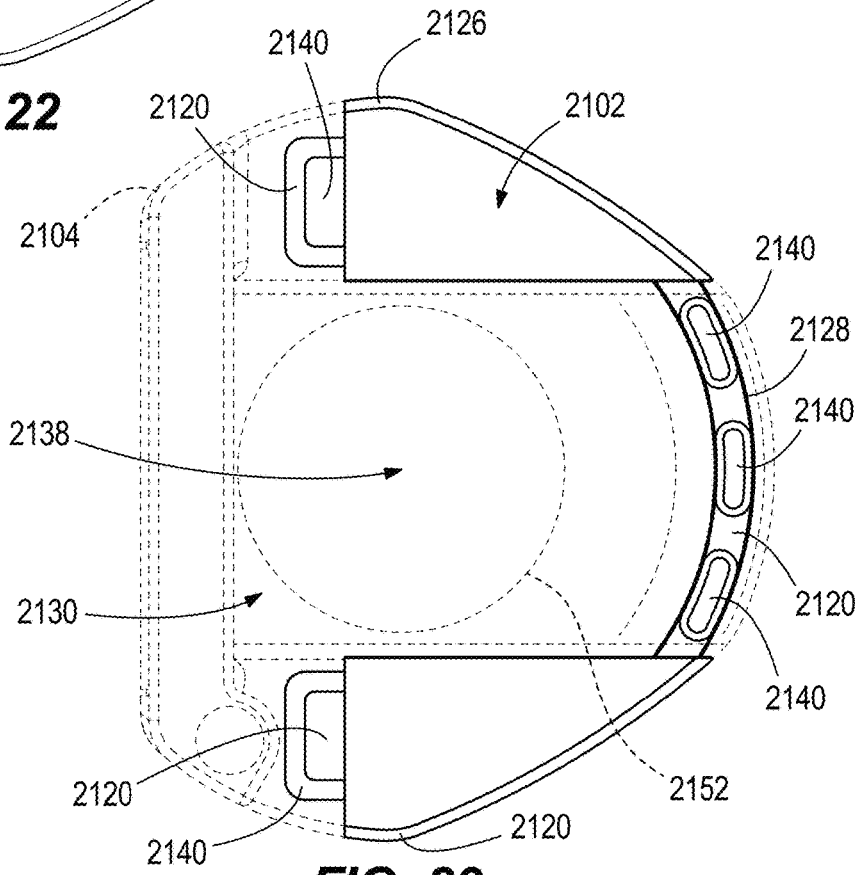
FIG. 23 illustrates a top view of the combination of a putter-type body and a chassis of the putter-type golf club of FIG. 22
Figure 24:
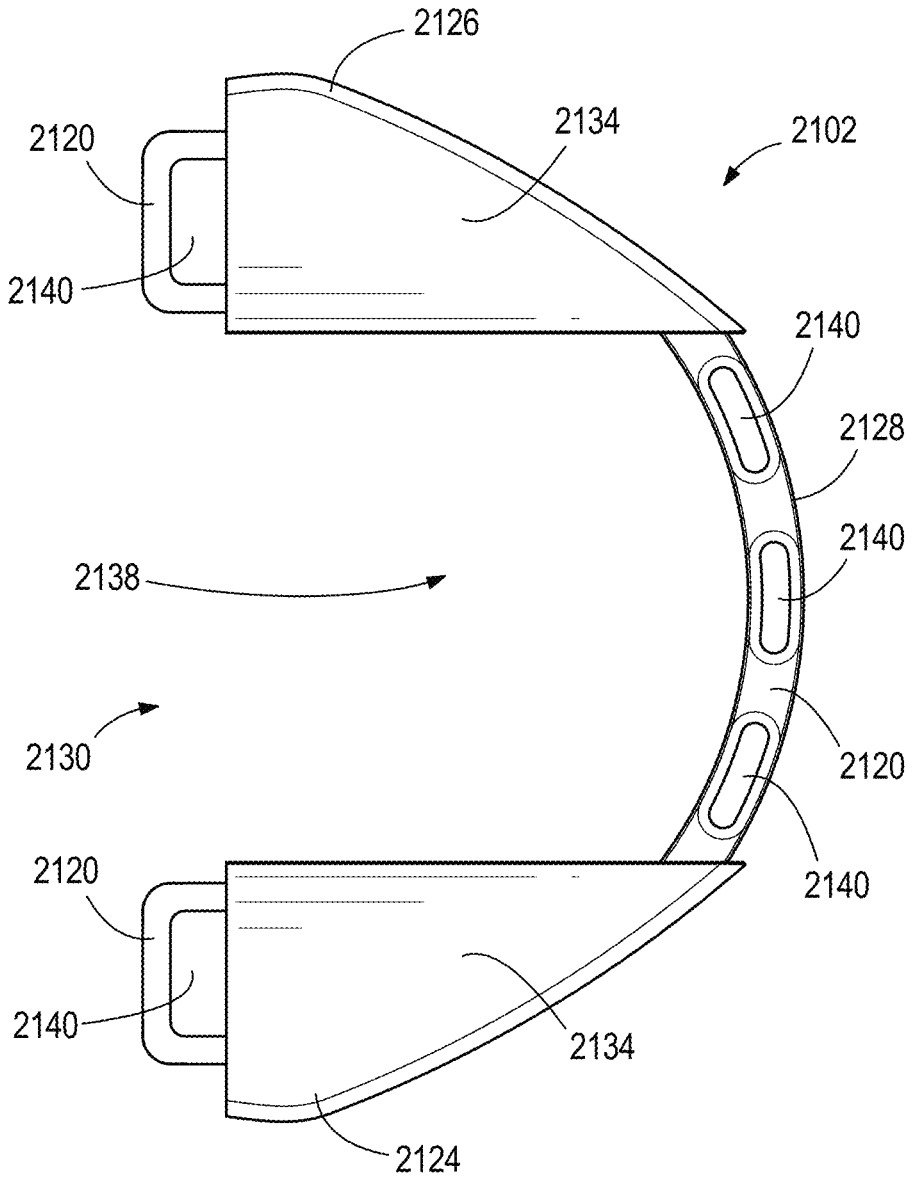
FIG. 24 illustrates a top view of the chassis of the putter-type golf club of FIG. 22.

Still referring to FIGS. 10-12, in some embodiments, the chassis 102 is devoid of the central strut 132, and thereby devoid of the flow aperture 104. In these embodiments, the heel portion 124, toe portion 126, and rear 128 form a flow region 138. The flow region 138 functions identically as the flow aperture 128, however, is devoid of the central strut 132. When the putter-type body 104 is molded to the chassis 102, the flow region 138 allows the lightweight, low density material of the putter-type body 104 to encapsulate the chassis 102 such that the body 104 extends through and completely fills the flow region 138. The flow region 138 allows the putter body 104 to integrally interlock the body 104 and the chassis 102, to form the club head 100. Furthermore, the flow region 138 allows the lightweight, low density material of the putter-type body 104 to flow in a direction perpendicular to the striking surface 110 of the golf club head 100. In some cases, when the putter-type body 104 is formed from a thermoplastic composite material with a fibrous filler, this allows the fibers to settle in a direction perpendicular to the striking surface 110, increasing the strength and durability of the club head 100. Further still, the flow region 138 allows a thermoplastic composite material with a fibrous filler to closely surround the chassis 102, with minimal porosity, thereby forming a solid and durable club head 100.

Figure 4:
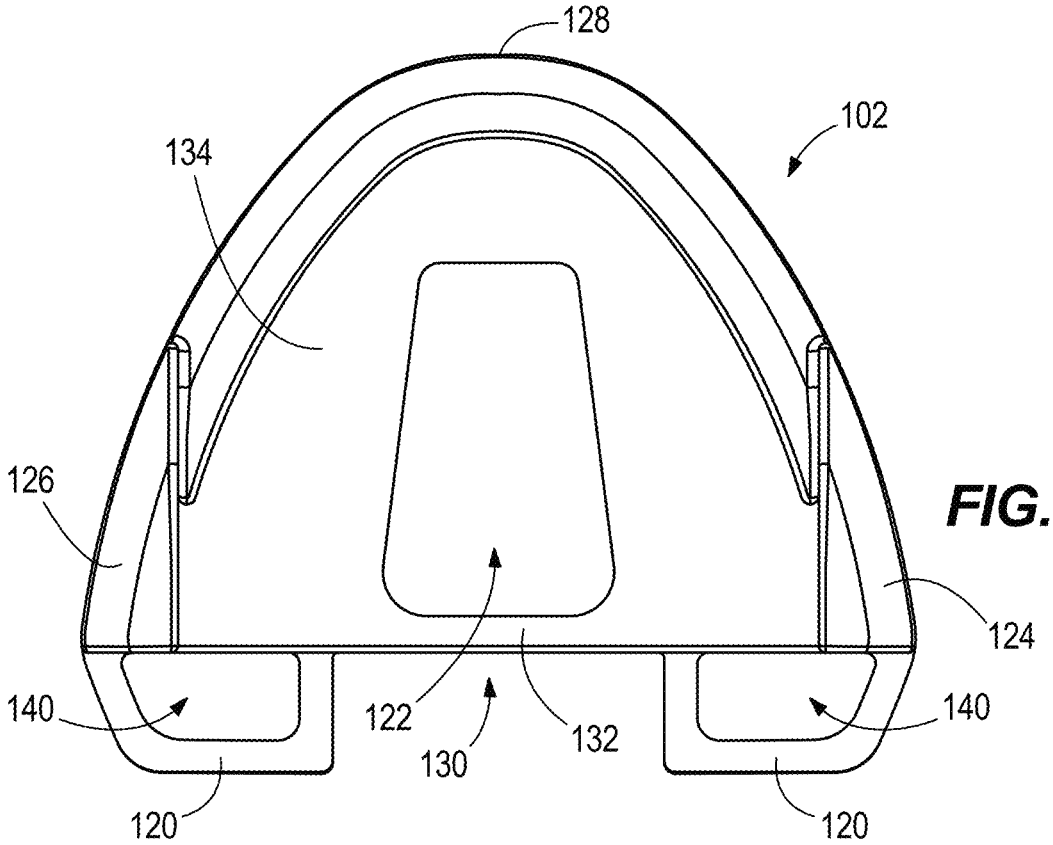
FIG. 4 illustrates a top view of the chassis of the putter-type golf club of FIG. 1
Figure 5:
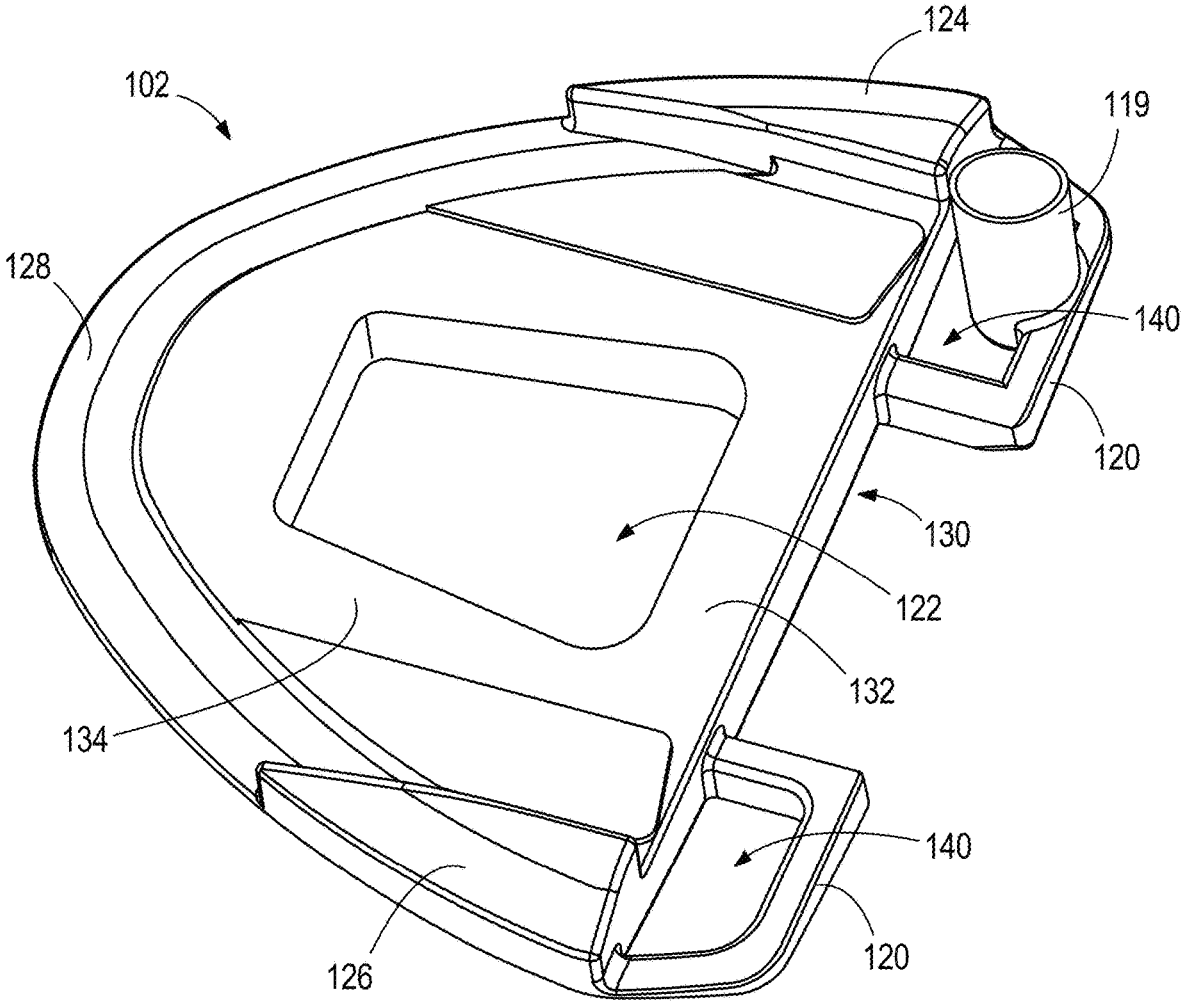
FIG. 5 illustrates a front perspective view of an alternate embodiment of the chassis of the putter-type golf club of FIG. 1.
Figure 6:
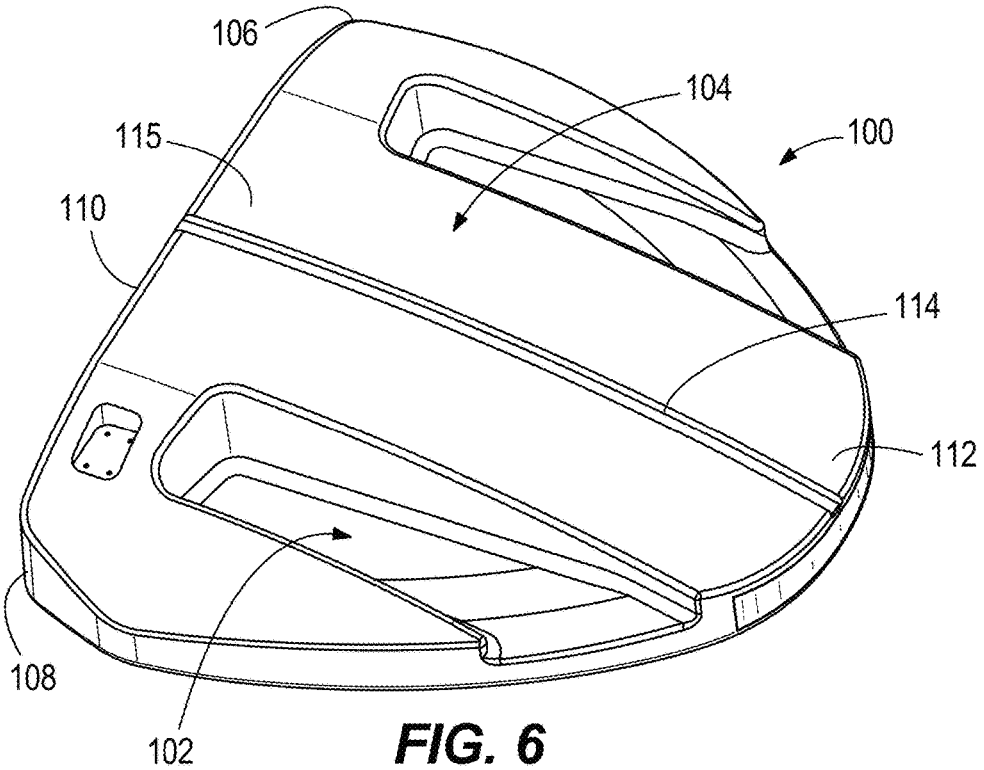
FIG. 6 illustrates a rear perspective view of a putter-type golf club with one or more weights.
Figure 7:
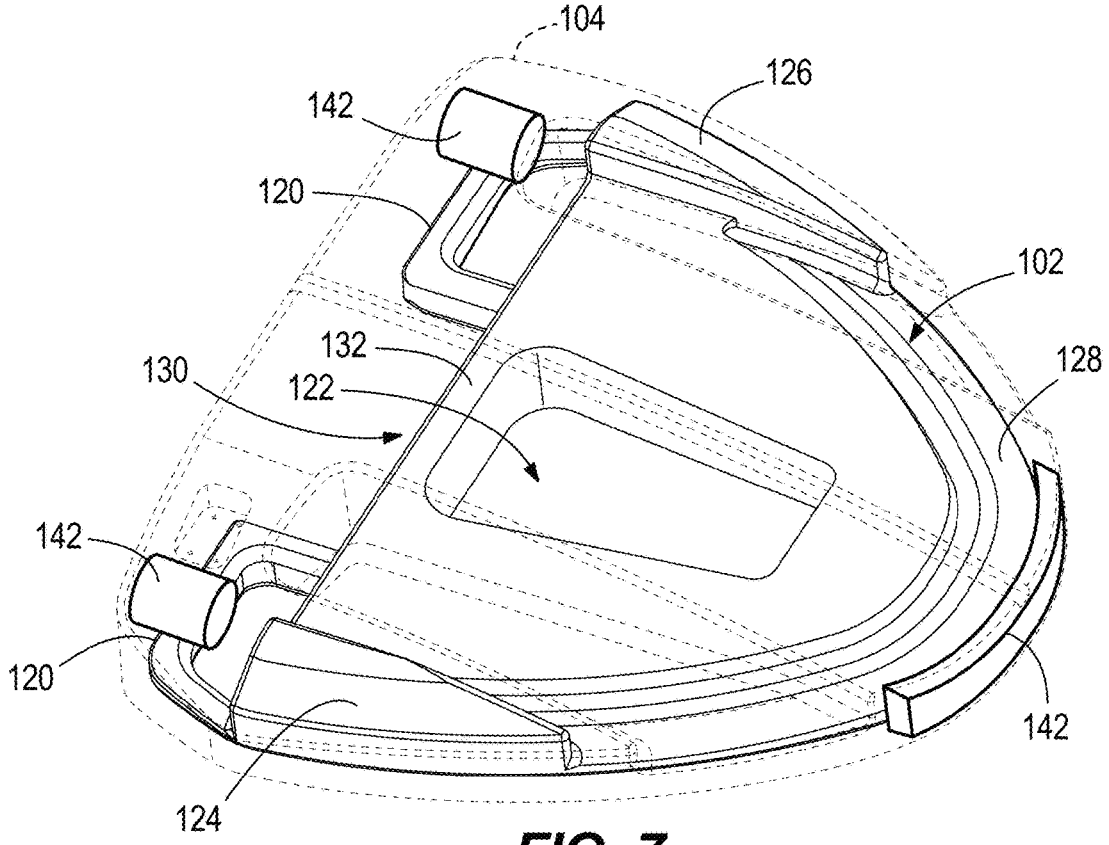
FIG. 7 illustrates a rear perspective view of the combination of a putter-type body and a chassis of the putter-type golf club of FIG. 5.
Figure 8:
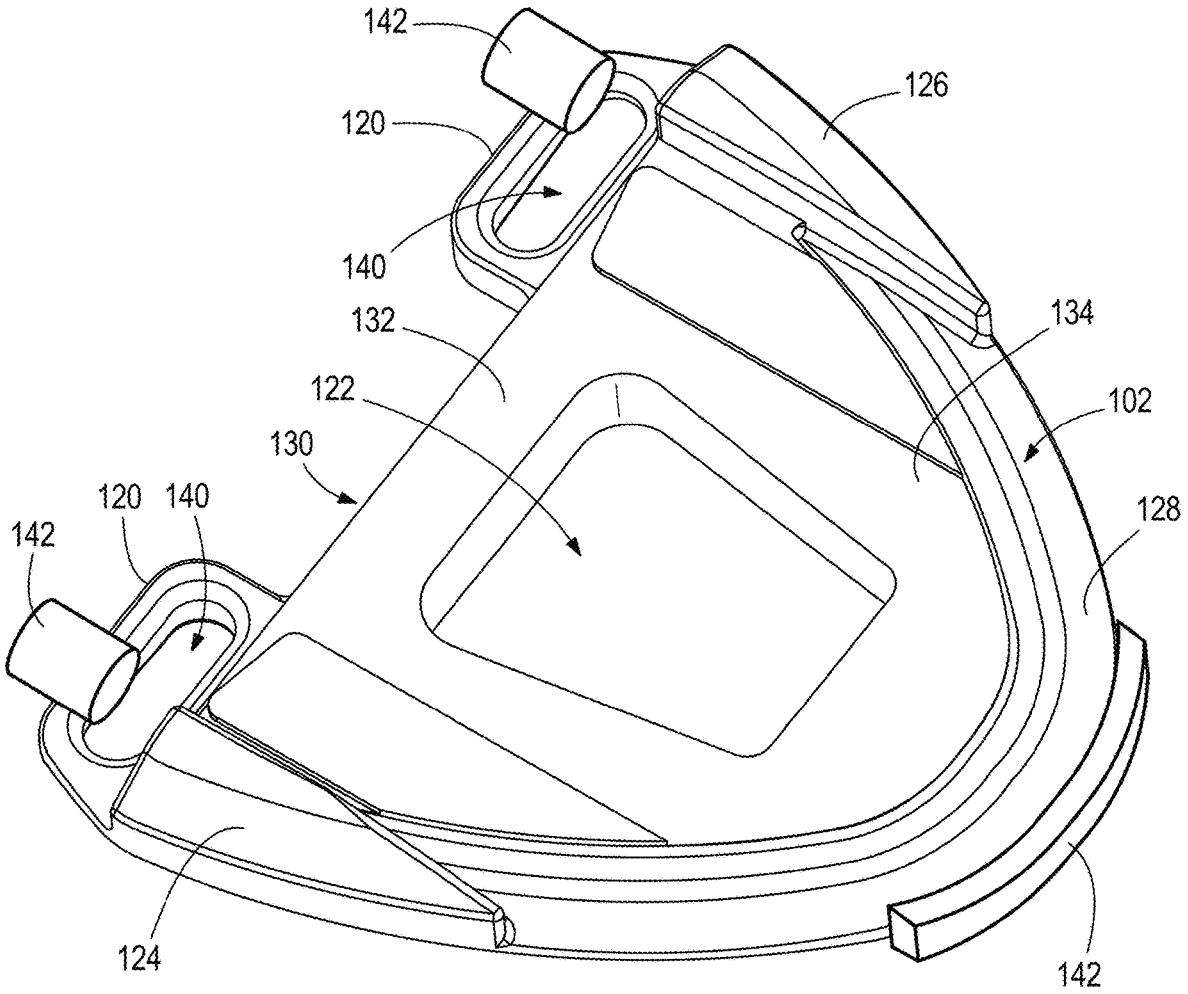
FIG. 8 illustrates a rear perspective view of the chassis and one or more weights of the putter-type golf club of FIG. 5.
Figure 9:
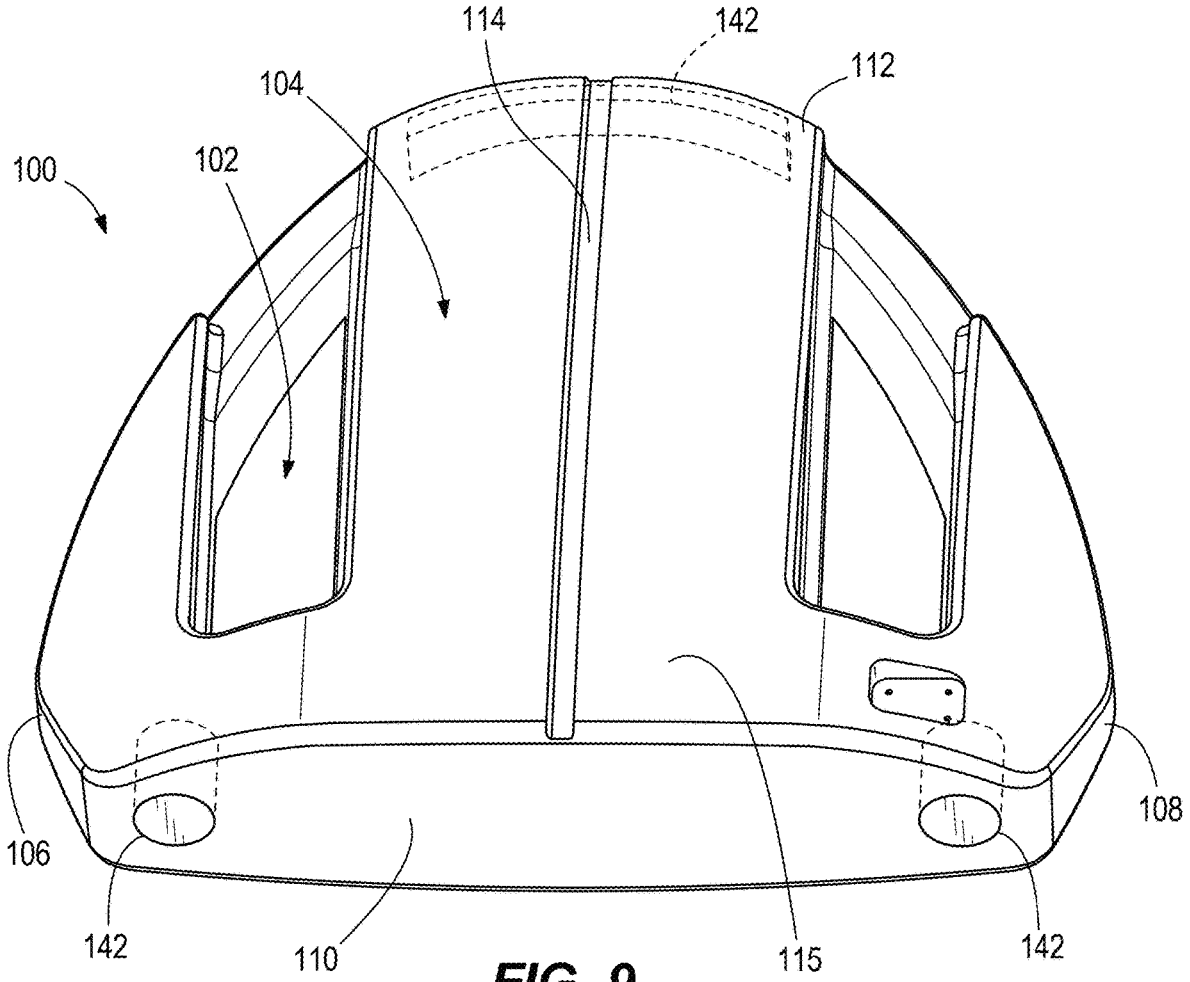
FIG. 9 illustrates a front perspective view of the putter-type golf club of FIG. 5.

Referring to FIGS. 2 and 4, the chassis 102 comprises at least one interlocking feature 120 protruding or extending from any one or more combination of the following chassis 102 features: the heel portion 124, the toe portion 126, the rear 128, the central strut 132, the front 130, the upper surface 134, and the lower surface 136. The at least one interlocking features 120 function to further interlock and integrally join the chassis 102 and the putter-type body 104, by allowing a thermoplastic composite material with a fibrous filler (or other high strength lightweight material) to encase the entirety of the at least one interlocking feature 120.

The chassis 102 can comprise one interlocking feature 120, two interlocking features 120, three interlocking features 120, four interlocking features 120, five interlocking features 120, six interlocking features 120, seven interlocking features 120, or more. In some embodiments, the chassis 102 can comprise two or more interlocking features 120, three or more interlocking features 120, four or more interlocking features, or more. In some embodiments, the chassis 102 can comprise at least one interlocking feature 120, at least two interlocking features 120, at least three interlocking features 120, at least four interlocking features, at least five interlocking features, at least six interlocking features, or more.

The at least one interlocking feature 120, in many embodiments, can be in the form of an anchor (see FIGS. 2, 4, 5, 7, 11-18, 23, 24, 27, 28, and 38-40). In these embodiments, wherein the at least one interlocking feature 120 is in the form of an anchor, an anchor aperture 140 is formed between the interlocking feature 120 and the portion of the chassis 102 (the heel portion 124, the toe portion 126, the rear 128, the central strut 132, the front 130, the upper surface 134, and the lower surface 136) that which the interlocking feature 120 protrudes from. The anchor aperture 140 and interlocking feature 120, similar to the flow aperture 122, allows the lightweight, low density material of the putter-type body 104, to entirely fill the anchor aperture 140 and encapsulate the interlocking feature 120, to integrally join the chassis 102 and the putter-type body 104.

In many embodiments, the anchor aperture 140 of the least one interlocking feature 120 can be any one of the following shapes: circular, semi-circular, ovular elliptical, triangular, rectangular, trapezoidal, octagonal, any polygonal shape, or any other desired geometric shape. In some embodiments, the at least one anchor interlocking features 120 can comprise more than one anchor apertures 140. In these embodiments, the more than one anchor apertures 140 of the at least one interlocking features 120 can be any one or combination of the following shapes: circular, elliptical, triangular, rectangular, trapezoidal, octagonal, any polygonal shape, or any other desired geometric shape.

In other embodiments, the at least one interlocking feature 120 can be in the form of a post or hitch (see FIGS. 21, 31, 32, 38, and 40), a series of indentations (see FIG. 21), a through-hole (see FIG. 20), a series of through-holes (see FIGS. 34-36), a slot or trough (see FIG. 19), a channel, a wedge, a beam with a series of through holes (see FIGS. 26-28), or any other desirable interlocking feature 120 geometry, to mold the putter-type body 104 to the chassis 102. In some of these other embodiments, such as the post or hitch embodiments, the at least one interlocking feature 120 is devoid of an anchor aperture 140. Rather than extending entirely through the anchor aperture 140 to encase the interlocking feature 120, the putter-type body 104 can surround and encapsulate the post or hitch embodiment of the interlocking feature 120, thereby joining the putter-type body 104 and the chassis 102.

Referring to FIGS. 6-9, in some embodiments, the chassis 102 can comprise one or more weights 142. The one or more weights 142 can comprise a weight density, wherein the weight density is greater than the density (first density) of the chassis, in order to alter the mass properties of the putter (i.e., CG, MOI, balance). The one or more weights 142 function to customize the center of gravity of the putter, while maintaining and/or increasing the MOI of the putter head 100. The one or more weights 142 can be attached to the chassis 102 through any of the following attachment methods: welding, soldering, brazing, swedging, adhesion, epoxy, mechanical fastening, adhesion with epoxy, polyurethanes, resins, hot melts, or any other adhesive.

In most embodiments, the one or more weights 142, are made from a different material than the chassis 102. In some embodiments, the one or more weights 142 are made from the same material as the chassis 102 but comprise a different density than the chassis 102. In most embodiments, the one or more weights 142 comprise a density greater than the density of the chassis 102. The one or more weights 142 can be comprise any one or combination of the following materials: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), manganese (7.43 g/cc) or any metal suitable for creating a high density weight. In most embodiments, the The material of the one or more weights 142 comprises a density. The density of the one or more weights 142 can range between 12.0 g/cc and 20.0 g/cc. In some embodiments, the one or more weights 142 density can range between 12.0-12.5 g/cc, 12.5-13.0 g/cc, 13.0-13.5 g/cc, 13.5-14.0 g/cc, 14.0-14.5 g/cc, 14.5-15.0 g/cc, 15.0-15.5 g/cc, 15.5-16.0 g/cc, 16.0-16.5 g/cc, 16.5-17.0 g/cc, 17.0-17.5 g/cc, 17.5-18.0 g/cc, 18.0-18.5 g/cc, 18.5-19.0 g/cc, or 19.0-19.5 g/cc, or 19.5-20.0 g/cc. In one embodiment, the density of the one or more weights 142 can range between 19.0-20.0 g/cc. In some embodiments, the one or more weights 142 density can be 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, or 20.0 g/cc.

The one or more weights 142 can comprise a mass ranging from 1 gram to 20 grams. In many embodiments, the one or more weights 142 can comprise a mass of 1 gram, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, or 20 grams. In some embodiments, the one or more weights 142 can range from 1-5 grams, 5-10 grams, 10-15 grams, or 15-20 grams. In most embodiments, the one or more weights 142 can comprise the same mass, however in other embodiments, the one or more weights 142 can comprise different masses.

Still referring to FIGS. 6-9, the chassis 102, in some embodiments, can comprise one or more weights 142. In many embodiments, the chassis 102 can comprise one weight 142, two weights 142, three weights 142, four weights 142, five weights 142, six weights 142, or more. In some embodiments, the chassis 102 can comprise two or more weights 142, three or more weights 142, or four or more weights 142.

In many embodiments, the one or more weights 142 can comprise any one or combination of the following shapes: circular, elliptical, triangular, rectangular, cylindrical, rectangular prismed, trapezoidal, octagonal, or any other polygonal shape or shape with at least one curved surface.

Furthermore, in most embodiments, the light-weight material of the putter-type body 104 encases at least one a portion of the one or more weights 142. In some embodiments, the light-weight material of the putter-type body can surround at least 10% of the one or more weights 142, at least 20% of the one or more weights 142, at least 30% of the one or more weights 142, at least 40% of the one or more weights 142, at least 50% of the one or more weights 142, at least 60% of the one or more weights 142, at least 70% of the one or more weights 142, at least 80% of the one or more weights 142, at least 90% of the one or more weights 142, or 100% of the one or more weights 142.

The combination of the high density chassis 102, with a low density putter-type body 104, creates the putter 100 with an extremely high MOI, while keeping the golf club head at a desirable overall weight. The flow aperture 122 formed by the chassis 102 forms a dense, yet low volume portion that drastically increase the MOI of the putter, in comparison to a putter milled from a single material. A single material putter fails to allocate high density material to the periphery, while maintaining a desirable volume (75 cc-100 cc) and mass (340 grams-385 grams).

b.) Putter-Type Body

Referring to FIGS. 1, 2, and 4, the putter-type golf club head 100, comprises a low density putter-type body 104. The putter-type body 104 is configured and positioned to be molded to the chassis 102, to form the putter-type golf club head 100. The light-weight material of the putter-type body 104 encase the entirety of the at least one interlocking feature 120 of the chassis 102. Further, the light-weight material of the putter-type body 104 extends through and completely fill the chassis 102 flow aperture 122, interlocks the body 104 and the chassis 102, and forms the putter-type golf club head 100. Furthermore, the low-density putter-type body 104 can be formed around the high-density chassis 102, to create a putter 100 with an extremely high MOI putter, while keeping the golf club head at a desirable overall weight.

In reference to FIGS. 2, 7, 11, 23, 27, 30, 32, 34, and 38, the dashed lines of each figure shows the mold that which the putter-type body 104 forms with (and around) the chassis 102, to form the putter-type golf club head 100. These figures display the interrelationship of the chassis 102 and the interlocking features 120 and flow aperture 122 (or flow region 138) of the putter-type body 104.

The body 104, in some embodiments, comprises more than 50% of a total volume of the putter 100. In some embodiments, the body 104 comprises more than 55% of the total volume of the putter 100, more than 60% of the total volume of the putter 100, or more than 65% of the total volume of the putter 100.

Although the body 104 comprises more than half of the volume of the putter 100, the body 104 comprises less than 40% of an overall mass of the putter 100. In some embodiments, the chassis 102 comprises less than 40% of the overall mass of the putter 100, less than 35% of the overall mass of the putter 100, less than 20% of the overall mass of the putter 100, or less than 15% of the overall mass of the putter 100.

The beneficial shift of mass to the periphery of the putter head 100, through the use of a high density, low volume chassis 102, in combination with a low density, high volume putter-type body 104, increases the MOI of the putter 100, over a putter with the same volume, mass, and single material construction (or multi-metal construction) ((i.e., a putter milled of a single stainless steel block, or a putter investment cast of two metals).

As aforementioned, the putter-type body 104 comprises a low density second material. In most embodiments, the putter-type body 104 comprises a thermoplastic composite material that comprises a thermoplastic polymer matrix material and a filler. In other embodiments, the putter-type body 104 can comprise any other low density second material, wherein the other low density materials are not repeated herein for brevity. However, in most embodiments, the putter-type body 104 comprises a second material with a density less than 4.0 g/cc. The chassis 102 and the putter-type body 104 are permanently joined without the use of welding, epoxies, or adhesives. The thermoplastic polymer matrix miller and filler of the putter-type body 104, combined with the flow aperture 122 and at least one interlocking feature 120 of the chassis 102, creates an integral putter 100, without the use of welding, epoxies, or adhesives.

The putter-type body 104 is integrally formed within and around the chassis 102. As previously described the light-weight material of the putter-type body 104 extends through and completely fill the chassis 102 flow aperture 122, interlocks the body 104 and the chassis 102, and forms the putter-type golf club head 100. Further, in some embodiments, the putter-type body 104 encases (or encapsulates) 100% of the chassis 102. In most embodiments, the putter-type body 104 encases at least 30% of the chassis 102. In other embodiments, the putter-type body 104 can encase at least 30% of the chassis 102, at least 35% of the chassis 102, at least 40% of the chassis 102, at least 45% of the chassis 102, at least 50% of the chassis 102, at least 55% of the chassis 102 at least 60% of the chassis 102, at least 65% of the chassis 102, at least 70% of the chassis 102, at least 75% of the chassis 102, at least 80% of the chassis 102, at least 85% of the chassis 102, and at least 95% of the chassis 102. In some embodiments, the putter-type body 104 can encase (or encapsulate) 30%-35% of the chassis 102, 35%-40% of the chassis 102, 40%-45% of the chassis 102, 45%-50% of the chassis 102, 50%-55% of the chassis 102, 55%-60% of the chassis 102 60%-65% of the chassis 102, 65%-70% of the chassis 102, 70%-75% of the chassis 102, 75%-80% of the chassis 102, 80%-85% of the chassis 102, 85%-90% of the chassis 102, 90%-95% of the chassis 102, or 95%-100% of the chassis 102.

The putter-type body 104, when combined with the chassis 102, forms the golf club head 100 toe end 106, heel end 108, rear portion 112, and striking surface 110. The putter-type body 104 forms a portion of the crown 115 and a portion of the sole 117. In reference to FIGS. 1 and 2, when the putter-type body 104 and chassis 102 are joined, in most embodiments, the chassis 102 and putter-type body 104 combine to form the putter 100 crown 115. Similarly, when the putter-type body 104 and chassis 102 are joined, in most embodiments, the chassis 102 and putter-type body 104 combine to form the putter 100 sole 117.

The putter-type body 104 can form 100% of the crown 115, such that the chassis 102 cannot be seen from an address position. In some embodiments, the putter-type body 104 can form 30%-35% of the crown 115, 35%-40% of the crown 115, 40%-45% of the crown 115, 45%-50% of the crown 115, 50%-55% of the crown 115, 55%-60% of the crown 115, 60%-65% of the crown 115, 65%-70% of the crown 115, 70%-75% of the crown 115, 75%-80% of the crown 115, 80%-85% of the crown 115, 85%-90% of the crown 115, 90%-95% of the crown 115, or 95%-100% of the crown 115. In most embodiments, the putter-type body 104 forms at least 50% of the crown 115, such that the chassis 102 is not as visible at an address position as the body 104.

Similar to the crown 115, the putter-type body 104 can form 100% of the sole 117, such that the chassis 102 does not contact the ground plane, at an address position. In some embodiments, the putter-type body 104 can form 30%-35% of the sole 117, 35%-40% of the sole 117, 40%-45% of the sole 117, 45%-50% of the sole 117, 50%-55% of the sole 117, 55%-60% of the sole 117, 60%-65% of the sole 117, 65%-70% of the sole 117, 70%-75% of the sole 117, 75%-80% of the sole 117, 80%-85% of the sole 117, 85%-90% of the sole 117, 90%-95% of the sole 117, or 95%-100% of the sole 117. In most embodiments, the putter-type body 104 forms at least 50% of the sole 117.

Further, the putter-type body 104, forms at least a portion of an alignment feature 114. In some embodiments, the putter-type body 104 forms the entirety of the alignment feature 114. Referring to FIG. 1, the alignment feature 114 can be any one or combination of the following: a line, a series of lines, a circle, a dashed line, a triangle, a channel, a trough, a series of troughs, a channel, or any other desired shape for an alignment feature 114. In most embodiments, the alignment feature 114 is position on the crown 115. Further, in most embodiments, the alignment feature 114 is positioned equidistance from the heel end 108 and the toe end 106, perpendicular to the striking surface 110, such that a golfer can utilize the alignment feature 114 to accurately line up the putter 100, to strike a golf ball at an address position.

In some embodiments, the chassis 102 and putter-type body 104 can combine to form the alignment feature 114. In most embodiments, the alignment feature 114 is positioned on the crown 115. Since the chassis 102 and putter-type body 104 comprise a first and second material, that which are different, in most embodiments, the chassis 102 and putter-type body 104 comprise different material colors. This aesthetic material contrast can lead to an improvement in the alignment of the putter, in combination with a traditional alignment feature (i.e., a line, circle, or arrow).

In reference to FIG. 1, the chassis 102 and putter-type body 104 combine to form the crown 115. The portion of the chassis 102 that is exposed, and the alignment line of the putter type body 104, combine to form the full alignment feature 114. The alignment line allows a golfer to center the putter 100, while the exposed chassis 102 portions of the crown 115, offer a secondary space to center a golf ball within. Furthermore, the chassis 102 in this embodiment, is made of a polished stainless steel (silver in color), while the body 104 is made of a dark thermoplastic composite. The chassis 102 is reflective in appearance and has a distinct color contrast to the body 104, allowing a golfer to easily align and center the putter 100 with a golf ball.

The combination of the high density chassis 102, with a low density putter-type body 104, creates the putter 100 with an extremely high MOI, while keeping the golf club head at a desirable overall weight. The flow aperture 122 formed by the chassis 102 forms a dense, yet low volume portion that drastically increase the MOI of the putter, in comparison to a putter milled from a single material. In direct contrast, the putter-type body 104 fills and surrounds the chassis with an extremely light weight, but high volume, to give the putter 100 a desirable shape and volume but maintaining desirable mass properties. A single material putter fails to allocate high density material to the periphery, while maintaining a desirable volume (75 cc-100 cc) and mass (340 grams-385 grams).

c.) Method of Manufacture

Described herein below is a method of manufacturing co-molded golf putter with integral interlocking features, similar to the golf club head 100 described above. Referring to FIG. _, the method comprises (Step 1) providing a chassis 10, (Step 2) providing a mold, (Step 3) injection molding a putter-type body 104, (Step 4) cooling the putter head 100, (Step 5) finishing the golf club head 100 and shafting the putter head to form a golf club.

The chassis 102 can be provided by casting the chassis from the high-density first material. In some embodiments, the chassis 102 can be investment cast and the one or more weights 142 are forged (or cast) and welded or swedged to the chassis 102. In other embodiments, the chassis 102 is co-die cast with the one or more weights 142. In some embodiments, the chassis 102 is forged and the at least one interlocking feature 120 is welded to the chassis 102.

The mold (not shown) can be provided in three parts: a top die, a bottom die, and at least one pin. The mold parts can together define a cavity that corresponds to the desired shape of the golf club head 100, and wherein the at least one pin holds the chassis 102 within the mold. In some embodiments, the size of the mold cavity is slightly different than the desired shape of the golf club head component to account for material shrink rate and springback. The mold can additionally comprise a sprue, a gate, ejection pins, cooling lines, and any other necessary components.

Injection molding may be used to produce putters with intricate geometries and high impact strength. Injection molding the putter-type body 104 comprises providing a mold designed to account for shrink rate, spring back, and freeze off thickness of the injected material. The mold is provided with a gate and flow leaders that guide the injected material evenly into the mold, through the flow aperture 122, through the at least one interlocking feature 120, thereby integrally forming the putter head 100. The even spread of the material into and throughout the mold reduces weld lines (wherein weld lines show the uneven junction of fibers, such that an undesirable line is formed on various parts of the putter 100). Weld lines can compromise the strength of the golf club head 100, as well as the visual aesthetic or alignment features of the club head 100. Ultimately, by reducing the size of the weld lines, the strength of the final part is increased.

Following injection molding, the putter head 100 is cooled. The cooling process allows the thermoplastic composite of the putter-head body 104 to harden within and around the chassis 102. The cooling process is vital in structurally securing the chassis 102 within the putter-type body 104, forming a strong and durable high-MOI putter 100.

After the cooling step, the full club head 100 can be polished to remove the mold gate and/or remove any unwanted flashes. The club head 100 can be coated, plated, or painted. After the club head 100 is finished, it is ready to be attached to a shaft and grip to form a fully assembled golf club.

Step 1: Providing a Chassis

Providing the chassis 102 in the first step can start with casting the chassis 102, wherein the chassis 102 can comprise the flow aperture 122 and at least one interlocking feature 120. The chassis 102 can be investment cast, die cast, co-die cast, lost-wax cast, or any other suitable method for casting the chassis. In other embodiments, the chassis 102 can forged or milled from a block or billet of the high-density first material. In some embodiments, the chassis 102 can be investment cast and the one or more weights 142 are forged (or cast) and welded or swedged to the chassis 102. In other embodiments, the chassis 102 is co-die cast with the one or more weights 142. In some embodiments, the chassis 102 is forged and the at least one interlocking feature 120 is welded to the chassis 102. Any other method of forming the chassis 102 can be used, such as metallic 3-D printing.

The chassis 102, is formed with the respective features mentioned above, including the toe portion 126, the heel portion 124, the rear portion 128, the front 130, the upper surface 134, the lower surface 136, the central strut 132 (in some cases no central strut 138, the flow aperture 122 (in some cases the flow region 138), and at least one interlocking feature 120. The flow aperture 122 and the at least one interlocking feature 120 enable the low-density second material of the putter-type body 104 to flow through the flow aperture 122, and encapsulate the interlocking feature 120, in step 3 of the enclosed method. The flow aperture 122 and the at least one interlocking feature 120 enable the low-density second material of the putter-type body 104 to extend through and completely fill the flow aperture to permanently interlock the body 104 and the chassis 102, to form the golf club head.

Step 2: Providing a Mold

In most embodiments, the mold comprises a top die, a bottom die, and at least one pin. The top die can comprise a sprue, a gate, and a cavity. The bottom die can comprise a reservoir. When the top die and bottom die compress, the pin is inserted in between the top and bottom die, holding the chassis 102 in the desired position to form the putter-type body 104 within and around the chassis 102. The composite material is then dispensed into the mold.

The top die comprises the sprue, the cavity, and the gate. The sprue transfers the liquid composite material from the screw tip to the gate. The gate then transfers the material evenly into the cavity of the top die and reservoir of the bottom die. In some embodiments, the gate is connected to the part of the mold that corresponds to a thickest portion of the putter head 100. In many embodiments, the thickest portion of the putter-type body 104 is the striking surface 110. However, in some embodiments, the gate is connected to a part of the mold that corresponds to a thin portion of the putter head 100. Typically, an injection molded component is weaker adjacent where the gate is connected to the putter 100. Therefore, for some components, such the golf club head described herein, it is advantageous to locate the gate adjacent a section of the component that is not the thickest portion of the putter 100. In embodiments with the gate connected to a thinner portion of the part, flow leaders may be necessary to encourage the flow of material throughout the mold.

In the most embodiments of the mold, the gate is positioned at what will become the striking surface 110 of the club head 100. The gate connects to a striking surface of the putter head 100, in line with the front 130 of the chassis 102. As described further below, locating the gate perpendicular to the striking surface 110 the material to flow generally forward (or away from the striking surface 110, which initially aligns the fibers in a generally front to rear direction. This can increase the strength of the final component, since the composite material strength is affected by the fiber alignment. Furthermore, locating the gate centrally, between what becomes the toe end 106 and the heel end 108, allows the composite material to flow quickly through and into the flow aperture 122 (or flow region 138) and evenly throughout the part. In contrast, if for instance the gate were connected to the toe end 10 or heel end 108 of the club head 100, the material flow could create unwanted weld lines within the toe end 10 or heel end 108.

The bottom die and top die comprise the at least one pin. The at least one pin extends from one of, or both of the, the top die and bottom die, to contact the upper surface 134 and/or lower surface 136 of the chassis 102. The at least one pin holds the chassis 102 in a precise location within the mold, so that the chassis 102 doesn't move with the composite material is dispensed into the mold. In most embodiments, the mold comprises at least 1 pin, at least 2 pins, at least 3 pins, or at least 4 pins. In one embodiment, the mold comprises exactly 2 pins, 3 pins, or 4 pins. Without the at least one pin, the chassis 102 would be subject to movement, causing improperly formed components.

Step 3: Injection Molding a Putter-Type Body

Injection molding a putter-type body 104 in the third step can comprise the following: drying a composite material, heating the composite material, compressing the heated material into the mold, and ejecting the putter head 100 from the mold. The chassis 102 is placed and the mold, the putter-type body 102 is formed around the chassis 102, and thus the putter head 102 is ejected from the mold.

A composite material, to form the putter-type body 104, is chosen. As described above, the putter-type body 104 can comprise a composite formed from polymer resin and reinforcing fiber. The polymer resin can comprise a thermoplastic. More specifically, the thermoplastic resin can comprise a thermoplastic polyurethane (TPU) or a thermoplastic elastomer (TPE). For example, the resin can comprise polyphenylene sulfide (PPS), polyetheretheretherketone (PEEK), polyimides, polyamides such as PA6 or PA66, polyamide-imides, polyphenylene sulfides (PPS), polycarbonates, engineering polyurethanes, and/or other similar materials. The reinforcing fiber can comprise carbon fibers (or chopped carbon fibers), glass fibers (or chopped glass fibers), graphene fibers (or chopped graphite fibers), or any other suitable filler material. In other embodiments, the composite material may comprise any reinforcing filler that adds strength and/or durability.

Each of the aforementioned composite materials must be properly dried, prior to the heating of the composite material. Composite materials must be dried prior to injection molding, to remove any and all of the moisture that exists within or on the material (often times composite materials are in pellet forms in large buckets, wherein water or moisture can be trapped between pellets). To properly dry the composite materials, the composite materials are placed in a heated vacuum, with zero humidity, and dried for different amounts of time. This step is necessary, because any moisture that is heated and compressed in the injection molder, can turn into steam and be shot out of the injection molder at high speed, high temperature, and high pressure. Moisture trapped in the composite material must be removed prior to the heating process, to prevent damage to the injection molder or injury to the operator of the machinery.

In Table A below, are five example polymers that can be used in various embodiments of wrap-around components for the golf club head. The drying temperature can range from 150° F. to 350° F. In some embodiments the drying temperature can be 150° F., 175° F., 200° F., 225° F., 250° F., 275° F., 300° F., 325° F., or 350° F. Furthermore, the drying time can range from 0 hours to at least 24 hours. In some embodiments, no drying time is necessary. In other embodiments, the drying time required can be at least 2 hours, at least 4 hours, at least 6 hours, at least 8 hours, at least 10 hours, at least 12 hours, or at least 14 hours. In some embodiments, the drying time required can range between 0-2 hours, 2-4 hours, 4-6 hours, 6-8 hours, 8-10 hours, 10-12 hours, 12-14 hours, 14-16 hours, 16-18 hours, 18-20 hours, 20-22 hours, or 22-24 hours. Further still, in some embodiments, the drying time can well exceed the minimum dry time (i.e., drying Nylon 66, which has a minimum drying time of 4 hours, for 28 hours).

TABLE A

| Polymer Type | Nylon 66 | Nylon 6 | PP | TPU | PES |
|---|---|---|---|---|---|
| Temperature | 185° F. | 185° F. | Not required | 190° F. | 300° F. |
| Time | 4 hours | 4 hours | N/A | 4 hours | 6 hours |
| Max Moisture Content | 0.18% | 0.18% | N/A | 0.02% | 0.04% |

Once the drying process is complete, the chosen composite material can be heated in the injection molder. In one embodiment, the injection molder comprises a hopper, a compression screw, a screw tip, and a mold. The composite material (in pellet form) is placed in the hopper, wherein the hopper slowly feeds pellets into the compression screw. The compression screw gradually rotates moving the pellets from the hopper, towards the screw tip. As the pellets are moved from the hopper to the screw tip, they are heated at various temperatures, liquifying the pellets. The liquified composite material passes into screw tip and then dispensed out of the screw tip into the mold, thus forming the wrap-around component.

However, there are a variety of factors that must be accounted for in the injection molder to properly heat the chosen composite material. The chosen composite material must be heated at various temperatures as it moves from the hopper, to the compression screw, to screw tip, and thus into the mold. Further, the compression screw comprises 3 different zones, a feed zone, a transition zone, and a metering zone, at which the composite material can be heated at different temperatures. In total there are 5 different regions of the injection molder, in which the composite material can be heated at various temperatures, to optimize the flow and material properties of each material.

Referring to Table B, below, are 5 example polymers, that can be used in various embodiments of wrap-around components for the golf club head, and their respective heating ranges for the 5 regions of the injection molder.

TABLE B

| Polymer Type | Nylon 66 | Nylon 6 | PP | TPU | PES |
|---|---|---|---|---|---|
| Feed Zone | 540° F.-570° F. | 500° F.-530° F. | 390° F.-410° F. | 440° F.-500° F. | 660° F.-690° F. |
| Transition Zone | 550° F.-580° F. | 510° F.-540° F. | 410° F.-420° F. | 410° F.-480° F. | 680° F.-710° F. |
| Metering Zone | 560° F.-590° F. | 520° F.-550° F. | 410° F.-430° F. | 420° F.-480° F. | 690° F.-720° F. |
| Screw Tip | 550° F.-590° F. | 520° F.-550° F. | 400° F.-420° F. | 430° F.-480° F. | 700° F.-730° F. |
| Mold | 200° F. | 200° F. | 175° F. | 210° F. | 325° F.-380° F. |

The temperature at the feed zone of the injection molder can range between 350° F.-800° F. In some embodiments, the temperature at the feed zone of the injection molder can range between, 350° F.-400° F., 400° F.-450° F., 450° F.-500° F., 500° F.-550° F., 550° F.-600° F., 600° F.-650° F., 650° F.-700° F., 700° F.-750° F., and 750° F.-800° F. In other embodiments, the temperature at the feed zone of the injection molder can be at least 400° F., at least 500° F., at least 600° F., at least 700° F., or at least 800° F. Further still, in some embodiments the temperature at the feed zone of the injection molder can range between the provided ranges in Table B above.

The temperature at the transition zone of the injection molder can range between 350° F.-800° F. In some embodiments, the temperature at the feed zone of the injection molder can range between, 350° F.-400° F., 400° F.-450° F., 450° F.-500° F., 500° F.-550° F., 550° F.-600° F., 600° F.-650° F., 650° F.-700° F., 700° F.-750° F., and 750° F.-800° F. In other embodiments, the temperature at the transition zone of the injection molder can be at least 400° F., at least 500° F., at least 600° F., at least 700° F., or at least 800° F. Further still, in some embodiments the temperature at the transition zone of the injection molder can range between the provided ranges in Table B above.

The temperature at the metering zone of the injection molder can range between 350° F.-800° F. In some embodiments, the temperature at the metering zone of the injection molder can range between, 350° F.-400° F., 400° F.-450° F., 450° F.-500° F., 500° F.-550° F., 550° F.-600° F., 600° F.-650° F., 650° F.-700° F., 700° F.-750° F., and 750° F.-800° F. In other embodiments, the temperature at the metering zone of the injection molder can be at least 400° F., at least 500° F., at least 600° F., at least 700° F., or at least 800° F. Further still, in some embodiments the temperature at the metering zone of the injection molder can range between the provided ranges in Table B above.

The temperature at the screw tip of the injection molder can range between 350° F.-800° F. In some embodiments, the temperature at the feed zone of the injection molder can range between, 350° F.-400° F., 400° F.-450° F., 450° F.-500° F., 500° F.-550° F., 550° F.-600° F., 600° F.-650° F., 650° F.-700° F., 700° F.-750° F., and 750° F.-800° F. In other embodiments, the temperature at the screw tip of the injection molder can be at least 400° F., at least 500° F., at least 600° F., at least 700° F., or at least 800° F. Further still, in some embodiments the temperature at the screw tip of the injection molder can range between the provided ranges in Table B above.

The temperature of the mold can range between 0° F.-400° F. In some embodiments, the temperature at the feed zone of the injection molder can range between, 0° F.-50° F., 50° F.-100° F., 100° F.-150° F., 150° F.-200° F., 200° F.-250° F., 250° F.-300° F., 300° F.-350° F., or 350° F.-400° F. In other embodiments, the temperature of the mold can be at least, 0° F., at least 100° F., at least 200° F., or at least 300° F. Further still, in some embodiments the temperature of the mold can range between the provided ranges in Table B above.

Once the composite material is heated, the screw tip dispenses the liquid composite into the desired mold. When the liquid composite is injected into the mold, the liquid composite material flows through through the flow aperture 122, around (and through) the at least interlocking features 120, and around the chassis 102. This forms the desired putter head 100 shape (i.e., blade, mid-mallet, mallet).

Although the above-described mold is designed to form a single putter head 100, the mold can also be designed to simultaneously form two, three, four, five, or six putter heads 100. Similar to a single mold, a sprue feeds material from the injection molder compression screw into two gates, one for each putter head being formed.

Further, during the injection molding process, the direction of material flow within the mold will affect the fiber alignment. The walls of the sprue, gate, and mold can interact with the flowing composite material, causing at least 50% of the fibers to align in the direction of flow. Therefore, the direction of the flow impacts the fiber alignment/structure of the putter head 100. By locating the gate on a first extremity of the mold (corresponding to the striking surface 110 of the putter head 100) the material initially flows forward towards a second extremity of the mold (opposite of the gate and corresponding to a rear portion 112 of the putter head 100). This flow aligns the fibers in the crown 115 and sole 117 roughly perpendicular to the striking surface 110 in the final club head 100. The strength of the composite material in a given direction is affected by the fiber alignment. Having the fibers aligned roughly perpendicular to the striking surface 110 increases the durability of the club head in the front to rear direction. The durability of the striking surface 110 in the front to rear direction is necessary to prevent failure, because upon impact with a golf ball, the striking surface 110 is directly hitting and contacting a golf ball. Therefore, aligning the fibers with the direction of compression stress that is expected at impact with a golf ball lowers the likelihood of failure within the composite putter head 100.

The pressure and speed at which the composite material is dispensed into the mold is equally as important as the temperature and direction of the composite material, in order to achieve a strong and durable putter head 100. The pressure of the injection molder is hydraulically applied from the back of the injection molder into the compression screw. The speed of the injection molder is the speed at which the composite material exits the screw tip. The pressure and speed help ensure that the composite material flows evenly through the mold, filling the entire mold.

In most embodiments, the injection pressure of the composite material through the injection molder can range between 0-2000 psi. In some embodiments, the injection pressure of the composite material through the injection molder can range from 0-100 psi, 100-200 psi, 200-300 psi, 300-400 psi, 400-500 psi, 500-600 psi, 600-700 psi, 700-800 psi, 800-900 psi, 900-1000 psi, 1000-1100 psi, 1100-1200 psi, 1200-1300 psi, 1300-1400 psi, 1400-1500 psi, 1500-1600 psi, 1600-1700 psi, 1700-1800 psi, 1800-1900 psi, or 1900-2000 psi. In other embodiments, the injection pressure of the composite material through the injection molder can be at least 100 psi, at least 200 psi, at least 300 psi, at least 400 psi, at least 500 psi, at least 600 psi, at least 700 psi, at least 800 psi, at least 900 psi, at least 1000 psi, at least 1100 psi, at least 1200 psi, at least 1300 psi, at least 1400 psi, at least 1500 psi, at least 1600 psi, or at least 1700 psi.

Finally, once the composite material is injected into the mold, the putter-type body 104 is formed around the chassis 102, and the final golf club head 100 is formed, the golf club head 100 is ejected from the injection molder. The top die is removed from the bottom die, and the pins are removed, leaving the golf club head 100 positioned in the bottom die. The at least one ejector pins of the bottom die subsequently extend from the bottom die pushing the putter head 100 out of the mold, completing the injection molding process.

The full injection molding step can be completed in an amount of time known as the cycle time. In embodiments where the mold comprises more than one cavity for forming more than one wrap-around component simultaneously, a part production speed is determined by dividing the cycle time by the number of components produced within one cycle. The cycle time can range between 20 seconds to 120 seconds. In some embodiments, the cycle time ranges between 20 seconds and 60 seconds, between 30 seconds and 60 seconds, between 40 second and 60 seconds, between 60 seconds and 90 seconds, between 70 seconds and 90 seconds, or between 100 seconds and 120 seconds.

Step 4: Cool the Putter Head

Following the injection molding of the golf club head 100, the putter head 100 is cooled for a desired amount of time, to allow the composite material to harden and settle within the flow aperture 122, within and around the at least one interlocking features 120, and around the chassis 102. The cooling of the putter head 100, in some embodiments, can occur in the mold, prior to ejection of the putter head 100 from the mold. In most embodiments, the putter head 100 is cooled in a cooling bath of a cool liquid, such as water.

The cooling time can range between 20 seconds to 120 seconds. In some embodiments, the cycle time ranges between 20 seconds and 60 seconds, between 30 seconds and 60 seconds, between 40 second and 60 seconds, between 60 seconds and 90 seconds, between 70 seconds and 90 seconds, or between 100 seconds and 120 seconds.

Step 5: Finish the Putter Head

Once the putter head 100 is cooled, the golf club head is finished. This step can comprise polishing, cleaning, coating, and/or painting the club head. In most embodiments, the putter head 100 has the gate and sprue attached to the striking surface 110 of the putter head 100. The gate and sprue are machined or cut away, and the face is smoothed, to form a level striking surface 110. In some embodiments, the striking face insert 115 is secured within the striking surface 110, covering the cavity created from the mold.

The striking face insert 116 can be formed by a number of different processes. The different forming processes include the following: injection molding, casting, blow molding, compression molding, co-molding, laser forming, film insert molding, gas assist molding, rotational molding, thermoforming, laser cutting, 3-D printing, forging, stamping, electroforming, machining, molding, or any combination thereof. Further, the striking face insert 116 can have any combination of hardness, volume, thickness, and forming processes described above.

Finally, the putter head 100, is attached to a golf shaft (not shown), wherein the shaft comprises a grip, to form a usable, functioning golf club. The golf shaft can be various lengths, with various grip sizes, to accommodate golfers of various sizes. Furthermore, the golf shaft can comprise the hosel wherein the hosel forms the connection between the shaft and the putter head 100.

d.) Benefits

The putter-type golf club head provides MOI, CG, feel, and weighting benefits, in a putter-type golf club head with a high-density chassis and low density putter-type body and/or without using mechanically fastened weights or weight ports. By creating a putter-type golf club head from a high-density chassis that is surrounded by a low-density putter-type body, the weighting of the club head shifts towards the peripheries of the putter-type golf club head, without any weight ports or attachments to the heel end and toe end of the putter-type golf club head. This shift in weight, towards the peripheries of the putter-type golf club head, raises the MOI of the club head about the y-axis (Iyy), therefore preventing the rotation of the club head at impact, about the y-axis, and assuring the strike face is square to a golf ball during impact. The increase in MOI about the y-axis helps achieve a straighter ball path and improve the outcome of off-centered hits (impact at the heel end or toe end).

By creating the putter-type golf club head from the high-density chassis that is surrounded by the low-density putter-type body, the putter-type golf club head can be optimized to improve the MOI, while keeping the golf club head at a desirable overall weight. In some embodiments, the moment of inertia of the golf club head about the y-axis center of gravity is between 3500 $g \cdot cm^2$-8000 $g \cdot cm^2$. In other embodiments the moment of inertia of the golf club head about the y-axis center of gravity can be between 3500 $g \cdot cm^2$-4000 $g \cdot cm^2$, 4000 $g \cdot cm^2$-4500 $g \cdot cm^2$, 4500 $g \cdot cm^2$-5000 $g \cdot cm^2$, 5000 $g \cdot cm^2$-5500 $g \cdot cm^2$, 5500 $g \cdot cm^2$-6000 $g \cdot cm^2$, 6000 $g \cdot cm^2$-6500 $g \cdot cm^2$, 6500 $g \cdot cm^2$-7000 $g \cdot cm^2$, 7000 $g \cdot cm^2$-7500 $g \cdot cm^2$, or 7500 $g \cdot cm^2$-8000 $g \cdot cm^2$.

The putter-type golf club head with the high-density chassis and low density putter-type body, increases the MOI about the y-axis center of gravity by at least 1% over a putter with the same volume, mass, and single material construction (i.e., a putter milled of a single material such as a steel putter or a putter investment cast of a single material). In some embodiments, the putter-type golf club head with the high-density chassis and low density putter-type body, increases the MOI about the y-axis center of gravity by at least 1%, by at least 5%, by at least 10%, by at least 20%, by at least 25%, by at least 30%, by at least 35%, by at least 40%, by at least 45%, by at least 50%, by at least 55%, by at least 60%, by at least 65%, by at least 70%, by at least 75%, by at least 80%, by at least 85%, by at least 90%, by at least 95%, by at least 95%, by at least 100%, or by at least 105%, over a putter with the same volume, mass, and single material construction.

e.) Co-Molded Putter Embodiments

Mallet Putter Head Embodiment

In one embodiment, the putter-type golf club head 100 can be a mallet putter head 1100. Referring to FIGS. 10-12, the putter head 1100 comprises a chassis 1102 and a putter-type body 1104. The chassis 1102 is made from a first material having a first density and the putter-type body 1104 is made from a second material having a second density. The first density is greater than the second density. The chassis 1102 and the putter-type body 1104 combine to create a high MOI putter head 2100 (4,500 $g \cdot cm^2$-5,500 $g \cdot cm^2$), while maintaining a desirable volume and mass.

As discussed above, the chassis 1102 is comprise of a high-density material (i.e., the first material). In this embodiment, the chassis 1102 comprises the first material with a density greater than 7.0 g/cc. The chassis 1102 comprises a heel portion 1124. The chassis 1102 comprises a toe portion 1126, opposite the heel portion 1124. The chassis 1102 comprises a rear 1128. The rear 1128 is adjacent the heel portion 1124 and the toe portion 1126. The chassis 1102 comprises a rear 1128. The rear 1128 is adjacent the heel portion 1124 and the toe portion 1126. The chassis 1102 comprises a front 1130 formed by only the toe portion 1126 and the heel portion 1124 (entirely devoid of the central strut 132 as mentioned in some embodiments).

Further, the chassis 1102 comprises an upper surface 1134. The upper surface 1134 is adjacent the rear 1128, the front 1130, the toe portion 1126, and the heel portion 1124. The chassis 1102 comprises a lower surface 1136. The lower surface is opposite the upper surface 1134, and is adjacent the rear 1128, the front 1130, the toe portion 1126, and the heel portion 1124.

The chassis 1102 can be "U-shaped," horseshoe shaped, parabolically shaped, dumbbell shaped, or any other desired curved shape. In most embodiments, the chassis 1102 shape fosters the desirable shift of mass towards the peripheries (toe, heel, rear, front) of the chassis 1102 and the peripheries of the putter-type golf club head 1100.

Still referring to FIGS. 10-12, the heel portion 1124, toe portion 1126, and rear 1128 form a flow region 1138 comprising a void 1160 bounded by an interior wall 1162 of the chassis 1102 that extends from the upper surface 1134 to the lower surface 1136 of the chassis 1102. The flow region 1138 functions identically as the flow aperture 128, however is merely devoid of the central strut 132. When the putter-type body 1104 is molded to the chassis 1102, the flow region 1138 allows the lightweight, low density material of the putter-type body 1104 to encapsulate the chassis 1102 such that the body 1104 extends through and completely fills the flow region 1138. The flow region 1138 allows the putter body 1104 to integrally interlock the body 1104 and the chassis 1102, to form the club head 1100. Furthermore, the flow region 1138 allows the lightweight, low density material of the putter-type body 1104 to flow in a direction perpendicular to the striking surface 1110 of the golf club head 1100. In some cases when the putter-type body 1104 is formed from a thermoplastic composite material with a fibrous filler, this allows the fibers to settle in a direction perpendicular to the striking surface 1110, increasing the strength and durability of the club head 1100. Further still, the flow region 1138 allows a thermoplastic composite material with a fibrous filler to closely surround the chassis 1102, with minimal porosity, thereby forming a solid and durable club head 1100.

The chassis 1102 comprises at least one interlocking feature 1120 protruding or extending from any one or combination of the following chassis 1102 features: the heel portion 1124, the toe portion 1126, the rear 1128, the front 1130, the upper surface 1134, and the lower surface 1136. The at least one interlocking features 1120 function to further interlock and integrally join the chassis 1102 and the putter-type body 1104, by allowing a thermoplastic composite material with a fibrous filler (or other high strength lightweight material) to encase the entirety of the at least one interlocking feature 1120.

The chassis 1102 can comprise three interlocking features 1120. In some embodiments, the chassis 1102 can comprise two or more interlocking features 1120, three or more interlocking features 1120, four or more interlocking features, or more. In this embodiment, the five interlocking features 1120 can be in the form of an anchor. In this embodiment, wherein the three interlocking features 1120 are in the form of an anchor, an anchor aperture 1140 is formed between the each of the three interlocking features 1120 and the portion of the chassis 1102 (the heel portion 1124, the toe portion 1126, the rear 1128, the front 1130, the upper surface 1134, and the lower surface 1136) that which each of the three interlocking features 1120 protrudes from. In this embodiment, the chassis 1102 comprises three anchor apertures 1140, one corresponding to each of the three interlocking features 1120. The anchor apertures 1140 and interlocking features 1120, similar to the flow aperture 1122, allows the lightweight, low density material of the putter-type body 1104, to entirely fill the anchor apertures 1140 and encapsulate the interlocking features 1120, to integrally join the chassis 1102 and the putter-type body 1104.

In many embodiments, the anchor apertures 1140 of the three interlocking feature 1120 can be any one of the following shapes: circular, semi-circular, elliptical, triangular, rectangular, trapezoidal, octagonal, any polygonal shape, or any other desired geometric shape. In some embodiments, the at least one anchor interlocking features 1120 can comprise more than one anchor apertures 1140. In these embodiments, the more than one anchor apertures 1140 of the at least one interlocking features 1120 can be any one or combination of the following shapes: circular, elliptical, triangular, rectangular, trapezoidal, octagonal, any polygonal shape, or any other desired geometric shape. In this embodiments, referring to FIG. 12, the anchor apertures 1140 are semi-circular in shape.

As aforementioned, the putter-type body 1104 comprises a low density second material. In most embodiments, the putter-type body 1104 comprises a thermoplastic composite material that comprises a thermoplastic polymer matrix material and a filler. In other embodiments, the putter-type body 1104 can comprise any other low density second material, wherein the other low density materials are not repeated herein for brevity. In this embodiment, the putter-type body 1104 comprises the second material with a density less than 4.0 g/cc. The chassis 1102 and the putter-type body 1104 are permanently joined without the use of welding, epoxies, or adhesives. The thermoplastic polymer matrix miller and filler of the putter-type body 2104, combined with the flow region 1138 and at least one interlocking feature 1120 of the chassis 1102, creates an integral putter 1100, without the use of welding, epoxies, or adhesives.

In some embodiments, the putter type golf club head 1100 can comprise a striking surface 1110 made of the first material and the second material. In this embodiment, the first and second material equally form the striking surface 1110. In this embodiment, the high-density first material of the chassis 1102 includes a striking surface heel end 1166 located at the heel end 108 and a striking surface toe end 1164 located at the toe end 106, to maximize the MOI, by positioning the heavy material towards the peripheries of the putter 1100.

The putter-type body 1104 is integrally formed within the chassis 1102. As previously described the light-weight material of the putter-type body 1104 extends through and completely fill the chassis 1102 flow region 1138, interlocks the body 1104 and the chassis 1102, and forms the putter-type golf club head 1100. Further, in some embodiments, the putter-type body 1104 encases (or encapsulates) 100% of the chassis 1102. In this embodiment, the putter-type body 1104 encases at least 10% of the chassis 1102.

The putter-type body 1104, when combined with the chassis 1102, forms the golf club head 1100 toe end 1106, heel end 1108, rear portion 1112, and striking surface 1110. The putter-type body 1104 forms a portion of the crown 1115 and a portion of the sole 1117. In reference to FIGS. 10-12, when the putter-type body 1104 and chassis 1102 are joined, the chassis 1102 and putter-type body 1104 combine to form the putter 1100 crown 1115. Similarly, when the putter-type body 1104 and chassis 1102 are joined, the chassis 1102 and putter-type body 1104 combine to form the putter 1100 sole 1117.

The putter-type body 1104 can form 100% of the crown 1115, such that the chassis 1102 cannot be seen from an address position. In this embodiment however, the putter-type body 1104 forms at least 50% of the crown 1115. Similar to the crown 1115, the putter-type body 1104 can form 100% of the sole 1117, such that the chassis 1102 does not contact the ground plane, at an address position. In this embodiment however, the putter-type body 1104 forms at least 50% of the sole 1117, wherein a portion of the putter-type body 1104 and a portion of the chassis 1102 contacts the ground, at an address position.

Further, the putter-type body 1104 forms at least a portion of the golf club head 1100 alignment feature 1114. In some embodiments, the putter-type body 1104 forms the entirety of the alignment feature 1114. The alignment feature 1114 can be any one or combination of the following: a line, a series of lines, a circle, a dashed line, a triangle, a channel, a trough, a series of troughs, a channel, or any other desired shape for an alignment feature 1114. In most embodiments, the alignment feature 1114 is positioned on the crown 1115. Further, in most embodiments, the alignment feature 1114 is positioned equidistance from the heel end 1108 and the toe end 1106, perpendicular to the striking surface 1110, such that a golfer can utilize the alignment feature 1114 to accurately line up the putter 1100, to strike a golf ball at an address position. In this embodiment, the alignment feature 1114 comprises a line 1150 positioned on the crown 1115.

Further, in this embodiment, the chassis 1102 comprises less than 60% of a total volume of the putter 1100. The chassis 1102 also comprises at least 60% of an overall mass of the putter 1100. By creating a putter-type golf club head 1100 from a high-density chassis 1102 that is surrounded by a low-density putter-type body 1104, the weighting of the club head 1100 shifts towards the peripheries of the putter-type golf club head 1100, without any weight ports or attachments to the heel end 1108 and toe end 1106 of the putter-type golf club head 1100. This shift in weight, towards the peripheries of the putter-type golf club head 1100, raises the MOI of the club head 1100 about the y-axis (Iyy), therefore preventing the rotation of the club head 1100 at impact, about the y-axis, and assuring the striking surface 1110 is square to a golf ball during impact. The increase in MOI about the y-axis helps achieve a straighter ball path and improve the outcome of off-centered hits (impact at the heel end or toe end).

The exemplary club head 1100 was compared to a control club head (hereafter the "control"), wherein the control was a golf club head of identical shape and volume as the exemplary club head 1100. However, the control club head was made entirely from stainless steel and tungsten, whereas the exemplary club head 1100 was made from the first, high-density material (stainless steel), and the second, low-density material (TPC).

The exemplary club head 1100 comprises a mass of 354.6 grams, with a moment of inertia about the y axis of 5,418.05 $g/cm^2$. In comparison, the control club comprises a mass of 365.2 grams, which is nearly 9 grams lighter, with a moment of inertia about the y axis of 4,270.31 $g/cm^2$. The exemplary club head 1100 comprises a 26.88% increase in moment of inertia. Thus, the exemplary club head 1100 comprises more forgiveness (higher MOI about the y-axis means the club head 1100 is less likely to rotate on off-center impacts, thus more consistently straight hits) than the control club.

Circular Mallet Putter Head Embodiment

In one embodiment, the putter-type golf club head 100 can be a circular shaped mallet putter head 2100. Referring to FIGS. 22-25, the circular putter head 2100 comprises a chassis 2102 and a putter-type body 2104. The chassis 2102 is made from a first material having a first density and the putter-type body 2104 is made from a second material having a second density. The first density is greater than the second density. The chassis 2102 and the putter-type body 2104 combine to create a light weight (315 grams-345 grams), high MOI putter head 2100 (3,500 $g \cdot cm^2$-4,000 $g \cdot cm^2$), while maintaining a desirable volume and mass.

As discussed above, the chassis 2102 is comprise of a high-density material (i.e., the first material). In this embodiment, the chassis 2102 comprises the first material with a density greater than 7.0 g/cc. The chassis 2102 comprises a heel portion 2124. The chassis 2102 comprises a toe portion 2126, opposite the heel portion 2124. The chassis 2102 comprises a rear 2128. The rear 2128 is adjacent the heel portion 2124 and the toe portion 2126. The chassis 2102 comprises a front 2130 formed by only the toe portion 2126 and the heel portion 2124 (entirely devoid of the central strut 132 as mentioned in some embodiments).

Further, the chassis 2102 comprises an upper surface 2134. The upper surface 2134 is adjacent the rear 2128, the front 2130, the toe portion 2126, and the heel portion 2124. The chassis 2102 comprises a lower surface 2136. The lower surface is opposite the upper surface 2134, and is adjacent the rear 2128, the front 2130, the toe portion 2126, and the heel portion 2124.

The chassis 2102 can be "U-shaped," horseshoe shaped, parabolically shaped, dumbbell shaped, or any other desired curved shape. In most embodiments, the chassis 2102 shape fosters the desirable shift of mass towards the peripheries (toe, heel, rear, front) of the chassis 2102 and the peripheries of the putter-type golf club head 2100.

Still referring to FIGS. 22-25, the heel portion 2124, toe portion 2126, and rear 2128 form a flow region 2138. The flow region 2138 functions identically as the flow aperture 128, however is merely devoid of the central strut 132. When the putter-type body 2104 is molded to the chassis 2102, the flow region 2138 allows the lightweight, low density material of the putter-type body 2104 to encapsulate the chassis 2102 such that the body 2104 extends through and completely fills the flow region 2138. The flow region 2138 allows the putter body 2104 to integrally interlock the body 2104 and the chassis 2102, to form the club head 2100. Furthermore, the flow region 2138 allows the lightweight, low density material of the putter-type body 2104 to flow in a direction perpendicular to the striking surface 2110 of the golf club head 2100. In some cases when the putter-type body 2104 is formed from a thermoplastic composite material with a fibrous filler, this allows the fibers to settle in a direction perpendicular to the striking surface 2110, increasing the strength and durability of the club head 2100. Further still, the flow region 2138 allows a thermoplastic composite material with a fibrous filler to closely surround the chassis 2102, with minimal porosity, thereby forming a solid and durable club head 2100.

The chassis 2102 comprises at least one interlocking feature 2120 protruding or extending from any one or combination of the following chassis 2102 features: the heel portion 2124, the toe portion 2126, the rear 2128, the front 2130, the upper surface 2134, and the lower surface 2136. The at least one interlocking features 2120 function to further interlock and integrally join the chassis 2102 and the putter-type body 2104, by allowing a thermoplastic composite material with a fibrous filler (or other high strength lightweight material) to encase the entirety of the at least one interlocking feature 2120.

The chassis 2102 can comprise three interlocking features 2120. In some embodiments, the chassis 2102 can comprise two or more interlocking features 2120, three or more interlocking features 2120, four or more interlocking features, or more. In this embodiment, the three interlocking features 2120 can be in the form of an anchor. In this embodiment, wherein the three interlocking features 2120 are in the form of an anchor, an anchor aperture 2140 is formed between the each of the two of the interlocking features 2120 and the portion of the chassis 2102 (the heel portion 2124, the toe portion 2126, the rear 2128, the front 2130, the upper surface 2134, and the lower surface 2136) that which each of the two interlocking features 2120 protrudes from. Further, the third interlocking feature 2120, comprises three anchor apertures 2140, formed within the interlocking feature 2120, and the rear 2128. In this embodiment, the chassis 2102 comprises five anchor apertures 2140, one corresponding to each of the five interlocking features 2120. The anchor apertures 2140 and interlocking features 2120, similar to the flow aperture 2122, allows the lightweight, low density material of the putter-type body 2104, to entirely fill the anchor apertures 2140 and encapsulate the interlocking features 2120, to integrally join the chassis 2102 and the putter-type body 2104.

In many embodiments, the anchor apertures 2140 of the three interlocking feature 2120 can be any one of the following shapes: circular, elliptical, triangular, rectangular, trapezoidal, octagonal, any polygonal shape, or any other desired geometric shape. In some embodiments, the at least one anchor interlocking features 2120 can comprise more than one anchor apertures 2140. In these embodiments, the more than one anchor apertures 2140 of the at least one interlocking features 2120 can be any one or combination of the following shapes: circular, elliptical, triangular, rectangular, trapezoidal, octagonal, any polygonal shape, or any other desired geometric shape. In this embodiments, referring to FIG. 24, the anchor apertures 2140 are a combination of ovular and rectangular in shape.

As aforementioned, the putter-type body 2104 comprises a low density second material. In most embodiments, the putter-type body 2104 comprises a thermoplastic composite material that comprises a thermoplastic polymer matrix material and a filler. In other embodiments, the putter-type body 2104 can comprise any other low density second material, wherein the other low density materials are not repeated herein for brevity. In this embodiment, the putter-type body 2104 comprises the second material with a density less than 4.0 g/cc. The chassis 2102 and the putter-type body 2104 are permanently joined without the use of welding, epoxies, or adhesives. The thermoplastic polymer matrix miller and filler of the putter-type body 2104, combined with the flow region 2138 and at least one interlocking feature 2120 of the chassis 2102, creates an integral putter 2100, without the use of welding, epoxies, or adhesives.

Further, the putter-type golf club head 2100 can comprise a strike face insert 2116, positioned on or within the striking surface 2110. In these embodiments, the strike face insert 2116 is independently formed prior to being coupled to the club head 2100. The side of the strike face insert 2116 that will contact the club head 2100 can comprise a geometry complementary to the geometry of the corresponding portion (i.e., a cavity in the striking surface of the putter-type golf club head) of the club head 2100 that will contact the striking surface 2110. In this embodiment, the putter head 2100, can comprises the chassis 2102, of the first material, the putter-type body 2104, of the second material, and the strike face insert 2116, comprising the third material.

The strike face insert 2116 can be secured to the club head 2100 by a fastening means. In this embodiment, the strike face insert 2116 is secured to the putter-type body 2104. In this embodiments, in reference to FIG. 25, the putter-type body 2104 can comprise an insert cavity 2118, wherein the cavity 2118 functions to receive the strike face insert 2116. The strike face insert 2116 can be secured by an adhesive such as glue, very high bond (VHB™) tape, epoxy or another adhesive. Alternately or additionally, the strike face insert 2116 can be secured by welding, soldering, screws, rivets, pins, mechanical interlock structure, or another fastening method.

The putter-type body 2104 is integrally formed within and around the chassis 2102. As previously described the lightweight material of the putter-type body 2104 extends through and completely fill the chassis 2102 flow aperture 2122, interlocks the body 2104 and the chassis 2102, and forms the putter-type golf club head 2100. Further, in some embodiments, the putter-type body 2104 encases (or encapsulates) 100% of the chassis 2102. In this embodiment, the putter-type body 2104 encases at least 30% of the chassis 2102.

The putter-type body 2104, when combined with the chassis 2102, forms the golf club head 2100 toe end 2106, heel end 2108, rear portion 2112, and striking surface 2110. The putter-type body 2104 forms a portion of the crown 2115 and a portion of the sole 2117. In reference to FIGS. 22 and 23, when the putter-type body 2104 and chassis 2102 are joined, the chassis 2102 and putter-type body 2104 combine to form the putter 2100 crown 2115. Similarly, when the putter-type body 2104 and chassis 2102 are joined, the chassis 2102 and putter-type body 2104 combine to form the putter 2100 sole 2117.

The putter-type body 2104 can form 100% of the crown 2115, such that the chassis 2102 cannot be seen from an address position. In this embodiment however, the putter-type body 2104 forms at least 50% of the crown 2115. Similar to the crown 2115, the putter-type body 2104 can form 100% of the sole 2117, such that the chassis 2102 does not contact the ground plane, at an address position. In this embodiment however, the putter-type body 2104 forms at least 50% of the sole 2117, wherein a portion of the putter-type body 2104 and a portion of the chassis 2102 contacts the ground, at an address position.

Further, the putter-type body 2104 forms at least a portion of the golf club head 2100 alignment feature 2114. In some embodiments, the putter-type body 2104 forms the entirety of the alignment feature 2114. The alignment feature 2114 can be any one or combination of the following: a line, a series of lines, a circle, a dashed line, a triangle, a channel, a trough, a series of troughs, a channel, or any other desired shape for an alignment feature 2114. In most embodiments, the alignment feature 2114 is positioned on the crown 2115. Further, in most embodiments, the alignment feature 2114 is positioned equidistance from the heel end 2108 and the toe end 2106, perpendicular to the striking surface 2110, such that a golfer can utilize the alignment feature 2114 to accurately line up the putter 2100, to strike a golf ball at an address position.

In this embodiment, the alignment feature 2114 comprises two lines 2150, and golf ball sized aperture 2152, positioned on the crown. The toe end 2106, the heel end 2108, striking surface 2110, rear portion 2112, form the ball sized aperture 2152. The ball sized aperture 2152 helps a golfer match the striking surface 2110 to the ball, with two alignment lines 2150 on each end, leading to improvement in the alignment of the putter, in combination with a traditional alignment feature (i.e., one line, one circle, or one arrow).

Further, in this embodiment, the chassis 2102 comprises less than 50% of a total volume of the putter 2100, yet the chassis 2102 comprises at least 60% of an overall mass of the putter 2100. By creating a putter-type golf club head 2100 from a high-density chassis 2102 that is surrounded by a low-density putter-type body 2104, the weighting of the club head 2100 shifts towards the peripheries of the putter-type golf club head 2100, without any weight ports or attachments to the heel end 2108 and toe end 2106 of the putter-type golf club head 2100. This shift in weight, towards the peripheries of the putter-type golf club head 2100, raises the MOI of the club head 2100 about the y-axis (Iyy), therefore preventing the rotation of the club head 2100 at impact, about the y-axis, and assuring the striking surface 2110 is square to a golf ball during impact. The increase in MOI about the y-axis helps achieve a straighter ball path and improve the outcome of off-centered hits (impact at the heel end or toe end).

The exemplary club head 2100 was compared to a control club head (hereafter the "control"), wherein the control was a golf club head of identical shape and volume as the exemplary club head 2100. However, the control club head was made entirely from stainless steel, whereas the exemplary club head 2100 was made from the first, high-density material (tungsten), and the second, low-density material (TPC).

The exemplary club head 2100 comprises a mass of 355.4 grams, with a moment of inertia about the y axis of 4,863.86 g/cm$^2$. In comparison, the control club comprises a mass of 363.5 grams, with a moment of inertia about the y axis of 4,741.28 g/cm$^2$. The exemplary club head 2100 is nearly 9 grams lighter and comprises a 2.59% increase in moment of inertia. Thus, the exemplary club head 2100 is lighter and yet comprises more forgiveness (higher MOI about the y-axis means the club head 2100 is less likely to rotate on off-center impacts, thus more consistently straight hits) than the control club.

Semi-Circular Mallet Putter Head Embodiment

Figure 27:
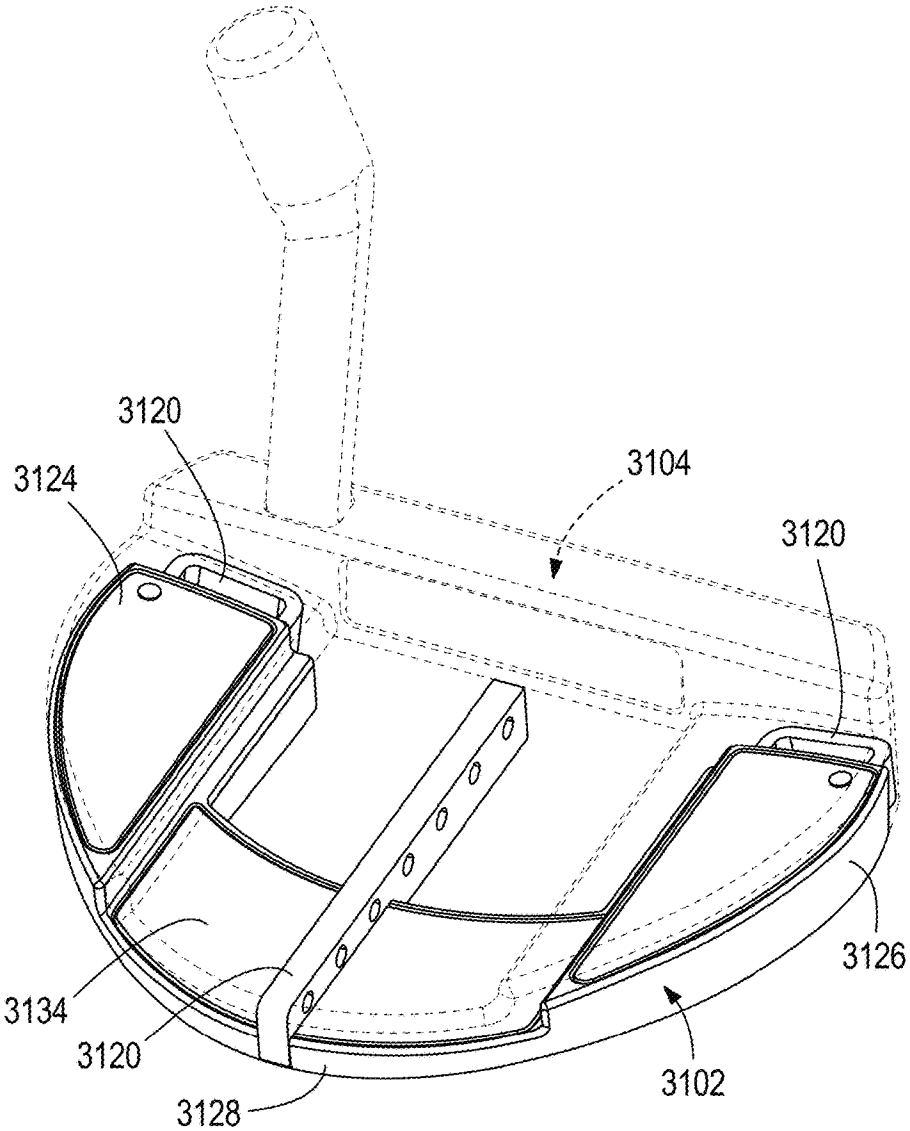
FIG. 27 illustrates a rear perspective view of the combination of a putter-type body and a chassis of the putter-type golf club of FIG. 26.
Figure 26:
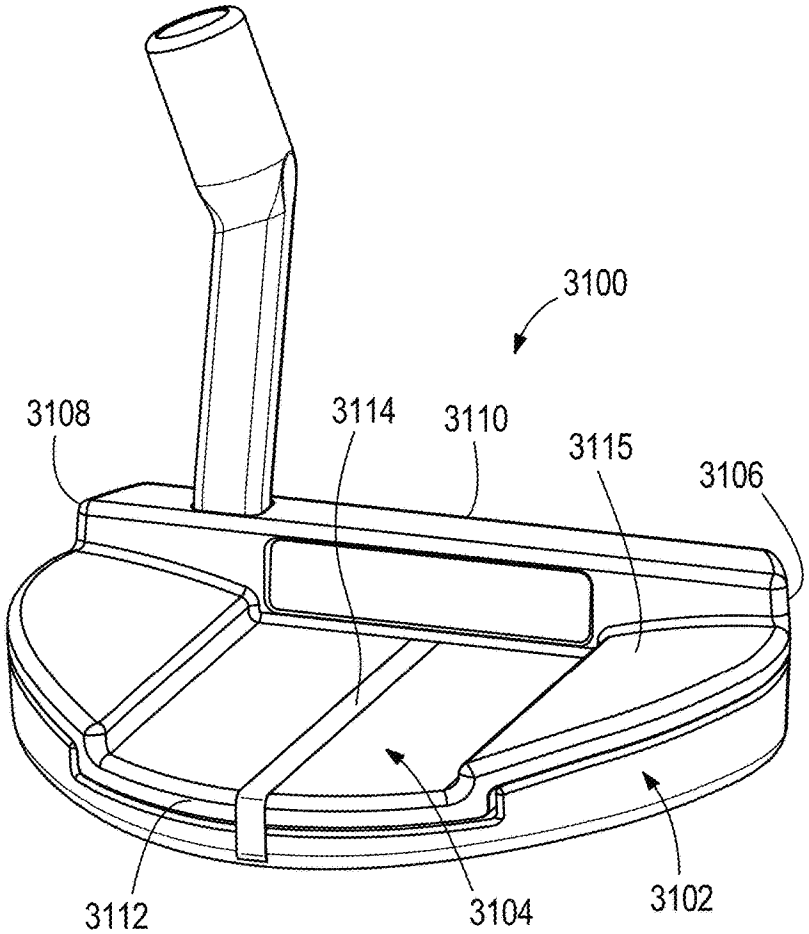
FIG. 26 illustrates a rear perspective view of another putter-type golf club.
Figure 28:
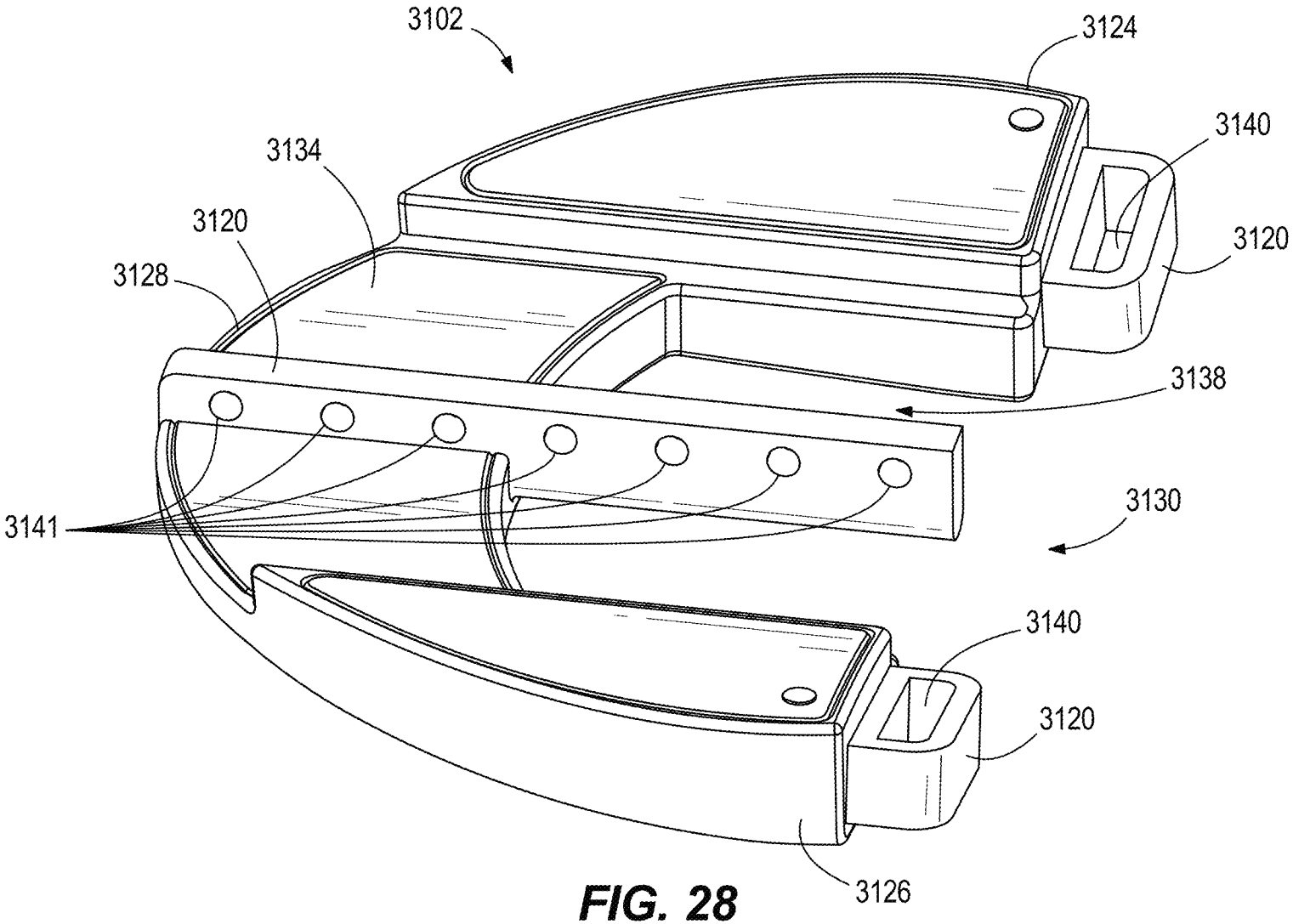
FIG. 28 illustrates a front perspective view of the chassis of the putter-type golf club of FIG. 26.
Figure 29:
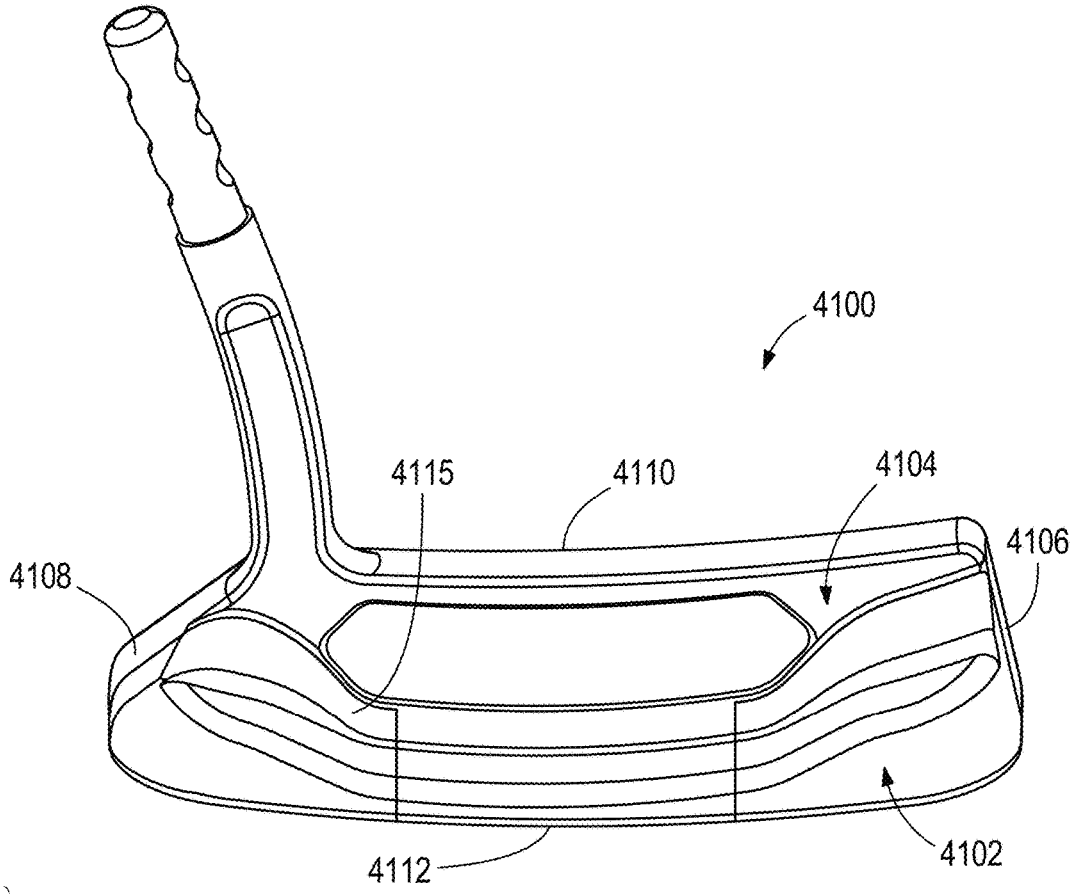
FIG. 29 illustrates a rear perspective view of another putter-type golf club.
Figure 30:
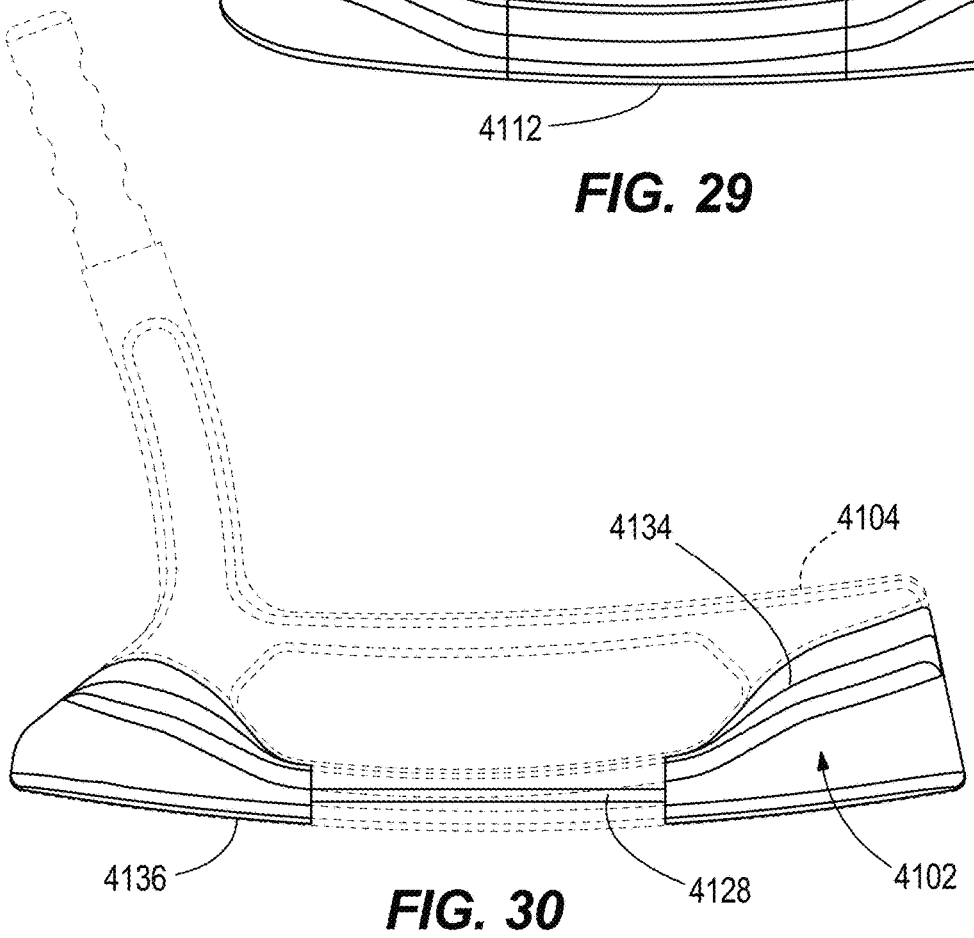
FIG. 30 illustrates a rear view of the combination of a putter-type body and a chassis of the putter-type golf club of FIG. 29.

In one embodiment, the putter-type golf club head 100 can be a semi-circular shaped mallet putter head 3100. Referring to FIGS. 26-28, the semi-circular putter head 3100 comprises a chassis 3102 and a putter-type body 3104. The chassis 3102 is made from a first material having a first density and the putter-type body 3104 is made from a second material having a second density. The first density is greater than the second density. The chassis 3102 and the putter-type body 3104 combine to create a high-MOI putter head 3100 (4,500 g·cm$^2$-6,500 g·cm$^2$), while maintaining a desirable volume and mass.

As discussed above, the chassis 3102 is comprise of a high-density material (i.e., the first material). In this embodiment, the chassis 3102 comprises the first material with a density greater than 7.0 g/cc. The chassis 3102 comprises a heel portion 3124. The chassis 3102 comprises a toe portion 3126, opposite the heel portion 3124. The chassis 3102 comprises a rear 3128. The rear 3128 is adjacent the heel portion 3124 and the toe portion 3126. The chassis 3102 comprises a front 3130 formed by only the toe portion 3126 and the heel portion 3124 (entirely devoid of the central strut 132 as mentioned in some embodiments).

Further, the chassis 3102 comprises an upper surface 3134. The upper surface 3134 is adjacent the rear 3128, the front 3130, the toe portion 3126, and the heel portion 3124. The chassis 3102 comprises a lower surface 3136. The lower surface is opposite the upper surface 3134, and is adjacent the rear 3128, the front 3130, the toe portion 3126, and the heel portion 3124.

The chassis 3102 can be "U-shaped," horseshoe shaped, parabolically shaped, dumbbell shaped, or any other desired curved shape. In most embodiments, the chassis 3102 shape fosters the desirable shift of mass towards the peripheries (toe, heel, rear, front) of the chassis 3102 and the peripheries of the putter-type golf club head 3100.

The heel portion 3124, toe portion 3126, and rear 3128 form a flow region 3138. The flow region 3138 functions identically as the flow aperture 122, however is merely devoid of the central strut 3132. When the putter-type body 3104 is molded to the chassis 3102, the flow region 3138 allows the lightweight, low density material of the putter-type body 3104 to encapsulate the chassis 3102 such that the body 3104 extends through and completely fills the flow region 3138. The flow region 3138 allows the putter body 3104 to integrally interlock the body 3104 and the chassis 3102, to form the club head 3100. Furthermore, the flow region 3138 allows the lightweight, low density material of the putter-type body 3104 to flow in a direction perpendicular to the striking surface 3110 of the golf club head 3100. In some cases when the putter-type body 3104 is formed from a thermoplastic composite material with a fibrous filler, this allows the fibers to settle in a direction perpendicular to the striking surface 3110, increasing the strength and durability of the club head 3100. Further still, the flow region 3138 allows a thermoplastic composite material with a fibrous filler to closely surround the chassis 3102, with minimal porosity, thereby forming a solid and durable club head 3100.

The chassis 3102 comprises at least one interlocking feature 3120 protruding or extending from any one or combination of the following chassis 3102 features: the heel portion 3124, the toe portion 3126, the rear 3128, the front 3130, the upper surface 3134, and the lower surface 3136.

The at least one interlocking features 3120 function to further interlock and integrally join the chassis 3102 and the putter-type body 3104, by allowing a thermoplastic composite material with a fibrous filler (or other high strength lightweight material) to encase the entirety of the at least one interlocking feature 3120.

The chassis 3102 can comprise three interlocking features 3120. In some embodiments, the chassis 3102 can comprise two or more interlocking features 3120, three or more interlocking features 3120, four or more interlocking features, or more. In this embodiment, the three interlocking features 3120 can be in the form of an anchor. In this embodiment, wherein the two of the three interlocking features 3120 are in the form of an anchor and the third interlocking feature 3120 is in the form of an interlocking beam. An anchor aperture 3140 is formed between the each of the two interlocking features 3120 and the portion of the chassis 3102 (the heel portion 3124, the toe portion 3126, the rear 3128, the front 3130, the upper surface 3134, and the lower surface 3136) that which each of the two anchor interlocking features 3120 protrudes from. In this embodiment, the chassis 3102 comprises two anchor apertures 3140, one corresponding to each of the anchor interlocking features 3120. The anchor apertures 3140 and anchor interlocking features 3120, similar to the flow aperture 3122, allows the lightweight, low density material of the putter-type body 3104, to entirely fill the anchor apertures 3140 and encapsulate the interlocking features 3120, to integrally join the chassis 3102 and the putter-type body 3104.

In many embodiments, the anchor apertures 3140 of the two interlocking feature 3120 can be any one of the following shapes: circular, elliptical, triangular, rectangular, trapezoidal, octagonal, any polygonal shape, or any other desired geometric shape. In some embodiments, the at least one anchor interlocking features 3120 can comprise more than one anchor apertures 3140. In these embodiments, the more than one anchor apertures 3140 of the at least one interlocking features 3120 can be any one or combination of the following shapes: circular, elliptical, triangular, rectangular, trapezoidal, octagonal, any polygonal shape, or any other desired geometric shape. In this embodiments, referring to FIG. 28, the anchor apertures 3140 are approximately rectangular in shape.

Further, the third interlocking feature 3120 is in the form of an interlocking beam. In most embodiments (and this embodiment), the beam interlocking feature 3120 can extend from the chassis 3102 rear 3128 to the chassis 3102 front 3130. In some embodiment, the beam interlocking feature 3120, can extend, partially or entirely, from the rear 3128 to the toe portion 3126, from the toe portion 3126 to the heel portion 3124, from the front 3130 to the toe portion 3126, from the front 3130 to the heel portion 3126, or any other desired direction.

Furthermore, the beam interlocking feature 3120 comprises a series of through holes 3141, wherein the through holes 3141 extend through the beam interlocking feature 3120, in a direction from the toe portion 3126 to the heel portion 3124. In other embodiments, the through holes 3141 can extend though the beam interlocking feature in any one or combination of the following directions: from the rear 3128 to the toe portion 3126, from the toe portion 3126 to the heel portion 3124, from the front 3130 to the toe portion 3126, from the front 3130 to the heel portion 3126, or any other desired direction.

The series of through holes 3141 can comprise at least 2 through holes 3141, at least 3 through holes 3141, at least 4 through holes 3141, at least 5 through holes 3141, at least 6 through holes 3141, or at least 7 through holes 3141. Referring to FIG. 28, this embodiment, comprises at least 7 through holes 3141. Similar to the anchor apertures 3140, the through holes 3141 allow the lightweight, low density material of the putter-type body 3104, to entirely fill the through holes 3141 and encapsulate the beam interlocking feature 3120, to integrally join the chassis 3102 and the putter-type body 3104.

As aforementioned, the putter-type body 3104 comprises a low density second material. In most embodiments, the putter-type body 3104 comprises a thermoplastic composite material that comprises a thermoplastic polymer matrix material and a filler. In other embodiments, the putter-type body 3104 can comprise any other low density second material, wherein the other low density materials are not repeated herein for brevity. In this embodiment, the putter-type body 3104 comprises the second material with a density less than 4.0 g/cc. The chassis 3102 and the putter-type body 3104 are permanently joined without the use of welding, epoxies, or adhesives. The thermoplastic polymer matrix miller and filler of the putter-type body 3104, combined with the flow region 3138 and at least one interlocking feature 3120 of the chassis 3102, creates an integral putter 3100, without the use of welding, epoxies, or adhesives.

The putter-type body 3104 is integrally formed within and around the chassis 3102. As previously described the lightweight material of the putter-type body 3104 extends through and completely fill the chassis 3102 flow aperture 3122, interlocks the body 3104 and the chassis 3102, and forms the putter-type golf club head 3100. Further, in some embodiments, the putter-type body 3104 encases (or encapsulates) 100% of the chassis 3102. In this embodiment, the putter-type body 3104 encases at least 30% of the chassis 3102.

The putter-type body 3104, when combined with the chassis 3102, forms the golf club head 3100 toe end 3106, heel end 3108, rear portion 3112, and striking surface 3110. The putter-type body 3104 forms a portion of the crown 3115 and a portion of the sole 3117. In reference to FIGS. 26 and 27, when the putter-type body 3104 and chassis 3102 are joined, the chassis 3102 and putter-type body 3104 combine to form the putter 3100 crown 3115. Similarly, when the putter-type body 3104 and chassis 3102 are joined, the chassis 3102 and putter-type body 3104 combine to form the putter 3100 sole 3117.

The putter-type body 3104 can form 100% of the crown 3115, such that the chassis 3102 cannot be seen from an address position. In this embodiment however, the putter-type body 3104 forms at least 80% of the crown 3115. Similar to the crown 3115, the putter-type body 3104 can form 100% of the sole 3117, such that the chassis 3102 does not contact the ground plane, at an address position. In this embodiment however, the putter-type body 3104 forms at least 30% of the sole 3117, wherein a portion of the putter-type body 3104 and a portion of the chassis 3102 contacts the ground, at an address position.

Further, the putter-type body 3104 forms at least a portion of the golf club head 3100 alignment feature 3114. In some embodiments, the putter-type body 3104 forms the entirety of the alignment feature 3114. The alignment feature 3114 can be any one or combination of the following: a line, a series of lines, a circle, a dashed line, a triangle, a channel, a trough, a series of troughs, a channel, or any other desired shape for an alignment feature 3114. In most embodiments, the alignment feature 3114 is positioned on the crown 3115. Further, in most embodiments, the alignment feature 3114 is positioned equidistance from the heel end 2108 and the toe end 3106, perpendicular to the striking surface 3110, such that a golfer can utilize the alignment feature 3114 to accurately line up the putter 3100, to strike a golf ball at an address position.

In this embodiment, the alignment feature 3114 comprises a single line 3150 positioned on the crown. The single line 3150 is formed by the beam interlocking feature 3120. The toe end 3106, the heel end 3108, striking surface 3110, rear portion 3112, partially encase the beam interlocking feature 3150, to leave a single surface visible by the user, when the putter is at an address position. The chassis 3102 in this embodiment, is made of a polished stainless steel (silver in color), while the body 3104 is made of a dark thermoplastic composite (black in color). The chassis 3102 is reflective in appearance and has a distinct color contrast to the body 3104, allowing a golfer to easily align and center the putter 3100 with a golf ball. The distinctly colored line 3152 helps a golfer match the striking surface 3110 to the ball, leading to improvement in the alignment of the putter 3100.

Further, in this embodiment, the chassis 3102 comprises less than 60% of a total volume of the putter 3100, yet the chassis 3102 comprises at least 60% of an overall mass of the putter 3100. By creating a putter-type golf club head 3100 from a high-density chassis 3102 that is surrounded by a low-density putter-type body 3104, the weighting of the club head 3100 shifts towards the peripheries of the putter-type golf club head 3100, without any weight ports or attachments to the heel end 3108 and toe end 3106 of the putter-type golf club head 3100. This shift in weight, towards the peripheries of the putter-type golf club head 3100, raises the MOI of the club head 3100 about the y-axis (Iyy), therefore preventing the rotation of the club head 3100 at impact, about the y-axis, and assuring the striking surface 3110 is square to a golf ball during impact. The increase in MOI about the y-axis helps achieve a straighter ball path and improve the outcome of off-centered hits (impact at the heel end or toe end).

The exemplary club head 3100 was compared to a control club head (hereafter the "control"), wherein the control was a golf club head of identical shape and volume as the exemplary club head 3100. However, the control club head was made entirely from stainless steel and aluminum, whereas the exemplary club head 3100 was made from the first, high-density material (stainless steel), and the second, low-density material (TPC).

The exemplary club head 3100 comprises a mass of 331.9 grams, with a moment of inertia about the y axis of 3,923.22 g/cm$^2$. In comparison, the control club comprises a mass of 360.3 grams, with a moment of inertia about the y axis of 3,806.44 g/cm$^2$. The exemplary club head 3100 is nearly 30 grams lighter and comprises a 3.07% increase in moment of inertia. Thus, the exemplary club head 3100 is substantially lighter and yet comprises more forgiveness (higher MOI about the y-axis means the club head 3100 is less likely to rotate on off-center impacts, thus more consistently straight hits) than the control club.

High-Arching Blade-Style Putter Head Embodiment

In one embodiment, the putter-type golf club head 100 can be a high-arching (wherein more mass is near the toe than the heel) blade-style putter head 4100. Referring to FIGS. 29-32, the blade-style putter head 4100 comprises a chassis 4102 and a putter-type body 4104. The chassis 4102 is made from a first material having a first density and the putter-type body 4104 is made from a second material having a second density. The first density is greater than the second density. The chassis 4102 and the putter-type body 4104 combine to create a high-MOI putter head 4100 (5,000 g·cm$^2$-6,500 g·cm$^2$), while maintaining a desirable volume and mass.

As discussed above, the chassis 4102 is comprise of a high-density material (i.e., the first material). In this embodiment, the chassis 4102 comprises the first material with a density greater than 7.0 g/cc. The chassis 4102 comprises a heel portion 4124. The chassis 4102 comprises a toe portion 4126, opposite the heel portion 4124. The chassis 4102 comprises a rear 4128. The rear 4128 is adjacent the heel portion 4124 and the toe portion 4126. The chassis 4102 comprises a central strut 4132. The central strut 4132 spans from the heel portion 4124 to the toe portion 4126, opposite the rear 4128. The chassis 4102 comprises a front 4130. The front 4130 is formed by the toe portion 4126, the heel portion 4124, and the central strut 4132. The front 4130 is opposite the rear 4128, adjacent the heel portion 4124, and adjacent the toe portion 4126.

Further, the chassis 4102 comprises an upper surface 4134. The upper surface 4134 is adjacent the rear 4128, the front 4130, the toe portion 4126, and the heel portion 4124. The chassis 4102 comprises a lower surface 4136. The lower surface is opposite the upper surface 4134, and is adjacent the rear 4128, the front 4130, the toe portion 4126, and the heel portion 4124.

The chassis 4102 can be dumbbell shaped, "I-shaped," asymmetrical shaped, or any other desirable shape. In most embodiments, the dumbbell shaped chassis 4102 can be used for the blade style putter, wherein mass needs to only be moved toward the heel end 4108 and the toe end 4106, in order to increase the MOI.

The heel portion 4124, toe portion 4126, rear 4128, and central strut 4132 form a flow aperture 4122. When the putter-type body 4104 is molded to the chassis 4102, the flow aperture 4122 allows the lightweight, low density material of the putter-type body 4104 to encapsulate at least a portion of the chassis 4102 such that the body 4104 extends through and completely fills the flow aperture 4122. The flow aperture 4122 allows the putter body 4104 to integrally interlock the body 4104 and the chassis 4102, to form the club head 4100. Furthermore, the flow aperture 4122 allows the lightweight, low density material of the putter-type body 4104 to flow in a direction perpendicular to the striking surface 4110 of the golf club head 4100. In some cases when the putter-type body 4104 is formed from a thermoplastic composite material with a fibrous filler, this allows the fibers to settle in a direction perpendicular to the striking surface 4110, increasing the strength and durability of the club head 4100. Further still, the flow aperture 4122 allows a thermoplastic composite material with a fibrous filler to closely surround the chassis 4102, with minimal porosity, thereby forming a solid and durable club head 4100.

The chassis 4102 comprises at least one interlocking feature 4120 protruding or extending from any one or combination of the following chassis 4102 features: the heel portion 4124, the toe portion 4126, the rear 4128, the front 4130, the upper surface 4134, and the lower surface 4136. The at least one interlocking features 4120 function to further interlock and integrally join the chassis 4102 and the putter-type body 4104, by allowing a thermoplastic composite material with a fibrous filler (or other high strength lightweight material) to encase the entirety of the at least one interlocking feature 4120.

Figure 31:
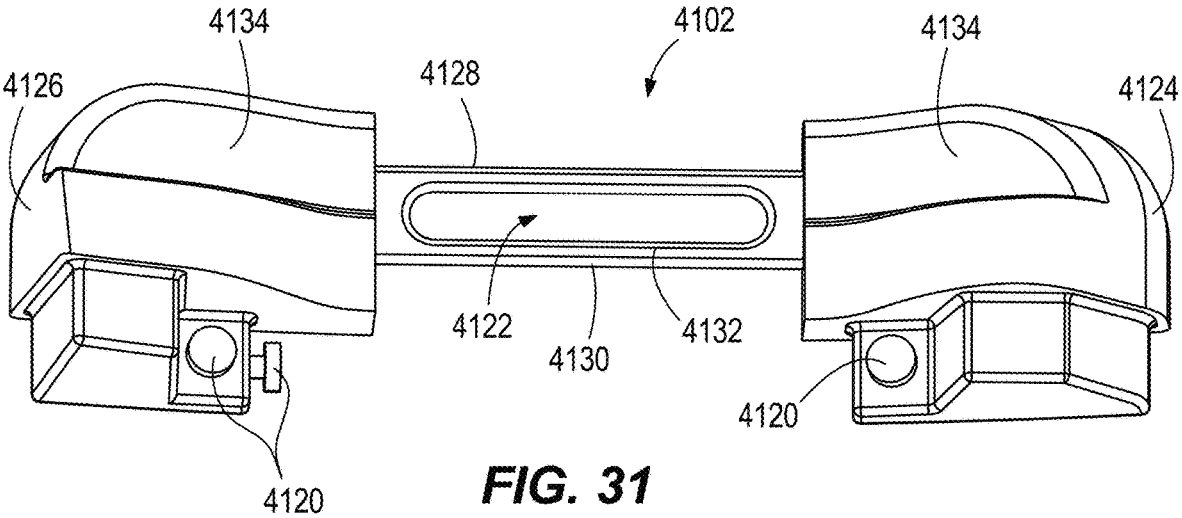
FIG. 31 illustrates a top view of the chassis of the putter-type golf club of FIG. 29.
Figure 32:
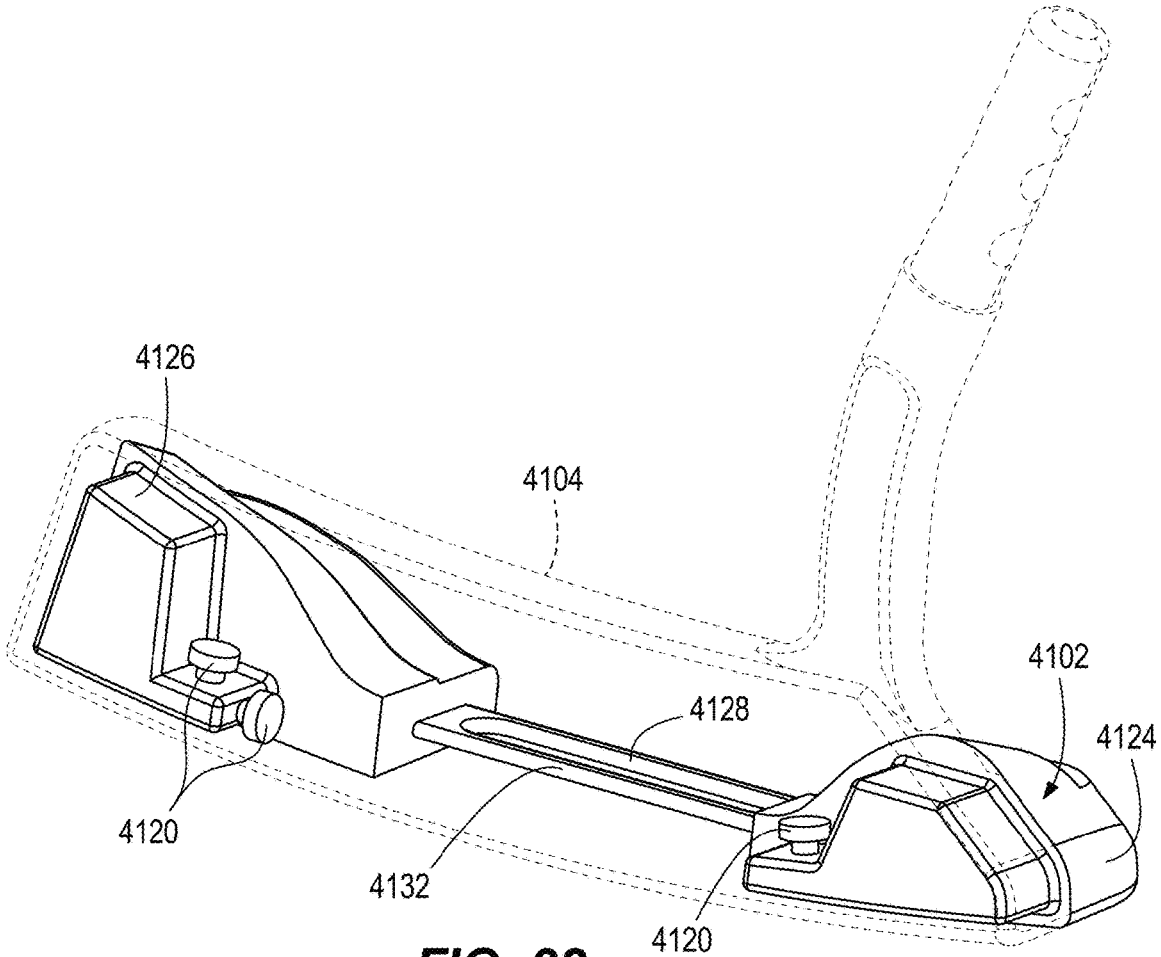
FIG. 32 illustrates a front perspective view of the combination of the putter-type body and chassis of the putter-type golf club of FIG. 29.
Figure 33:
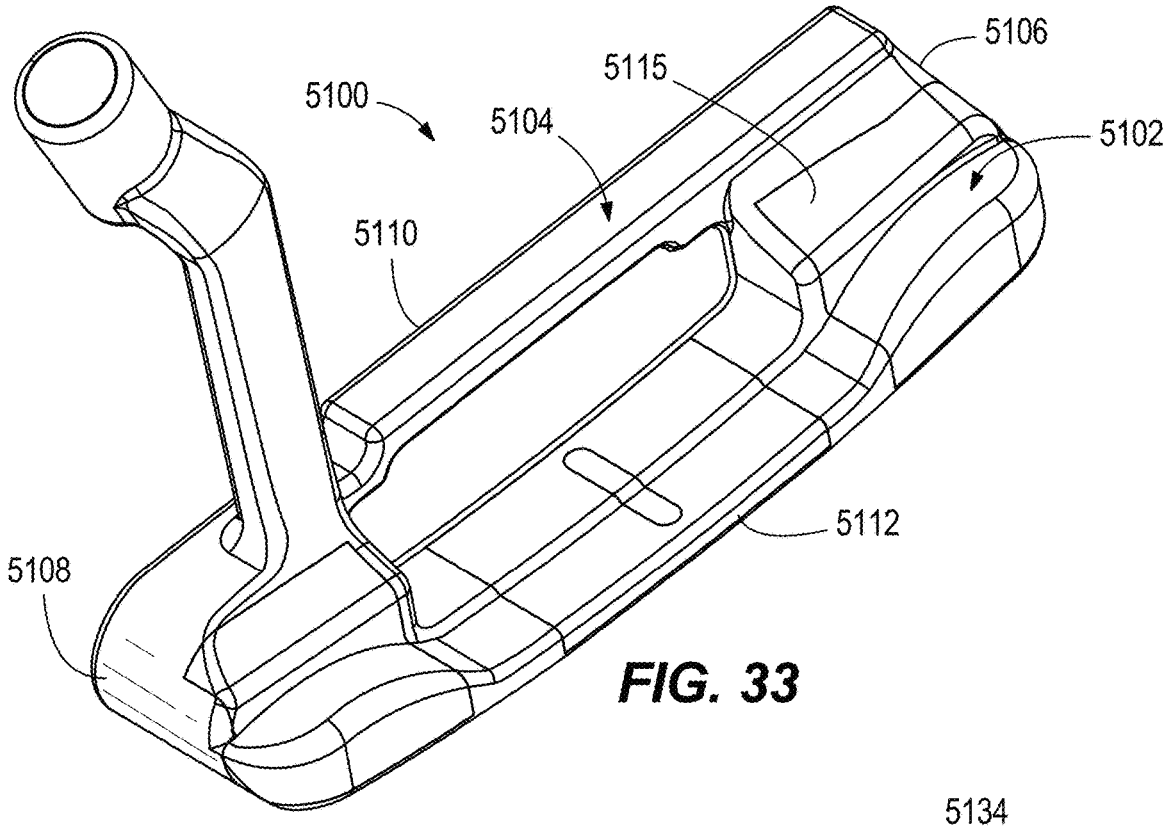
FIG. 33 illustrates a rear perspective view of another putter-type golf club.

Referring to FIGS. 31 and 32, the chassis 4102 can comprise three interlocking features 4120. In some embodiments, the chassis 4102 can comprise two or more interlocking features 4120, three or more interlocking features 4120, four or more interlocking features, or more. In this embodiment, wherein the three interlocking features 4120 are in the form of an interlocking hitch. In this embodiment, the hitch interlocking features 4120 protrude from the toe portion 4126 and the heel portion 4128. In this embodiment, one hitch interlocking feature 4120 extends away from the toe portion 4126, in a direction away from the lower surface 4136 of the chassis 4102. The second hitch interlocking feature 4120 extends away from the toe portion 4126, in a direction towards the heel portion 4128. The third hitch interlocking feature 4120 extends away from the heel portion 4128, in a direction towards the toe portion 4126. The hitch interlocking features 4120, similar to the flow aperture 4122, allows the lightweight, low density material of the putter-type body 4104, to encapsulate the interlocking features 4120, to integrally join the chassis 4102 and the putter-type body 4104.

As aforementioned, the putter-type body 4104 comprises a low density second material. In most embodiments, the putter-type body 4104 comprises a thermoplastic composite material that comprises a thermoplastic polymer matrix material and a filler. In other embodiments, the putter-type body 4104 can comprise any other low density second material, wherein the other low density materials are not repeated herein for brevity. In this embodiment, the putter-type body 4104 comprises the second material with a density less than 4.0 g/cc. The chassis 4102 and the putter-type body 4104 are permanently joined without the use of welding, epoxies, or adhesives. The thermoplastic polymer matrix miller and filler of the putter-type body 4104, combined with the flow aperture 4122 and at least one interlocking feature 4120 of the chassis 4102, creates an integral putter 4100, without the use of welding, epoxies, or adhesives.

The putter-type body 4104 is integrally formed within and around the chassis 4102. As previously described the lightweight material of the putter-type body 4104 extends through and completely fill the chassis 4102 flow aperture 4122, interlocks the body 4104 and the chassis 4102, and forms the putter-type golf club head 4100. Further, in some embodiments, the putter-type body 4104 encases (or encapsulates) 100% of the chassis 4102. In this embodiment, the putter-type body 4104 encases at least 30% of the chassis 4102.

The putter-type body 4104, when combined with the chassis 4102, forms the golf club head 4100 toe end 4106, heel end 4108, rear portion 4112, and striking surface 4110. The putter-type body 4104 forms a portion of the crown 4115 and a portion of the sole 4117. In reference to FIGS. 28 and 29, when the putter-type body 4104 and chassis 4102 are joined, the chassis 4102 and putter-type body 4104 combine to form the putter 4100 crown 4115. Similarly, when the putter-type body 4104 and chassis 4102 are joined, the chassis 4102 and putter-type body 4104 combine to form the putter 4100 sole 4117.

The putter-type body 4104 can form 100% of the crown 4115, such that the chassis 4102 cannot be seen from an address position. In this embodiment however, the putter-type body 4104 forms at least 40% of the crown 4115. Similar to the crown 4115, the putter-type body 4104 can form 100% of the sole 4117, such that the chassis 4102 does not contact the ground plane, at an address position. In this embodiment however, the putter-type body 4104 forms at least 30% of the sole 4117, wherein a portion of the putter-type body 4104 and a portion of the chassis 4102 contacts the ground, at an address position.

Further, the putter-type body 4104 forms at least a portion of the golf club head 4100 alignment feature 4114. In some embodiments, the putter-type body 4104 forms the entirety of the alignment feature 4114. The alignment feature 4114 can be any one or combination of the following: a line, a series of lines, a circle, a dashed line, a triangle, a channel, a trough, a series of troughs, a channel, or any other desired shape for an alignment feature 4114. In most embodiments, the alignment feature 4114 is positioned on the crown 4115. Further, in most embodiments, the alignment feature 4114 is positioned equidistance from the heel end 4108 and the toe end 4106, perpendicular to the striking surface 4110, such that a golfer can utilize the alignment feature 4114 to accurately line up the putter 4100, to strike a golf ball at an address position.

In this embodiment, the putter head 4100 is comprises a trough alignment feature 4114. The alignment feature 4114 is formed by the chassis 4102 toe portion 4126 and heel portion 4124. The toe portion 4126 slopes downward at an angle from the crown 4115 towards the sole 4117, as well as towards the heel portion 4128. Similarly, the heel portion 4124 slopes downward at an angle from the crown 4115 towards the sole 4117, as well as towards the toe portion 4126. These sloping portions 4126, 4124 form the trough alignment feature 4114.

The chassis 4102 in this embodiment, is made of a polished stainless steel (silver in color), while the body 4104 is made of a dark thermoplastic composite (black in color). The chassis 4102 is reflective in appearance and has a distinct color contrast to the body 4104, allowing a golfer to easily align and center the putter 4100 with a golf ball, by placing the golf ball between the bright heel portion 4124 and bright toe portion 4126. The distinctly colored alignment feature 4114 helps a golfer match the striking surface 4110 to the ball, leading to improvement in the alignment of the putter 4100.

Further, in this embodiment, the chassis 4102 comprises less than 70% of a total volume of the putter 4100, yet the chassis 4102 comprises at least 70% of an overall mass of the putter 4100. By creating a putter-type golf club head 4100 from a high-density chassis 4102 that is surrounded by a low-density putter-type body 4104, the weighting of the club head 4100 shifts towards the peripheries of the putter-type golf club head 4100, without any weight ports or attachments to the heel end 4108 and toe end 4106 of the putter-type golf club head 4100. This shift in weight, towards the peripheries of the putter-type golf club head 4100, raises the MOI of the club head 4100 about the y-axis (Iyy), therefore preventing the rotation of the club head 4100 at impact, about the y-axis, and assuring the striking surface 4110 is square to a golf ball during impact. The increase in MOI about the y-axis helps achieve a straighter ball path and improve the outcome of off-centered hits (impact at the heel end or toe end).

The exemplary club head 4100 was compared to a control club head (hereafter the "control"), wherein the control was a golf club head of identical shape and volume as the exemplary club head 4100. However, the control club head was made entirely from stainless steel, whereas the exemplary club head 4100 was made from the first, high-density material (tungsten or stainless steel), and the second, low-density material (TPC).

The exemplary club head 4100 comprises a mass of 346.90 grams, with a moment of inertia about the y axis of 5,741.92 g/cm$^2$. In comparison, the control club comprises a mass of 347.10 grams, with a moment of inertia about the y axis of 4,729.67 g/cm$^2$. The exemplary club head 4100 is nearly identical in weight to the control club and comprises a 21.40% increase in moment of inertia. Thus, the exemplary club head 4100 comprises more forgiveness (higher MOI about the y-axis means the club head 4100 is less likely to rotate on off-center impacts, thus more consistently straight hits) than the control club.

Non-Arching Blade-Style Putter Head Embodiment

In one embodiment, the putter-type golf club head 100 can be a slight-arcing or non-arcing (wherein mass is evenly distributed between the heel end and toe end) blade-style putter head 5100. Referring to FIGS. 33-36, the blade-style putter head 5100 comprises a chassis 5102 and a putter-type body 5104. The chassis 5102 is made from a first material having a first density and the putter-type body 5104 is made from a second material having a second density. The first density is greater than the second density. The chassis 5102 and the putter-type body 5104 combine to create a high-MOI putter head 5100 (5,000 $g \cdot cm^2$-6,500 $g \cdot cm^2$), while maintaining a desirable volume and mass.

As discussed above, the chassis 5102 is comprise of a high-density material (i.e., the first material). The chassis 5102 comprises a heel portion 5124. The chassis 5102 comprises a toe portion 5126, opposite the heel portion 5124. The chassis 5102 comprises a rear 5128. The rear 5128 is adjacent the heel portion 5124 and the toe portion 5126. The chassis 5102 comprises a central strut 5132. The central strut 5132 spans from the heel portion 5124 to the toe portion 5126, opposite the rear 5128. The chassis 5102 comprises a front 5130. The front 5130 is formed by the toe portion 5126, the heel portion 5124, and the central strut 5132. The front 5130 is opposite the rear 5128, adjacent the heel portion 5124, and adjacent the toe portion 5126.

Further, the chassis 5102 comprises an upper surface 5134. The upper surface 5134 is adjacent the rear 5128, the front 5130, the toe portion 5126, and the heel portion 5124. The chassis 5102 comprises a lower surface 5136. The lower surface is opposite the upper surface 5134, and is adjacent the rear 5128, the front 5130, the toe portion 5126, and the heel portion 5124.

The chassis 5102 can be dumbbell shaped, "I-shaped," asymmetrical shaped, or any other desirable shape. In most embodiments, the dumbbell shaped chassis 5102 can be used for the blade style putter, wherein mass needs to only be moved toward the heel end 5108 and the toe end 5106, in order to increase the MOI.

The heel portion 5124, toe portion 5126, rear 5128, and central strut 5132 form a flow aperture 5122. When the putter-type body 5104 is molded to the chassis 5102, the flow aperture 5122 allows the lightweight, low density material of the putter-type body 5104 to encapsulate at least a portion of the chassis 5102 such that the body 5104 extends through and completely fills the flow aperture 5122. The flow aperture 5122 allows the putter body 5104 to integrally interlock the body 5104 and the chassis 5102, to form the club head 5100. Furthermore, the flow aperture 5122 allows the lightweight, low density material of the putter-type body 5104 to flow in a direction perpendicular to the striking surface 5110 of the golf club head 5100. In some cases when the putter-type body 5104 is formed from a thermoplastic composite material with a fibrous filler, this allows the fibers to settle in a direction perpendicular to the striking surface 5110, increasing the strength and durability of the club head 5100. Further still, the flow aperture 5122 allows a thermoplastic composite material with a fibrous filler to closely surround the chassis 5102, with minimal porosity, thereby forming a solid and durable club head 5100.

The chassis 5102 comprises at least one interlocking feature 5120 protruding or extending from any one or combination of the following chassis 5102 features: the heel portion 5124, the toe portion 5126, the rear 5128, the front 5130, the upper surface 5134, and the lower surface 5136. The at least one interlocking features 5120 function to further interlock and integrally join the chassis 5102 and the putter-type body 5104, by allowing a thermoplastic composite material with a fibrous filler (or other high strength lightweight material) to encase the entirety of the at least one interlocking feature 5120.

Figure 34:
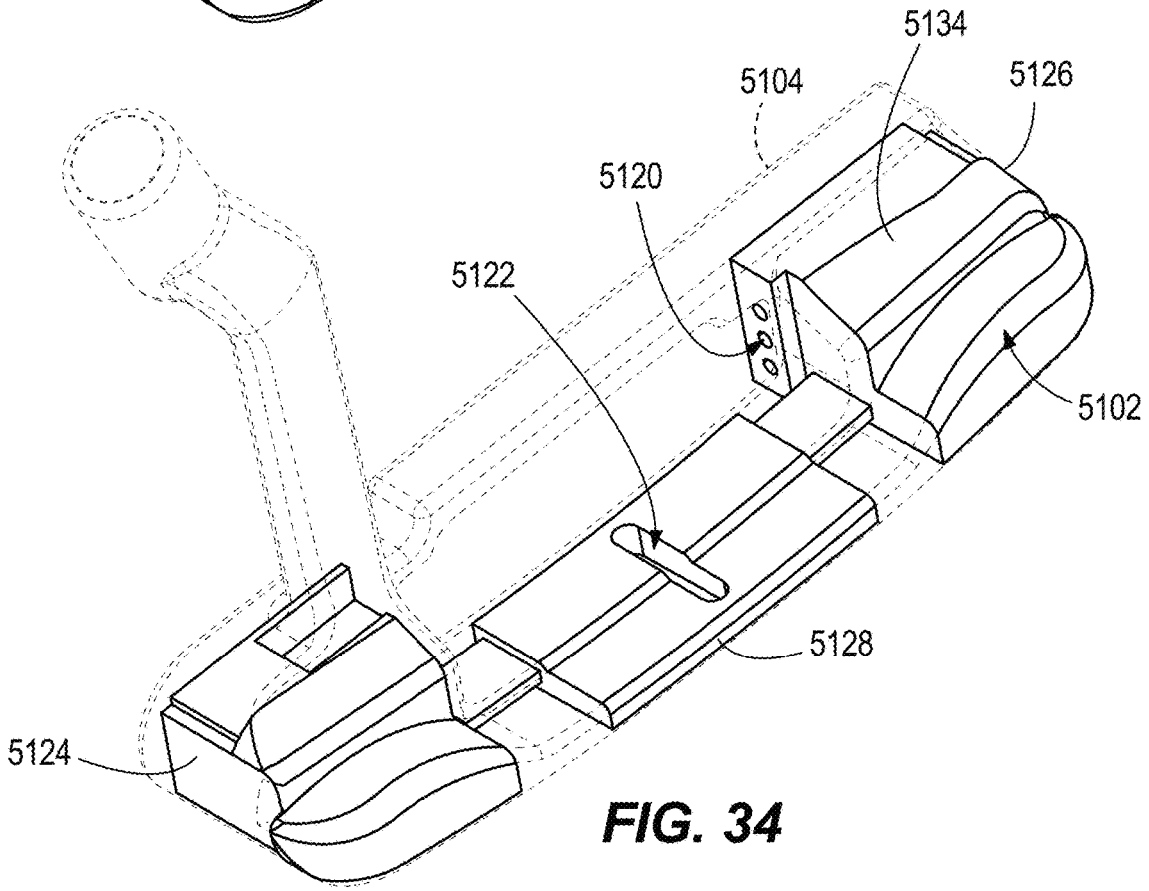
FIG. 34 illustrates a rear perspective view of the combination of a putter-type body and a chassis of the putter-type golf club of FIG. 33.
Figure 35:
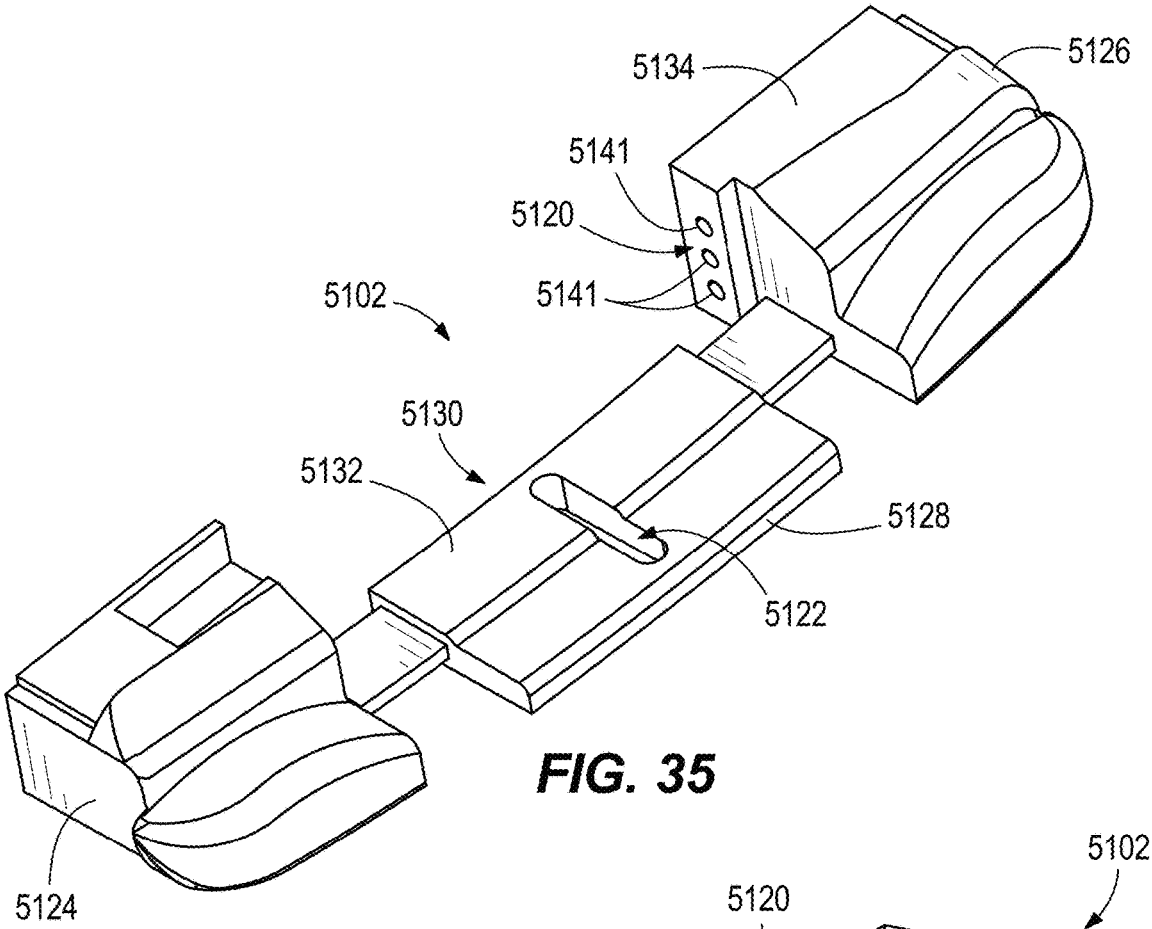
FIG. 35 illustrates rear perspective view of the chassis of the putter-type golf club of FIG. 33.
Figure 36:
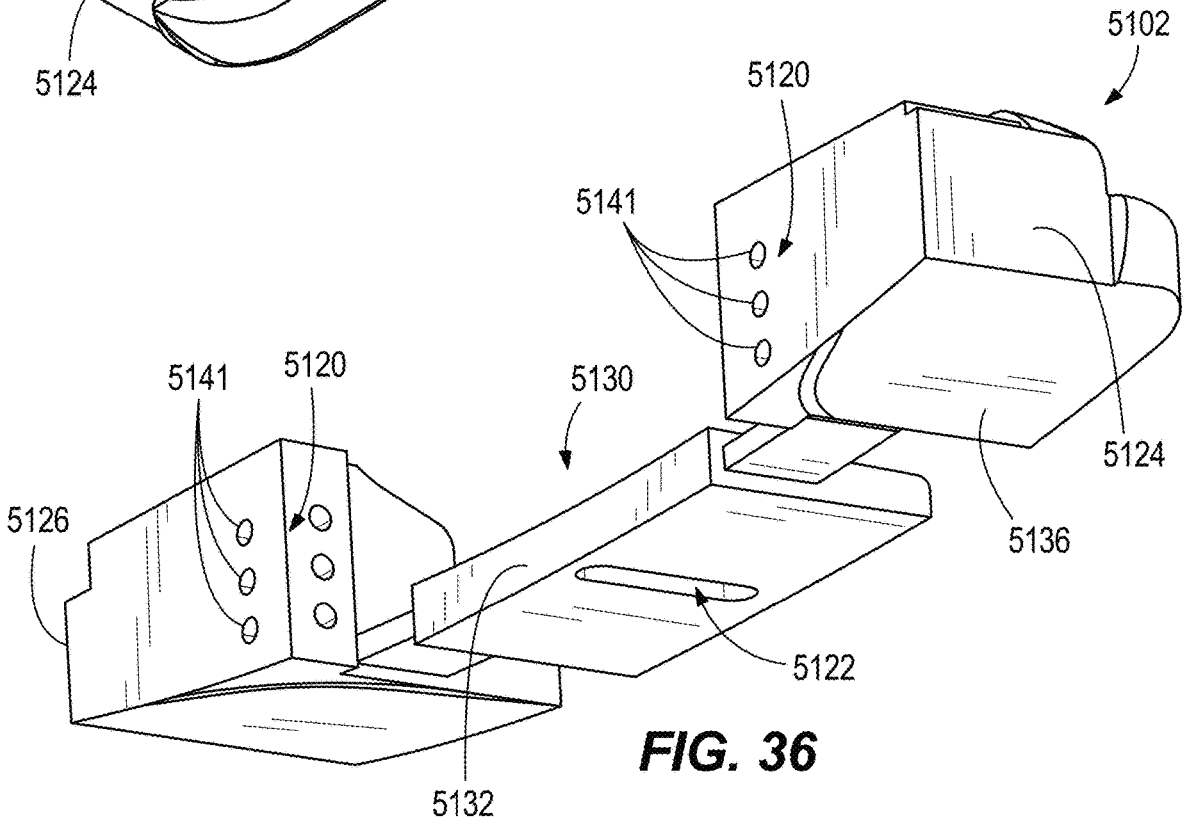
FIG. 36 illustrates a front perspective view of the chassis of the putter-type golf club of FIG. 33.
Figure 37:
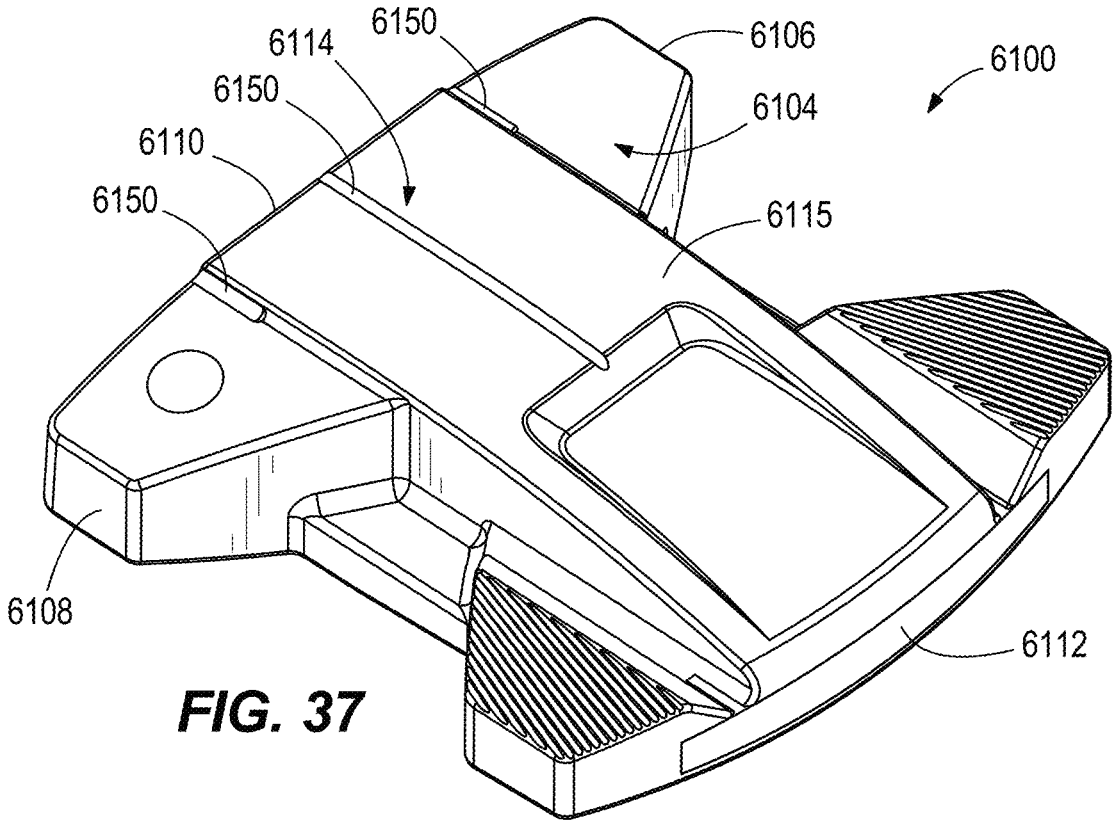
FIG. 37 illustrates a rear perspective view of another putter-type golf club.

Referring to FIGS. 34-36, the chassis 5102 can comprise two interlocking features 5120. In some embodiments, the chassis 5102 can comprise two or more interlocking features 5120, three or more interlocking features 5120, four or more interlocking features, or more. In this embodiment, wherein the two interlocking features 5120 are in the form of an interlocking a series of through holes. In this embodiment, the two interlocking features 5120 are in the form of a series of through holes that pass through the toe portion 5126 and the heel portion 5128. In this embodiment, one of the through hole interlocking features 5120 extends through the toe portion 5126 in a direction from the heel portion 5128, to the front 5130, forming in approximately 90 degree angle, through hole. In this embodiment, one of the through hole interlocking features 5120 extends through the heel portion 5128 in a direction from the toe portion 5126, to the front 5130, forming in approximately 90 degree angle through hole. In other embodiments, the through holes 5141 can extend though the interlocking feature in any one or combination of the following directions: from the rear 5128 to the toe portion 5126, from the toe portion 5126 to the heel portion 5124, from the front 5130 to the toe portion 5126, from the front 5130 to the heel portion 5126, or any other desired direction. The interlocking features 5120, similar to the flow aperture 5122, allows the lightweight, low density material of the putter-type body 5104, to encapsulate the interlocking features 5120, to integrally join the chassis 5102 and the putter-type body 5104.

As aforementioned, the putter-type body 5104 comprises a low density second material. In most embodiments, the putter-type body 5104 comprises a thermoplastic composite material that comprises a thermoplastic polymer matrix material and a filler. In other embodiments, the putter-type body 5104 can comprise any other low density second material, wherein the other low density materials are not repeated herein for brevity. In this embodiment, the putter-type body 5104 comprises the second material with a density less than 4.0 g/cc. The chassis 5102 and the putter-type body 5104 are permanently joined without the use of welding, epoxies, or adhesives. The thermoplastic polymer matrix miller and filler of the putter-type body 5104, combined with the flow aperture 5122 and at least one interlocking feature 5120 of the chassis 5102, creates an integral putter 5100, without the use of welding, epoxies, or adhesives.

The putter-type body 5104 is integrally formed within and around the chassis 5102. As previously described the lightweight material of the putter-type body 5104 extends through and completely fill the chassis 5102 flow aperture 5122, interlocks the body 5104 and the chassis 5102, and forms the putter-type golf club head 5100. Further, in some embodiments, the putter-type body 5104 encases (or encapsulates) 100% of the chassis 5102. In this embodiment, the putter-type body 5104 encases at least 30% of the chassis 5102.

The putter-type body 5104, when combined with the chassis 5102, forms the golf club head 5100 toe end 5106, heel end 5108, rear portion 5112, and striking surface 5110. The putter-type body 5104 forms a portion of the crown 5115 and a portion of the sole 5117. In reference to FIGS. 33 and 34, when the putter-type body 5104 and chassis 5102 are joined, the chassis 5102 and putter-type body 5104 combine to form the putter 5100 crown 5115. Similarly, when the putter-type body 5104 and chassis 5102 are joined, the chassis 5102 and putter-type body 5104 combine to form the putter 5100 sole 5117.

The putter-type body 5104 can form 100% of the crown 5115, such that the chassis 5102 cannot be seen from an address position. In this embodiment however, the putter-type body 5104 forms at least 40% of the crown 5115. Similar to the crown 5115, the putter-type body 5104 can form 100% of the sole 5117, such that the chassis 5102 does not contact the ground plane, at an address position. In this embodiment however, the putter-type body 5104 forms at least 30% of the sole 5117, wherein a portion of the putter-type body 5104 and a portion of the chassis 5102 contacts the ground, at an address position.

Further, the putter-type body 5104 forms at least a portion of the golf club head 5100 alignment feature 5114. In some embodiments, the putter-type body 5104 forms the entirety of the alignment feature 5114. The alignment feature 5114 can be any one or combination of the following: a line, a series of lines, a circle, a dashed line, a triangle, a channel, a trough, a series of troughs, a channel, or any other desired shape for an alignment feature 5114. In most embodiments, the alignment feature 5114 is positioned on the crown 5115. Further, in most embodiments, the alignment feature 5114 is positioned equidistance from the heel end 4108 and the toe end 5106, perpendicular to the striking surface 5110, such that a golfer can utilize the alignment feature 5114 to accurately line up the putter 5100, to strike a golf ball at an address position.

In this embodiment, the putter head 5100 is comprises a line alignment feature 5114. The alignment feature 5114 is in between the chassis 5102 toe portion 5126 and heel portion 5128. The single line alignment feature 5114 is formed by the body 5104 filling the flow aperture 5122. The flow aperture 5122 provides a central line on the crown 5115, while allowing the chassis 5102 and body 5104 to integrally and permanently join. The chassis 5102 in this embodiment, is made of a polished stainless steel (silver in color), while the body 5104 is made of a dark thermoplastic composite (black in color). The chassis 5102 is reflective in appearance and has a distinct color contrast to the body 5104, allowing a golfer to easily align and center the putter 5100 with a golf ball. The distinctly colored line 5152 helps a golfer match the striking surface 5110 to the ball, leading to improvement in the alignment of the putter 5100.

The chassis 5102 in this embodiment, is made of a polished stainless steel (silver in color), while the body 5104 is made of a dark thermoplastic composite (black in color). The chassis 5102 is reflective in appearance and has a distinct color contrast to the body 5104, allowing a golfer to easily align and center the putter 5100 with a golf ball, by placing the golf ball between the bright heel portion 5128 and bright toe portion 5126. The distinctly colored alignment feature 5114 helps a golfer match the striking surface 5110 to the ball, leading to improvement in the alignment of the putter 5100.

Further, in this embodiment, the chassis 5102 comprises less than 70% of a total volume of the putter 5100, yet the chassis 5102 comprises at least 70% of an overall mass of the putter 5100. By creating a putter-type golf club head 5100 from a high-density chassis 5102 that is surrounded by a low-density putter-type body 5104, the weighting of the club head 5100 shifts towards the peripheries of the putter-type golf club head 5100, without any weight ports or attachments to the heel end 5108 and toe end 5106 of the putter-type golf club head 4100. This shift in weight, towards the peripheries of the putter-type golf club head 5100, raises the MOI of the club head 5100 about the y-axis (Iyy), therefore preventing the rotation of the club head 5100 at impact, about the y-axis, and assuring the striking surface 5110 is square to a golf ball during impact. The increase in MOI about the y-axis helps achieve a straighter ball path and improve the outcome of off-centered hits (impact at the heel end or toe end).

The exemplary club head 5100 was compared to a control club head (hereafter the "control"), wherein the control was a golf club head of identical shape and volume as the exemplary club head 5100. However, the control club head was made entirely from stainless steel, whereas the exemplary club head 5100 was made from the first, high-density material (stainless steel or tungsten), and the second, low-density material (TPC).

The exemplary club head 5100 comprises a mass of 348.4 grams, with a moment of inertia about the y axis of 5,329.02 $g/cm^2$. In comparison, the control club comprises a mass of 348.4 grams, with a moment of inertia about the y axis of 4,692.25 $g/cm^2$. The exemplary club head 5100 is identical in weight to the control club and comprises a 13.57% increase in moment of inertia. Thus, the exemplary club head 5100 comprises more forgiveness (higher MOI about the y-axis means the club head 5100 is less likely to rotate on off-center impacts, thus more consistently straight hits) than the control club.

Large Mallet Putter Head Embodiment

In one embodiment, the putter-type golf club head 100 can be a large mallet putter head 6100. Referring to FIGS. 37-41, the putter head 6100 comprises a chassis 6102 and a putter-type body 6104. The chassis 6102 is made from a first material having a first density and the putter-type body 6104 is made from a second material having a second density. The chassis 6102 comprises one or more weights 6142, wherein the one or more weights 6142, are affixed to the chassis, and made of a third material having a third density. The first density is greater than the second density. The third density is greater than the first density. The chassis 6102 and the putter-type body 6104 combine to create a heavy weight (365 grams-380 grams), extremely high MOI putter head 2100 (5,500 $g \cdot cm^2$-7,000 $g \cdot cm^2$), while maintaining a desirable volume and mass.

As discussed above, the chassis 6102 is comprise of a high-density material (i.e., the first material). The chassis 6102 comprises a heel portion 6124. The chassis 6102 comprises a toe portion 6126, opposite the heel portion 6124. The chassis 6102 comprises a rear 6128. The rear 6128 is adjacent the heel portion 6124 and the toe portion 6126. The chassis 6102 comprises a central strut 6132. The central strut 6132 spans from the heel portion 6124 to the toe portion 6126, opposite the rear 6128. The chassis 6102 comprises a front 6130. The front 6130 is formed by the toe portion 6126, the heel portion 6124, and the central strut 6132. The front 6130 is opposite the rear 6128, adjacent the heel portion 6124, and adjacent the toe portion 6126.

Further, the chassis 6102 comprises an upper surface 6134. The upper surface 6134 is adjacent the rear 6128, the front 6130, the toe portion 6126, and the heel portion 6124. The chassis 6102 comprises a lower surface 6136. The lower surface is opposite the upper surface 6134, and is adjacent the rear 6128, the front 6130, the toe portion 6126, and the heel portion 6124.

In many embodiments, the chassis 6102 can be polygonal, hourglass shaped, symmetrical, or any other desirable chassis 6102 shape. In most embodiments, the chassis 6102 shape fosters the desirable shift of mass towards the peripheries (toe, heel, rear, front) of the chassis 6102 and the peripheries of the putter-type golf club head 6100. In this embodiment, the chassis 6102 is hourglass shaped.

The chassis 6102 further comprises one or more weights 6142. The one or more weights 6142 comprise the third density greater than the density of the chassis 6102 (and thus the body 6104), in order to further alter the mass properties of the putter (i.e., CG, MOI, balance). In this embodiment, the one or more weights 6142 comprises the third density of at least 12 g/cc. The one or more weights 6142 function to customize the center of gravity of the putter, while maintaining and/or increasing the MOI of the putter head 6100. The one or more weights 6142 can be attached to the chassis 6102, prior to the molding of the putter-type body 6104, through any of the following attachment methods: welding, soldering, brazing, swedging, adhesion, epoxy, mechanical fastening, adhesion with epoxy, polyurethanes, resins, hot melts, or any other attachment method.

The chassis 6102, in some embodiments, can comprise one or more weights 6142. In many embodiments, the chassis 6102 can comprise one weight 6142, two weights 6142, three weights 6142, four weights 6142, five weights 6142, six weights 6142, or more. In some embodiments, the chassis 6102 can comprise two or more weights 6142, three or more weights 6142, or four or more weights 6142. In this embodiment, the chassis 6102 comprises exactly 4 weights 6142.

In many embodiments, the one or more weights 6142 can comprise any one or combination of the following shapes: circular, elliptical, triangular, rectangular, cylindrical, rectangular prismed, trapezoidal, octagonal, or any other polygonal shape or shape with at least one curved surface. In this embodiment, the four weights 6142 are cylindrical in shape.

Further, each of the four weights 6142, are positioned at a junction of the four peripheries (toe portion 6126, heel portion 6124, rear portion 6128, and front 6130) of the chassis 6102. In this embodiment, one weight 6142 is positioned at the junction of the toe portion 6126 and the front 6130, one weight 6142 is positioned at the junction of the toe portion 6126 and the rear portion 6128, one weight 6142 is positioned at the junction of the heel portion 6124 and the front 6130, and one weight 6142 is positioned at the junction of the heel portion 6124 and the rear portion 6128.

Furthermore, in most embodiments, the light-weight material of the putter-type body 6104 encases at least one a portion of the one or more weights 6142. In some embodiments, the light-weight material of the putter-type body can surround at least 10% of the one or more weights 6142, at least 20% of the one or more weights 6142, at least 30% of the one or more weights 6142, at least 40% of the one or more weights 6142, at least 50% of the one or more weights 6142, at least 60% of the one or more weights 6142, at least 70% of the one or more weights 6142, at least 80% of the one or more weights 6142, at least 90% of the one or more weights 6142, or 100% of the one or more weights 6142. In this embodiment, the light-weight material of the putter-type body 6104, surrounds at least 80% of the four weights 6142.

The heel portion 6124, toe portion 6126, rear 6128, and central strut 6132 form a flow aperture 6122. When the putter-type body 6104 is molded to the chassis 6102, the flow aperture 6122 allows the lightweight, low density material of the putter-type body 6104 to encapsulate at least a portion of the chassis 6102 such that the body 6104 extends through and completely fills the flow aperture 6122. The flow aperture 6122 allows the putter body 6104 to integrally interlock the body 6104 and the chassis 6102, to form the club head 6100. Furthermore, the flow aperture 6122 allows the lightweight, low density material of the putter-type body 6104 to flow in a direction perpendicular to the striking surface 6110 of the golf club head 6100. In some cases when the putter-type body 6104 is formed from a thermoplastic composite material with a fibrous filler, this allows the fibers to settle in a direction perpendicular to the striking surface 6110, increasing the strength and durability of the club head 6100. Further still, the flow aperture 6122 allows a thermoplastic composite material with a fibrous filler to closely surround the chassis 6102, with minimal porosity, thereby forming a solid and durable club head 6100.

The chassis 6102 comprises at least one interlocking feature 6120 protruding or extending from any one or combination of the following chassis 6102 features: the heel portion 6124, the toe portion 6126, the rear 6128, the front 6130, the upper surface 6134, and the lower surface 6136. The at least one interlocking features 6120 function to further interlock and integrally join the chassis 6102 and the putter-type body 6104, by allowing a thermoplastic composite material with a fibrous filler (or other high strength lightweight material) to encase the entirety of the at least one interlocking feature 6120.

Figure 38:
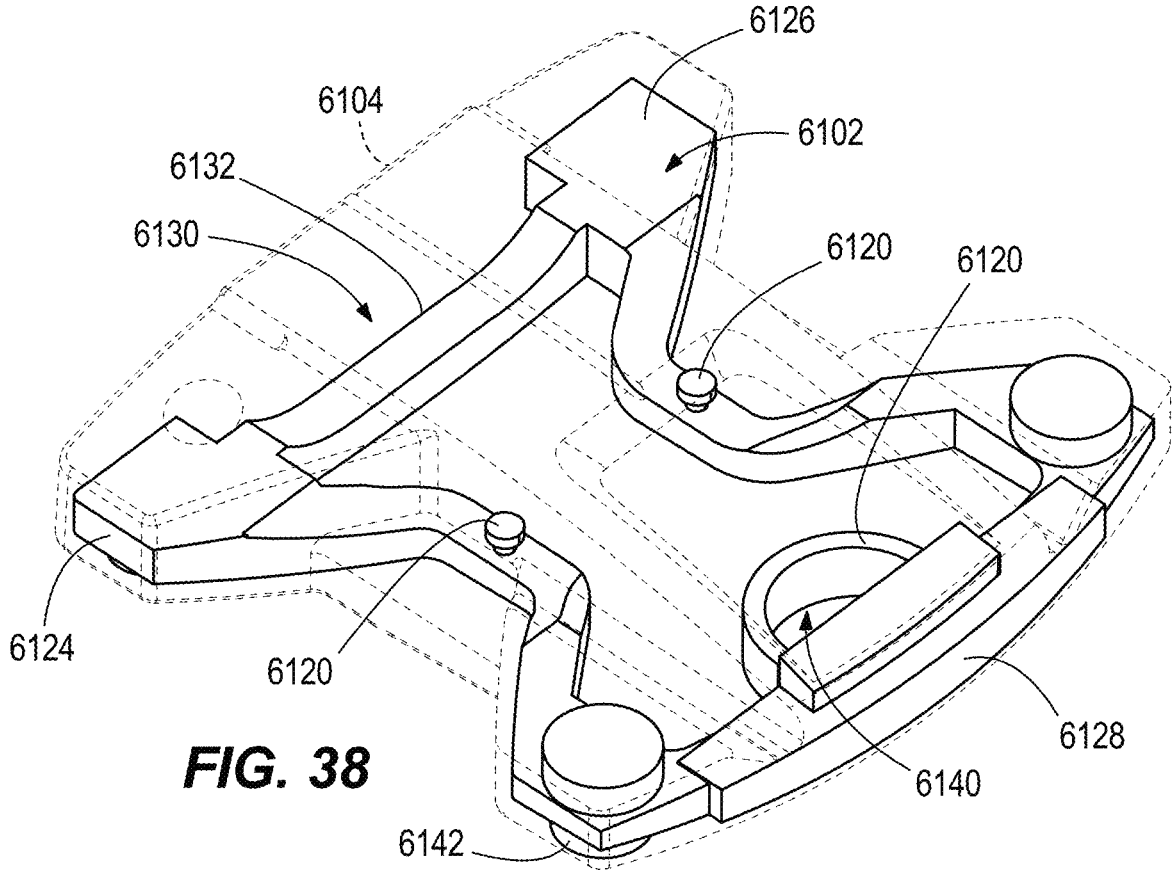
FIG. 38 illustrates a rear perspective view of the combination of a putter-type body and a chassis of the putter-type golf club of FIG. 37.
Figure 39:
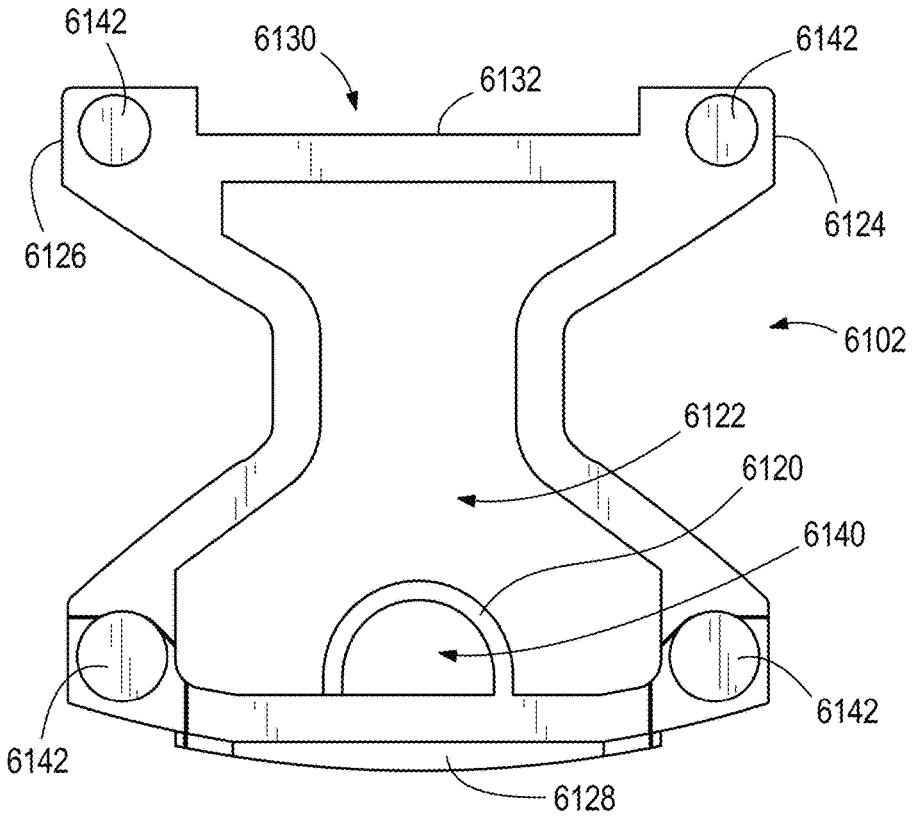
FIG. 39 illustrates a bottom view of the chassis of the putter-type golf club of FIG. 37.
Figure 40:
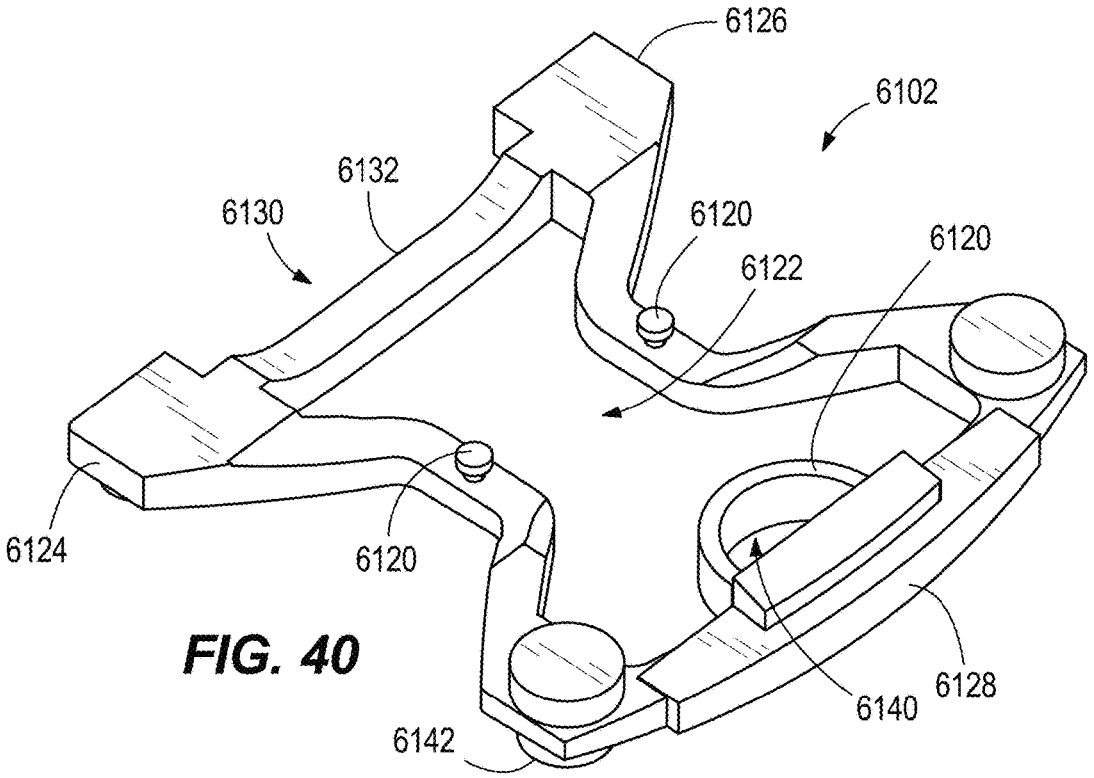
FIG. 40 illustrates rear perspective view of the chassis of the putter-type golf club of FIG. 37.

Referring to FIGS. 38-40, the chassis 6102 can comprise three interlocking features 6120. In some embodiments, the chassis 6102 can comprise two or more interlocking features 6120, three or more interlocking features 6120, four or more interlocking features, or more. In this embodiment, wherein two interlocking features 6120, of the three, are in the form of a hitch, while one interlocking feature 6120 is in the form of a hitch. In this embodiment, the two hitch interlocking features 6120, extend away from the upper surface 6134, in a direction away from the lower surface 6136. Further, in this embodiment, one of the hitch interlocking features 6120 is positioned on the toe portion 6126, while the other hitch interlocking feature 6120 is positioned on the heel portion 6124. The interlocking features 6120, similar to the flow aperture 6122, allows the lightweight, low density material of the putter-type body 6104, to encapsulate the interlocking features 6120, to integrally join the chassis 6102 and the putter-type body 6104.

Further still, the anchor interlocking feature 6120, extends away from the rear portion 6128, towards the front 6130, and is positioned within a portion of the flow aperture 6122. In this embodiment, wherein one of the three interlocking features 6120 is in the form of an anchor, an anchor aperture 6140 is formed between the rear 6128 and the anchor interlocking feature 6120. In this embodiment, the chassis 6102 comprises one anchor aperture 6140, one corresponding to the interlocking feature 6120 in the form of an anchor. The anchor apertures 6140 and interlocking feature 6120, similar to the flow aperture 6122, allows the lightweight, low density material of the putter-type body 6104, to entirely fill the anchor apertures 6140 and encapsulate the interlocking features 6120, to integrally join the chassis 6102 and the putter-type body 6104.

In many embodiments, the anchor apertures 6140 of the anchor interlocking feature 6120 can be any one of the following shapes: semi-circular, circular, elliptical, triangular, rectangular, trapezoidal, octagonal, any polygonal shape, or any other desired geometric shape. In some embodiments, the at least one anchor interlocking features 6120 can comprise more than one anchor apertures 6140. In these embodiments, the more than one anchor apertures 6140 of the at least one interlocking features 6120 can be any one or combination of the following shapes: circular, elliptical, triangular, rectangular, trapezoidal, octagonal, any polygonal shape, or any other desired geometric shape. In this embodiments, referring to FIGS. 39 and 40, the anchor aperture 6140 is semi-circular in shape.

Further, the putter-type golf club head 6100 can comprise a strike face insert 6116, positioned on or within the striking surface 6110. In these embodiments, the strike face insert 6116 is independently formed prior to being coupled to the club head 6100. The side of the strike face insert 6116 that will contact the club head 6100 can comprise a geometry complementary to the geometry of the corresponding portion (i.e., a cavity in the striking surface of the putter-type golf club head) of the club head 6100 that will contact the striking surface 6110. In this embodiment, the putter head 6100, can comprises the chassis 6102, of the first material, the putter-type body 6104, of the second material, and the strike face insert 6116, comprising the third material.

The strike face insert 6116 can be secured to the club head 6100 by a fastening means. In this embodiment, the strike face insert 6116 is secured to the putter-type body 6104. In this embodiments, in reference to FIG. 41, the putter-type body 6104 can comprise an insert cavity 6118, wherein the cavity 6118 functions to receive the strike face insert 6116. The strike face insert 6116 can be secured by an adhesive such as glue, very high bond (VHB™) tape, epoxy or another adhesive. Alternately or additionally, the strike face insert 6116 can be secured by welding, soldering, screws, rivets, pins, mechanical interlock structure, or another fastening method.

As aforementioned, the putter-type body 6104 comprises a low density second material. In most embodiments, the putter-type body 6104 comprises a thermoplastic composite material that comprises a thermoplastic polymer matrix material and a filler. In other embodiments, the putter-type body 6104 can comprise any other low density second material, wherein the other low density materials are not repeated herein for brevity. In this embodiment, the putter-type body 6104 comprises the second material with a density less than 4.0 g/cc. The chassis 6102 and the putter-type body 6104 are permanently joined without the use of welding, epoxies, or adhesives. The thermoplastic polymer matrix miller and filler of the putter-type body 6104, combined with the flow region 6138 and at least one interlocking feature 6120 of the chassis 6102, creates an integral putter 6100, without the use of welding, epoxies, or adhesives.

The putter-type body 6104 is integrally formed within and around the chassis 6102. As previously described the lightweight material of the putter-type body 6104 extends through and completely fill the chassis 6102 flow aperture 6122, interlocks the body 6104 and the chassis 6102, and forms the putter-type golf club head 6100. Further, in some embodiments, the putter-type body 6104 encases (or encapsulates) 100% of the chassis 6102. In this embodiment, the putter-type body 6104 encases at least 80% of the chassis 6102.

The putter-type body 6104, when combined with the chassis 6102, forms the golf club head 6100 toe end 6106, heel end 6108, rear portion 6112, and striking surface 6110. The putter-type body 6104 forms a portion of the crown 6115 and a portion of the sole 6117. In reference to FIGS. __, when the putter-type body 6104 and chassis 6102 are joined, the chassis 6102 and putter-type body 6104 combine to form the putter 6100 crown 6115. Similarly, when the putter-type body 6104 and chassis 6102 are joined, the chassis 6102 and putter-type body 6104 combine to form the putter 6100 sole 6117.

The putter-type body 6104 can form 100% of the crown 6115, such that the chassis 6102 cannot be seen from an address position. In this embodiment, the putter-type body 6104 forms 100% of the crown 6115. Similar to the crown 6115, the putter-type body 6104 can form 100% of the sole 6117, such that the chassis 6102 does not contact the ground plane, at an address position. In this embodiment however, the putter-type body 6104 forms at least 80% of the sole 6117, wherein a portion of the putter-type body 6104 and a portion of the chassis 6102 contacts the ground, at an address position.

Further, the putter-type body 6104 forms at least a portion of the golf club head 6100 alignment feature 6114. In some embodiments, the putter-type body 6104 forms the entirety of the alignment feature 6114. The alignment feature 6114 can be any one or combination of the following: a line, a series of lines, a circle, a dashed line, a triangle, a channel, a trough, a series of troughs, a channel, or any other desired shape for an alignment feature 6114. In most embodiments, the alignment feature 6114 is positioned on the crown 6115. Further, in most embodiments, the alignment feature 6114 is positioned equidistance from the heel end 6108 and the toe end 6106, perpendicular to the striking surface 6110, such that a golfer can utilize the alignment feature 6114 to accurately line up the putter 6100, to strike a golf ball at an address position.

In this embodiment, the alignment feature 6114 comprises three lines 6150 positioned on the crown 6115. The three lines 6150 are equally spaced apart, wherein one line 6150 is nearer the toe 6106, one line is equidistant from the toe 6106, and one line is nearer the heel 6108. The three lines 6150 help a golfer match the striking surface 6110 to the ball, with two alignment lines 6150 on each end, and one centrally located, leading to improvement in the alignment of the putter, in combination with a traditional alignment feature (i.e., only one line, one circle, or one arrow).

Further, in this embodiment, the chassis 6102 comprises less than 45% of a total volume of the putter 6100, yet the chassis 6102 comprises at least 60% of an overall mass of the putter 6100. By creating a putter-type golf club head 6100 from a high-density chassis 6102 that is surrounded by a low-density putter-type body 6104, the weighting of the club head 6100 shifts towards the peripheries of the putter-type golf club head 6100, without any weight ports or attachments to the heel end 6108 and toe end 6106 of the putter-type golf club head 6100. This shift in weight, towards the peripheries of the putter-type golf club head 6100, raises the MOI of the club head 6100 about the y-axis (Iyy), therefore preventing the rotation of the club head 6100 at impact, about the y-axis, and assuring the striking surface 6110 is square to a golf ball during impact. The increase in MOI about the y-axis helps achieve a straighter ball path and improve the outcome of off-centered hits (impact at the heel end or toe end).

The exemplary club head 6100 was compared to a control club head (hereafter the "control"), wherein the control was a golf club head of identical shape and volume as the exemplary club head 6100. However, the control club head was made entirely from metallic materials (stainless steel and aluminum), whereas the exemplary club head 6100 was made from the first, high-density material (tungsten weights and stainless steel chassis), and the second, low-density material (TPC).

The exemplary club head 6100 comprises a mass of 380.00 grams, with a moment of inertia about the y axis of 6,496.76 g/cm$^2$. In comparison, the control club comprises a mass of 381.00 grams, with a moment of inertia about the y axis of 6,399.98 g/cm$^2$. The exemplary club head 6100 is one gram lighter and comprises a 1.51% increase in moment of inertia. Thus, the exemplary club head 6100 comprises more forgiveness (higher MOI about the y-axis means the club head 6100 is less likely to rotate on off-center impacts, thus more consistently straight hits) than the control club.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A putter-type golf club head comprising:

a toe end, a heel end, a striking surface, a rear portion, a sole, and a crown;

wherein the heel end is opposite the toe end;

wherein the striking surface is adjacent to the toe end and the heel end;

wherein the rear portion is opposite the striking surface and adjacent to the toe end and the heel end;

wherein the sole spans from the heel end to the toe end, and from the striking surface to the rear portion;

wherein the sole is positioned in a ground plane when the putter-type golf club head is at an address position; and wherein the crown is opposite the sole, and spans from the heel end to the toe end, and from the striking surface to the rear portion;

a chassis having a U-shape from a top view occupying portions of the toe end, the heel end, and the rear portion and forming a striking surface heel end and a striking surface toe end;

wherein the chassis comprises a first material comprising a first density of at least 7 g/cm$^3$;

a body comprising a second material comprising a second density of 4 g/cm$^3$ or less;

wherein the first material and the second material combine to form an entirety of the striking surface;

the chassis further comprises:

a heel portion, a toe portion, a rear, a front, an upper surface, and a lower surface;

wherein the heel portion is opposite the toe portion and adjacent to the rear;

wherein the upper surface is opposite the lower surface;

wherein the front is adjacent to the toe portion and the heel portion, and opposite the rear;

an interior wall extending from the upper surface to the lower surface;

wherein the heel portion, the toe portion, and the rear form a flow region comprising a void bounded by the interior wall of the chassis and extending from the upper surface to the lower surface;

a first interlocking feature extending from the interior wall proximate the heel portion and into the flow region, forming a first anchor aperture having a semi-circular shape;

a second interlocking feature extending from the interior wall proximate the rear and into the flow region, forming a second anchor aperture having a semi-circular shape;

a third interlocking feature extending from the interior wall proximate the toe portion and into the flow region, forming a third anchor aperture having a semi-circular shape;

wherein the body encases an entirety of the first interlocking feature, the second interlocking feature, and the third interlocking feature;

wherein the chassis comprises less than 50% of a total volume of the putter-type golf club head;

wherein the chassis comprises between 50% to 55% of an overall mass of the putter-type golf club head; and wherein the body abuts the interior wall such that the body extends through and continuously fills the flow region from the crown to the sole, to interlock the body and chassis, and to form the putter-type golf club head.

2. The putter-type golf club head of claim 1, wherein the first material is selected from the group consisting of: 8620 alloy steel, S25C steel, carbon steel, maraging steel, 17-4 stainless steel, 303 stainless steel, 304 stainless steel, stainless steel alloy, tungsten, or manganese.

3. The putter-type golf club head of claim 1, wherein the second material is a composite material comprising a thermoplastic polymer matrix material and a filler.

4. The putter-type golf club head of claim 3, wherein the thermoplastic polymer matrix material is selected from the group consisting of: thermoplastic polyurethane (TPU), polyamine 6-6 (PA66), and polyamide 6 (PA6).

5. The putter-type golf club head of claim 3, wherein the filler is a fiber, comprising either a carbon or glass.

6. The putter-type golf club head of claim 5, the composite material comprises 30-40% fillers by volume.

7. The putter-type golf club head of claim 6, wherein the chassis and putter-type body are integral and form an alignment feature; and wherein the alignment feature is positioned on the crown.

8. The putter-type golf club head of claim 7, wherein the alignment feature is selected from the group consisting of: a line, a series of lines, a circle, a dashed line, a triangle, a channel, a trough, a series of troughs, and a channel.

9. The putter-type golf club head of claim 1, wherein the body abuts at least 30% of the chassis.

10. The putter-type golf club head of claim 1, wherein the chassis can comprise one or more weights;

wherein the one or more weights comprise a weight density; and wherein the weight density is greater than the first density of the first material.

11. The putter-type golf club head of claim 1, comprises a club head volume ranging between 25 cc and 125 cc; and a club head mass ranging between 320 and 385 grams.

12. The putter-type golf club head of claim 1, wherein a moment of inertia of the putter-type golf club head about a y-axis center of gravity is between 3500 g $cm^2$-8000 g $cm^2$.

13. A putter-type golf club head comprising:

a toe end, a heel end, a striking surface, a rear portion, a sole, and a crown;

wherein the heel end is opposite the toe end;

wherein the striking surface is adjacent to the toe end and the heel end;

wherein the rear portion is opposite the striking surface and adjacent to the toe end and the heel end;

wherein the sole spans from the heel end to the toe end, and from the striking surface to the rear portion;

wherein the sole is positioned in a ground plane when the putter-type golf club head is at an address position; and wherein the crown is opposite the sole, and spans from the heel end to the toe end, and from the striking surface to the rear portion;

a chassis having a U-shape from a top view occupying portions of the toe end, the heel end, and the rear portion and forming a striking surface heel end and a striking surface toe end;

wherein the chassis comprises a first material comprising a first density of at least 7 g/$cm^3$;

a body comprising a second material comprising a second density of 4 g/$cm^3$ or less;

wherein the first material and the second material combine to form an entirety of the striking surface;

the chassis further comprises:

a heel portion, a toe portion, a rear, a front, an upper surface, and a lower surface;

wherein the heel portion is opposite the toe portion and adjacent to the rear;

wherein the upper surface is opposite the lower surface;

wherein the front is adjacent to the toe portion and the heel portion, and opposite the rear;

an interior wall extending from the upper surface to the lower surface;

wherein the heel portion, the toe portion, and the rear form a flow region comprising a void bounded by the interior wall of the chassis and extending from the upper surface to the lower surface;

a first interlocking feature extending from the interior wall proximate the heel portion and into the flow region, forming a first anchor aperture having a semi-circular shape;

a second interlocking feature extending from the interior wall proximate the rear and into the flow region, forming a second anchor aperture having a semi-circular shape;

a third interlocking feature extending from the interior wall proximate the toe portion and into the flow region, forming a third anchor aperture having a semi-circular shape;

wherein the body encases an entirety of the first interlocking feature, the second interlocking feature, and the third interlocking feature;

wherein the chassis comprises less than 50% of a total volume of the putter-type golf club head;

wherein the chassis comprises between 50% to 55% of an overall mass of the putter-type golf club head;

wherein the body abuts the interior wall such that the body extends through and continuously fills the flow region from the crown to the sole, to integrally interlock the body and the chassis, and to form the putter-type golf club head;

wherein the chassis and the body are co-molded together; and wherein the body abuts at least 30% of the chassis.

14. The putter-type golf club head of claim 13, wherein the body abuts at least 80% of the chassis.

15. The putter-type golf club head of claim 13, wherein the first material is selected from the group consisting of: 8620 alloy steel, S25C steel, carbon steel, maraging steel, 17-4 stainless steel, 303 stainless steel, 304 stainless steel, stainless steel alloy, tungsten, or manganese.

16. The putter-type golf club head of claim 13, wherein the second material is a composite material comprising a thermoplastic polymer matrix material and a filler.

17. The putter-type golf club head of claim 16, wherein the thermoplastic polymer matrix material is selected from the group consisting of: thermoplastic polyurethane (TPU), polyamine 6-6 (PA66), and polyamide 6 (PA6).

18. The putter-type golf club head of claim 16, wherein the filler is a fiber, comprising either a carbon or glass.

19. The putter-type golf club head of claim 18, the composite material comprises 30-40% fillers by volume.

20. The putter-type golf club head of claim 13, comprises a club head volume ranging between 25 cc and 125 cc; and a club head mass ranging between 320 and 385 grams, and wherein a moment of inertia of the putter-type golf club head about a y-axis center of gravity is between 3500 g·$cm^2$-8000 g·$cm^2$.

* * * * *